US006361136B1

(12) United States Patent
Watanabe et al.

(10) Patent No.: US 6,361,136 B1
(45) Date of Patent: Mar. 26, 2002

(54) DETECTION SYSTEM, LIQUID-JET PRINTING APPARATUS AND LIQUID CONTAINER

(75) Inventors: Itaru Watanabe; Shinji Takagi, both of Kawasaki; Soichi Hiramatsu, Hachioji; Osamu Sato, Chigasaki; Kenta Udagawa, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/025,791

(22) Filed: Feb. 19, 1998

(30) Foreign Application Priority Data

| | | |
|---|---|---|
| Feb. 19, 1997 | (JP) | 9-035092 |
| Feb. 19, 1997 | (JP) | 9-035093 |
| Feb. 19, 1997 | (JP) | 9-035094 |
| Feb. 19, 1997 | (JP) | 9-035095 |
| Feb. 19, 1997 | (JP) | 9-035096 |
| Mar. 28, 1997 | (JP) | 9-078425 |
| Jan. 23, 1998 | (JP) | 10-011785 |

(51) Int. Cl.[7] ..... B41J 2/195; B41J 29/38; B41J 29/393

(52) U.S. Cl. ..... 347/7; 347/6; 347/19

(58) Field of Search ..... 347/6, 7; 359/399, 359/831

(56) References Cited

U.S. PATENT DOCUMENTS

| | | | | |
|---|---|---|---|---|
| 4,246,489 A | * | 1/1981 | Yoshida et al. | 250/577 |
| 5,616,929 A | * | 4/1997 | Hara | 250/573 |
| 5,997,121 A | * | 12/1999 | Altfather et al. | 347/7 |
| 6,012,795 A | * | 1/2000 | Saito et al. | 347/7 |
| 6,137,503 A | * | 10/2000 | Hashimoto et al. | 347/19 |

FOREIGN PATENT DOCUMENTS

| | | | |
|---|---|---|---|
| EP | 0 573 274 A | 12/1993 | B41J/2/175 |
| EP | 0 753 411 A | 1/1997 | B41J/2/175 |
| EP | 0 779 156 A | 6/1997 | B41J/2/175 |
| FR | 2 672 390 A | 8/1992 | G01F/23/28 |
| JP | 7-89090 | 4/1995 | B41J/2/175 |
| JP | 7218321 | 8/1995 | G01F/23/26 |
| JP | 7-311072 | 11/1995 | G01F/23/26 |
| JP | 8112907 | 5/1996 | B41J/2/175 |
| JP | 9-29989 | 2/1997 | B41J/2/175 |
| JP | 9 174877 | 7/1997 | B41J/2/175 |
| JP | 9174877 | 7/1997 | B41J/2/175 |

* cited by examiner

*Primary Examiner*—John Barlow
*Assistant Examiner*—Alfred Dudding
(74) *Attorney, Agent, or Firm*—Fitzpatrick, Cella, Harper & Scinto

(57) ABSTRACT

Precision of detecting existence/non-existence of a liquid container and a liquid level in the container is improved even if the detection is performed by a single sensor, or even if the S/N ratio of the detection is low, the detected results can be discriminated from one another. For this, a concave polyhedron is provided in the center of the bottom surface of an optical prism in order to reduce the amount of light reflected on the bottom surface of the optical prism and returned to a photoreceptor. Moreover, a reflection curved surface having a quadratic surface e.g. spherical surface or paraboloid, is provided on the bottom surface of an ink tank, for reflecting light emitted by an optical unit consisting of a light emission device and a photoreceptor. By virtue of this, even in a case where an arrangement angle or position of the optical unit is deviated to some extent, sufficient amount of light for the photoreceptor can be received, making it possible to accurately detect existence/non-existence of ink and/or existence/non-existence of an ink tank.

44 Claims, 32 Drawing Sheets

DETECTION SYSTEM, LIQUID-JET PRINTING APPARATUS AND LIQUID CONTAINER

BACKGROUND OF THE INVENTION

The present invention relates to a liquid-jet printing apparatus and a liquid container for performing printing on a print medium by discharging liquid and, more particularly, to a detection system which can detect whether or not an ink level in a liquid container reaches a predetermined level, liquid-jet printing apparatus using the detection system, liquid container used together with the system and apparatus, and a system of receiving changes in amount of light.

According to the conventionally known devices for detecting existence/non-existence of ink in an ink tank containing ink, electrodes are provided in the ink tank and electric conductivity between the electrodes is measured, or a discharged ink droplet is optically detected. Generally, a method of using electrodes complicates the structure of the ink tank. Thus, means for optically detecting existence/non-existence of ink is usually employed.

Particularly, a liquid-jet printing apparatus for performing printing by discharging liquid, generally comprises print means (printhead), an ink tank (liquid container), conveyance means for conveying a print medium and control means for controlling the above means. Herein, if ink left in the ink tank is lower than a predetermined amount, ink supplied to the printhead becomes insufficient and may cause discharge failure. For this reason, an apparatus for detecting a residual ink amount or existence/non-existence of ink in an ink tank has been suggested.

As ink-existence detection apparatus of this type, for instance, Japanese Patent Application Laid-Open (KOKAI) No. 8-112907 discloses an ink-jet printing apparatus which detects existence/non-existence of ink in an ink tank having a negative-pressure-generating member e.g. absorbent material, foaming material and the like, by transmitting light through a part of the transparent or semi-transparent wall surface of the ink tank and detecting changes in optical reflectance in the boundary portion between the wall surface of the ink tank and the negative-pressure-generating member.

Furthermore, U.S. Pat. No. 5,616,929 discloses an ink tank integrating an optical ink detection portion, formed with a light-transmitting material made of the same material as the ink tank, where the surface contacting ink has a predetermined angle with respect to a detection light path.

Moreover, in a case where an ink tank is detachable from a printing apparatus, the printing apparatus needs to automatically determine whether or not the ink tank is properly attached to the printing apparatus at the time of printing operation. For this, Japanese Patent Application Laid-Open (KOKAI) No. 9-174877 discloses a sensor system for detecting existence of an ink tank and ink of a predetermined level in the ink tank.

As described above, in the sensor system for detecting existence of an ink tank and ink level in the ink tank (or existence/non-existence of ink in the ink tank), it is desirable to share a detection sensor (light emission device and photoreceptor) so as to simplify the structure of the printing apparatus including the sensor system. Japanese Patent Application Laid-Open (KOKAI) No. 9-29989 discloses an ink-jet printing apparatus capable of detecting existence/non-existence of ink and existence/non-existence of an ink tank by a single photosensor.

Besides the above, Japanese Patent Application Laid-Open (KOKAI) No. 7-89090 is known as a detection apparatus for detecting liquid existence in a liquid container comprising: a negative-pressure generating member accommodating chamber accommodating a negative-pressure-generating member and having a liquid supply opening and atmospheric-air communicating portion; and a liquid containing chamber, which forms a substantially enclosed space, having a communicating portion connecting to the negative-pressure generating member accommodating chamber.

The use of the above-described sensor system is a reasonable approach in detecting existence/non-existence of an ink tank and ink of a predetermined level (or existence/non-existence of ink) in the ink tank with low cost.

However, since the above sensor system utilizes an optical sensor, it is preferable to satisfy the following requirements with low cost for more accurate detection, taking into consideration an expected life span of an optical device influenced by deterioration of a light emission device, a stained photoreceptor or the like, non-precise formation of the surface of a reflector, changes in an amount of light and so on in the surrounding environment.

The first requirement is to improve precision in detection by increasing an S/N (signal/noise) ratio. The second requirement is to accurately discriminate between the detection of existence/non-existence of an ink tank and the detection of ink of a predetermined level (or existence/non-existence of ink) in the ink tank when these are detected by a single sensor.

SUMMARY OF THE INVENTION

The present invention has been made in consideration of the above situation, and has as its first object to provide a practical detection system which can improve precision in detection by reducing noise received by a photoreceptor, liquid-jet printing apparatus using the detection system, and liquid container used together with the system and apparatus.

A second object of the present invention is to provide a liquid container which can accurately discriminate between the detection of existence/non-existence of a liquid container and the detection of a liquid level (or existence/non-existence of liquid) in the container when these are detected by a single sensor.

A third object of the present invention is to provide a detection system and liquid container which can improve precision in detection by reducing noise received by the photoreceptor, and which can accurately discriminate between the detection of existence/non-existence of a liquid container and the detection of a liquid level (or existence/non-existence of liquid) in the container when these are detected by a single sensor.

A fourth object of the present invention is to provide a liquid-jet printing apparatus which can accurately discriminate between the detection of existence/non-existence of a liquid container and the detection of a liquid level (or existence/non-existence of liquid) in the container when these are detected by a single sensor, even if the first requirement is not satisfied.

In order to attain the above first object, the detection system according to the present invention has the following configuration.

More specifically, the present invention provides a detection system comprising: optical means including a light emission unit for emitting light to a liquid container and a light receptor for receiving reflected light of the emitted light; a prism formed with light transmitting material, the prism having a surface constructing a part of an external wall surface of the liquid container and plural reflection surfaces, which are different from the surface, each being in contact with liquid and having a predetermined angle with respect to a light path of the emitted light; and determination means for determining whether or not the liquid in the liquid container exists based on the reflected light of the light emitted on the prism and received by the optical means, wherein the liquid container has a diffusion portion, provided in between a portion opposing to the light emission unit and another portion opposing to the light receptor of the prism, for diffusing light reflected on the external wall surface of the liquid container so as to prevent the reflected light from returning to the light receptor of the optical means.

Note that light in this present invention includes not only visible light but also infrared rays or the like.

Further note that it is preferable that the prism is provided on the bottom surface portion of the liquid container.

Furthermore, it is preferable that the diffusion portion is a concave polyhedral portion provided in the center of the bottom surface portion of the prism, or that the diffusion portion is a rough surface provided in the center of the bottom surface portion of the prism.

Moreover, it is preferable that the detection system further comprises a detection portion provided in the neighborhood of the prism, in cooperation with the optical and determination means, for when light is emitted by the optical means, determining whether or not the liquid container exist by reflecting a predetermined amount of light regardless of whether or not the liquid in the liquid container exists.

In this case, it is preferable that the detection portion is a concave curved surface portion provided on the external wall surface of the liquid container. Further, it is preferable that the amount of light, reflected on the detection portion, detected by the light receptor, is in between an amount of light reflected on the prism in a case where the liquid container contains liquid and an amount of light reflected on the prism in a case where the liquid container does not contain liquid. Moreover, it is preferable that the detection system further comprises a second diffusion portion, different from the diffusion portion, which is provided in between the prism and the detection portion, for diffusing light reflected on the external wall surface of the container, thereby preventing the reflected light from returning to the light receptor.

It is preferable that the determination means comprises: maximum value detection means for respectively obtaining maximum values of an amount of reflected light received when the liquid container and the optical means are within respective predetermined ranges; comparison means for comparing the maximum values detected by the maximum value detection means with respective predetermined threshold values; and discrimination means for discriminating whether or not the liquid in the liquid container exists and whether or not the liquid container exists, based on the comparison result obtained by the comparison means.

Furthermore, in order to attain the above first object, the liquid-jet printing apparatus according to the present invention has the following configuration.

More specifically, the present invention provides a liquid-jet printing apparatus comprising: a container holding portion capable of holding a liquid container which contains liquid; optical means, provided near the container holding portion, including a light emission unit for emitting light to the liquid container and a light receptor for receiving reflected light of the emitted light; and detection means for detecting whether or not liquid in the liquid container exists, based on the reflected light of the light emitted by the light emission unit and received by the light receptor, wherein the liquid container held by the container holding portion comprises: a prism formed with light transmitting material, the prism having a surface constructing a part of an external wall surface of the liquid container and plural reflection surfaces, which are different from the surface, each being in contact with liquid and having a predetermined angle with respect to a light path of the emitted light; and a diffusion portion provided in between the light reception portion and light reflecting portion of the prism, for diffusing light reflected on the external wall surface of the liquid container so as to prevent the reflected light from returning to the light receptor of the optical means.

Furthermore, in order to attain the above first object, the liquid container according to the present invention has the following configuration.

More specifically, the present invention provides a liquid container comprising: a liquid storage for reserving liquid; a liquid supply opening for supplying the liquid reserved in the liquid storage to an external; and a prism formed with light transmitting material, the prism having a surface constructing a part of an external wall surface of the liquid storage and plural reflection surfaces, which are different from the surface, each being in contact with liquid and having a predetermined angle with respect to a light path of emitted light, wherein the prism has a concave polyhedral portion constructed with plural surfaces having a different shape from that of the plural reflection surfaces of the prism, the concave polyhedral portion provided on the surface of the prism which constructs the external wall surface of the liquid container.

Note that it is preferable that the prism is provided on the bottom surface portion of the liquid container.

Furthermore, it is preferable that a concave depth of the concave polyhedral portion is about a thickness of an external wall surface whose part is constructed by the prism.

Moreover, it is preferable that a side surface of the prism partially contacts against a part of an external wall surface of the liquid container, and a notch is provided in the external wall surface which the side surface of the prism partially contacts against. Among the surfaces of the prism, which form a part of the external wall surface of the liquid container, it is preferable that at least one of the surfaces separated by the concave polyhedral portion has a convex surface. It is preferable that the internal surface of the concave portion of the concave polyhedral portion has a rough surface, or that the plural reflection surfaces of the prism have a smooth surface and the side surface of the prism has a rough surface so as to irregularly reflect light.

Furthermore, it is preferable that the liquid container further comprises a detection portion provided in the neighborhood of the prism, when light is emitted by external optical means, for reflecting a predetermined amount of light regardless of whether or not the liquid exists in the liquid container. In this case, it is preferable that the detection portion is a concave surface portion provided on the external wall surface of the liquid container, and that a diffusion portion is further provided in between the prism and the detection portion, for diffusing light reflected on the external wall surface of the liquid container, thereby preventing the reflected light from returning to a light receptor of the external optical means.

Moreover, in order to attain the aforementioned first object, a light amount change receiving system according to the present invention has the following configuration.

More specifically, the present invention provides a light amount change receiving system for emitting light on a prism and receiving reflected light of the emitted light, the prism formed with light transmitting material, having a surface constructing a part of an external wall surface of a container and plural reflection surfaces, which are different from the surface, each being contact with contents of the container and having a-predetermined angle with respect to a light path of the emitted light, comprising: a diffusion portion, provided in between a light incident portion of the prism for receiving the light emitted from light emission means and a light reflecting portion, of the prism, for reflecting the light intended to return to light reception means, for diffusing light reflected on an external wall surface of the container, thereby preventing the light from returning to the light reception means.

Further, in order to attain the aforementioned first object, a liquid container according to the present invention has the following configuration.

More specifically, the present invention provides a liquid container attachable/detachable to/from a printing apparatus having optical means in which a light emission unit and a light receptor are fixed with a predetermined space, the liquid container being movable relative to the optical means, comprising: a prism formed with light transmitting material, having a surface constructing a part of an external wall surface of the liquid container and plural reflection surfaces, which are different from the surface, each being in contact with liquid and having a predetermined angle with respect to a light path of light; and a diffusion portion provided on a surface of the prism constructing a part of an external wall surface of the liquid container, for diffusing light reflected on an external wall surface of the container, thereby preventing the light from returning to the light receptor, wherein the diffusion portion is provided in between a light incident portion of the prism for receiving light from the light emission portion and a light reflecting portion of the prism for reflecting the light intended to return to the light receptor.

Herein, it is preferable that the liquid container further comprises: a negative-pressure generating member accommodating chamber, accommodating a negative-pressure-generating member and having a liquid supply opening and an atmospheric-air communicating portion; and a liquid storage, having a passage opening connected to the negative-pressure generating member accommodating chamber and forming a substantially enclosed space, wherein the prism is provided in the liquid storage.

Furthermore, in order to attain the aforementioned second object, the liquid container according to the present invention has the following configuration.

More specifically, the present invention provides a liquid container attachable/detachable to/from a printing apparatus having optical means in which a light emission unit and a light receptor are fixed with a predetermined space, comprising: a liquid storage for reserving liquid; a liquid supply opening for supplying the liquid reserved in the liquid storage to an external; a first detection portion provided on a surface of the liquid storage, wherein when light is emitted, the first detection portion reflects different amounts of light depending on whether or not the liquid in the liquid storage exists; and a second detection portion provided in the neighborhood of the first detection portion, wherein when light is emitted, the second detection portion reflects a predetermined amount of light, wherein the container is movable relative to the optical means, and the predetermined amount of light reflected by the second detection portion is in between an amount of reflected light in a case where the first detection portion detects existence of liquid and an amount of reflected light in a case where the first detection portion detects non-existence of liquid.

Herein, it is preferable that the first detection portion is a light-transmitting prism provided on the bottom surface of the liquid storage, and the second detection portion is a concave curved surface portion provided on the external wall surface of the liquid container. In this case, it is preferable that a radius of curvature of the concave curved surface portion is larger in a first direction than a second direction, the first direction being parallel to a line connecting a light incident portion and light reflecting portion of the first detection portion, the second direction being perpendicular to the first direction.

Furthermore, it is preferable that the internal wall surface of the liquid container where the second detection portion is arranged has a rough surface. It is preferable that the liquid container further comprises a diffusion portion, provided in between the first detection portion and the second detection portion, for diffusing light reflected on the external wall surface of the liquid container, thereby preventing the light from returning to the light receptor. In this case, the second detection portion is a concave curved surface portion provided on the external wall surface of the liquid container, the diffusion portion is a rough surface formed integratedly on the external wall surface of the bottom surface of the liquid container, and an end portion of the concave curved surface portion is a part of a circular arc. It is preferable that the diffusion portion is further projected outwardly from the external wall surface of the container as compared to the first detection portion, or is situated on the same surface level.

Furthermore, in order to attain the aforementioned second object, the liquid-jet printing apparatus according to the present invention has the following configuration.

More specifically, the present invention provides a liquid-jet printing apparatus capable of including the liquid container having the above-described configuration, comprising: a carriage capable of holding the liquid container and scanning in the second direction; optical means, provided along a scanning path of the carriage, capable of emitting light to and the first and second detection portions of the liquid container and receiving reflected light; control means for controlling to drive the optical means while moving the liquid container by the carriage in the neighborhood of the optical means; and detection means for detecting existence/non-existence of liquid in the liquid container and/or existence/non-existence of the liquid container, based on the reflected light received by the optical means, wherein the light emission unit and light receptor of the optical means are arranged in the first direction.

Herein, it is preferable that the detection means comprises: maximum value detection means for respectively obtaining maximum values of an amount of received reflected light when a relative portion of the liquid container and the optical means are within respective predetermined ranges; comparison means for comparing the maximum values detected by the maximum value detection means with respective predetermined threshold values; and determination means for determining existence/non-existence of liquid in the liquid container and/or existence/non-existence of the liquid container, based on the comparison result obtained by the comparison means.

Furthermore, in order to attain the aforementioned third object, the liquid container according to the present invention has the following configuration.

More specifically, the present invention provides a liquid container comprising: a liquid storage for reserving liquid; a liquid supply opening for supplying the liquid reserved in the liquid storage to an external portion; a first detection portion provided on a surface of the liquid storage, wherein when light is emitted, the first detection portion reflects different amounts of light depending on whether or not liquid in the liquid storage exists; and a second detection portion provided in the neighborhood of the first detection portion, wherein when light is emitted, the second detection portion reflects a predetermined amount of light; and a diffusion portion, provided in between the first detection portion and the second detection portion, for diffusing light reflected on the external wall surface of the liquid container, thereby preventing the light from returning to an externally provided light receptor.

Herein, it is preferable that the first detection portion and the second detection portion are provided on the bottom surface of the liquid container.

Furthermore, it is preferable that the diffusion portion is further projected outwardly from the external wall surface of the container as compared to the first detection portion, or is situated on the same surface level.

Still further, it is preferable that the diffusion portion is a rough surface formed integratedly on the external wall surface of the bottom surface of the liquid container, or a concave portion formed on the external wall of the bottom surface of the liquid container.

Still further, the liquid container preferably further comprises: plural liquid storages capable of respectively reserving plural types of liquid; and plural prisms corresponding to the plural liquid storages, wherein a diffusion portion is provided in between the plural prisms.

Furthermore, in order to attain the aforementioned fourth object, the liquid-jet printing apparatus according to the present invention has the following configuration.

More specifically, the present invention provides a liquid-jet printing apparatus for performing printing by discharging liquid, comprising: a liquid container having a first detection portion and a second detection portion adjacent to the first detection portion, on at least one surface of the liquid container; a carriage capable of holding the liquid container and scanning along a direction in which the first and second detection portions are arranged; optical means, provided along a scanning path of the carriage, capable of emitting light to the first and second detection portions of the liquid container and receiving reflected light; control means for controlling to drive the optical means while moving the liquid container by the carriage in the neighborhood of the optical means; and detection means for detecting existence/non-existence of liquid in the liquid container and/or existence/non-existence of the liquid container, based on reflected light received by the optical means, wherein the detection means comprises: maximum value detection means for respectively obtaining maximum values of an amount of received reflected light when a relative portion of the liquid container and the optical means are within respective predetermined ranges; comparison means for comparing the maximum values detected by the maximum value detection means with respective predetermined threshold values; and determination means for determining existence/non-existence of liquid in the liquid container and/or existence/non-existence of the liquid container, based on the comparison result obtained by the comparison means.

Herein, it is preferable that the determination means first determines existence/non-existence of the liquid container, then determines existence/non-existence of liquid in the liquid container.

Moreover, it is preferable that the liquid-jet printing apparatus further comprises minimum value detection means for obtaining a minimum value of an amount of reflected light detected at a predetermined portion other than the first detection portion or the second detection portion, wherein the comparison means compares differences between the maximum values obtained by the maximum value detection means and the minimum value detected by the minimum value detection means, with predetermined threshold values respectively.

Herein, it is preferable that the liquid container comprises: a negative-pressure generating member accommodating chamber, having a liquid supply opening and an atmospheric-air communicating portion, for accommodating a negative-pressure-generating member; and a liquid storage, having a passage opening connected to the negative-pressure generating member accommodating chamber and forming a substantially enclosed space, wherein after the determination means in cooperation with the first detection portion detects existence/non-existence of liquid in the liquid container, a number of dots corresponding to liquid droplets discharged is counted and a request for exchanging the liquid container is displayed before consuming liquid in the negative-pressure generating member accommodating chamber.

Note that the prism employed in the present invention is formed with light-transmitting material, and has a surface constructing a part of the external wall surface of a container and plural reflection surfaces which are different from the foregoing surface. The reflection surfaces which contact with contents (e.g. ink) of the container have a predetermined angle with respect to a path of light. The prism is structured such that the amount of light, reflected on the surface constructing a part of the external wall of the container serving as an ink tank, is different depending on existence or non-existence of the contents in the container. In other words, the plural reflection surfaces are provided in the internal wall surface side of the container. Note that the plural reflection surfaces may be replaced with a curved surface. Moreover, the bottom surface portion of the prism is a surface which constructs a part of an external wall surface of the container.

Further, the diffusion portion indicates a portion for diffusing light reflected on the external wall surface of the container, thus preventing the light from returning to the light receptor.

Moreover, the concave polyhedral portion is a concave portion constituted with plural surfaces or a curved surface, provided on the surface (bottom surface portion) constructing a part of the external wall of the prism. In a case where the concave polyhedral portion is optically used, it serves as the aforementioned diffusion portion. The concave polyhedral portion has a concave shape when it is seen from the external wall surface of the container.

Furthermore, the ink-existence/non-existence detection portion (which is often referred to as a "first detection portion" in the summary) and ink-tank-existence/non-existence detection portion (which is often referred to as a "second detection portion" in the summary) respectively indicate a portion having the function for detecting existence/non-existence of ink, and a portion having the function for detecting existence/non-existence of an ink tank.

The invention is particularly advantageous since the detection system, liquid-jet printing apparatus and liquid container according to the present invention enables to improve the precision in detecting existence/non-existence of the liquid container or detecting existence/non-existence of liquid therein by reducing noise returned to the photoreceptor.

Moreover, according to the liquid container and liquid-jet printing apparatus according to the present invention, there is an advantage in that the detection of existence/non-existence of a liquid container is accurately discriminated from the detection of a liquid level (or existence/non-existence of liquid) in the container when these are detected by a single sensor. Furthermore, even if the S/N (signal/noise) ratio is somewhat low, the present invention enables to detect existence/non-existence of a liquid container and a liquid level in the container.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follows the description for determining the scope of the invention. dr

BRIEF DESCRIPTION OF THE DRAWINGS

The accompanying drawings, which are incorporated in and constitute a part of the specification, illustrate embodiments of the invention, and together with the description, serve to explain the principles of the invention.

DETAILED DESCRIPTION OF THE PREFERRED EMBODIMENTS

Preferred embodiments of the present invention will be described in detail in accordance with the accompanying drawings.

First, a liquid-jet printing apparatus, which is commonly used in some of the embodiments employing the detection system according to the present invention, will be described.

Figure 1:
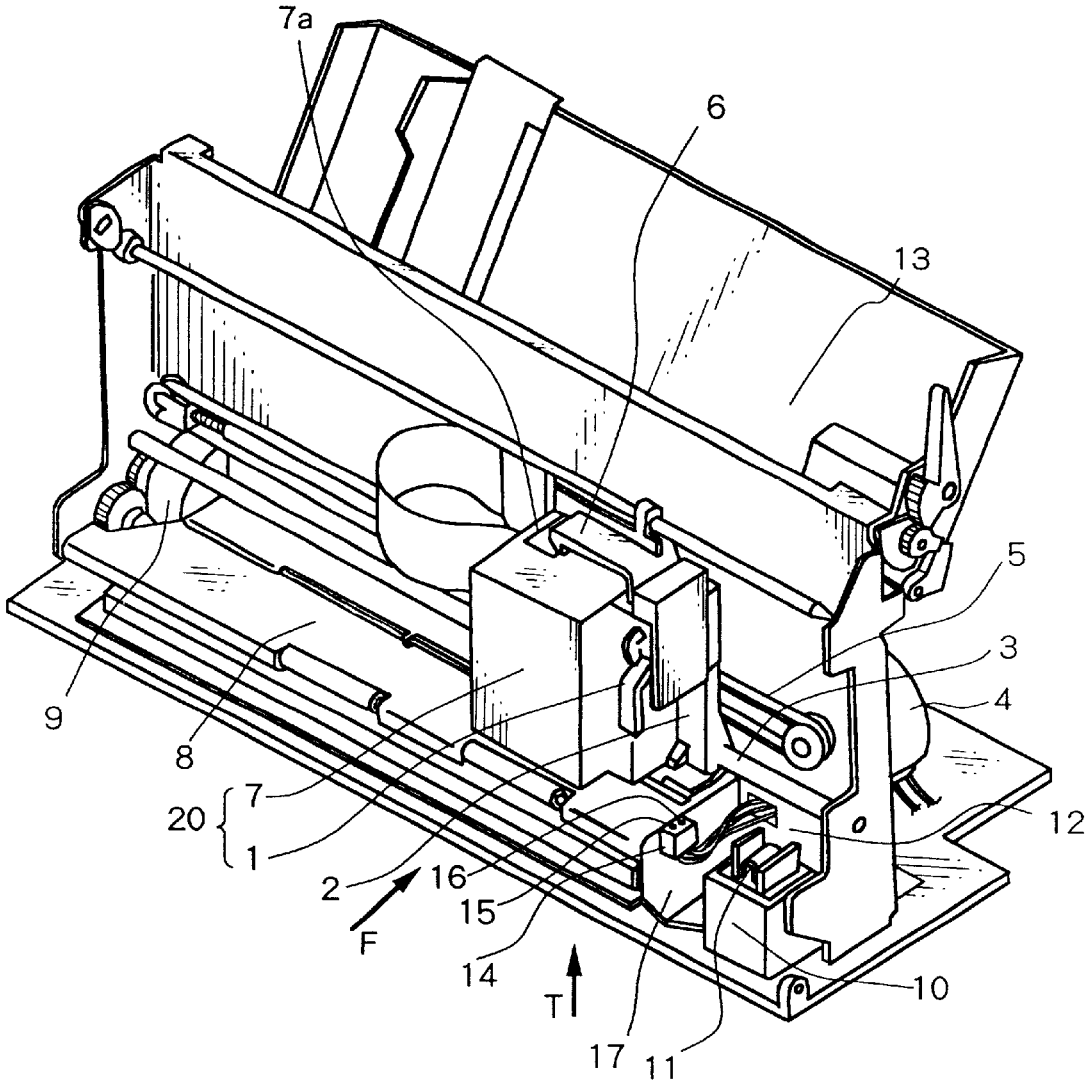
FIG. 1 is a perspective view showing a schematic construction of a printing apparatus, as a typical embodiment of the present invention, which includes a printhead for performing printing in accordance with an ink-jet printing method.

FIG. 1 is a perspective view showing a schematic construction of a printing apparatus, as a typical embodiment of the present invention, which includes a printhead for performing printing in accordance with an ink-jet printing method. In the present embodiment, a printhead 1 connected with an ink tank 7 which supplies ink thereto construct an ink cartridge 20 as shown in FIG. 1. Note, in the present embodiment, although the ink cartridge 20 is configured such that the printhead 1 and ink tank 7 are separable as will be described later, an ink cartridge where a printhead and ink tank are integrated as a unit may be used.

On the bottom surface of the ink tank 7, a prism for detecting existence/non-existence of ink and a concave light-reflection surface for detecting existence/non-existence of an ink tank are provided. The configuration thereof will be described later.

Referring to FIG. 1, the printhead 1 is attached to a carriage 2 in the manner such that the printhead discharges ink downward in FIG. 1. While the carriage 2 moves along a guide 3, the printhead 1 discharges ink droplets to form an image on a print medium (not shown) e.g. print paper. Note that the lateral movement (reciprocal movement) of the carriage 2 is realized by rotation of a carriage motor 4 via a timing belt 5. The carriage 2 has an engagement latch 6 which engages with an engagement slot 7*a* of the ink tank, fixing the ink tank 7 to the carriage 2.

Upon printing for one scan by the printhead, the printing operation is suspended, a print medium positioned on a platen 8 is conveyed a predetermined amount by driving a feed motor 9, and image forming for the subsequent scan is performed by moving the carriage 2 along the guide 3.

On the right side of the main body of the printing apparatus, a recovery device 10 which performs recovery operation for maintaining a good ink discharge condition is provided. The recovery device 10 includes a cap 11 for capping the printhead 1, a wiper 12 for wiping the ink discharge surface of the printhead 1, and a suction pump (not shown) for sucking ink from the ink discharge nozzle of the printhead 1.

The driving force, of the feed motor 9 for conveying a print medium, which is normally transmitted not only to the print medium conveyance mechanism, but also to an automatic sheet feeder (ASF) 13.

Moreover, on the side of the recovery device 10, an optical unit 14, consisting of an infrared LED (light emission device) 15 and phototransistor (photoreceptor) 16, is provided for detecting existence/non-existence of ink and existence of an ink tank. These light emission device 15 and photoreceptor 16 are arrayed in the conveyance direction of a print medium (direction indicated by the arrow F). The optical unit 14 is attached to a chassis 17 of the main body of the printing apparatus. Upon attaching the ink cartridge 20 to the carriage 2, if the carriage 2 moves to the right from the position shown in FIG. 1, the ink cartridge 20 comes to the position above the optical unit 14. In this position, it is possible to detect from the bottom of the ink tank 7, the ink existence or existence of an ink tank by using the optical unit 14 (details will be described later).

Next, the configuration for executing print control of the above-described apparatus will be described.

Figure 2:
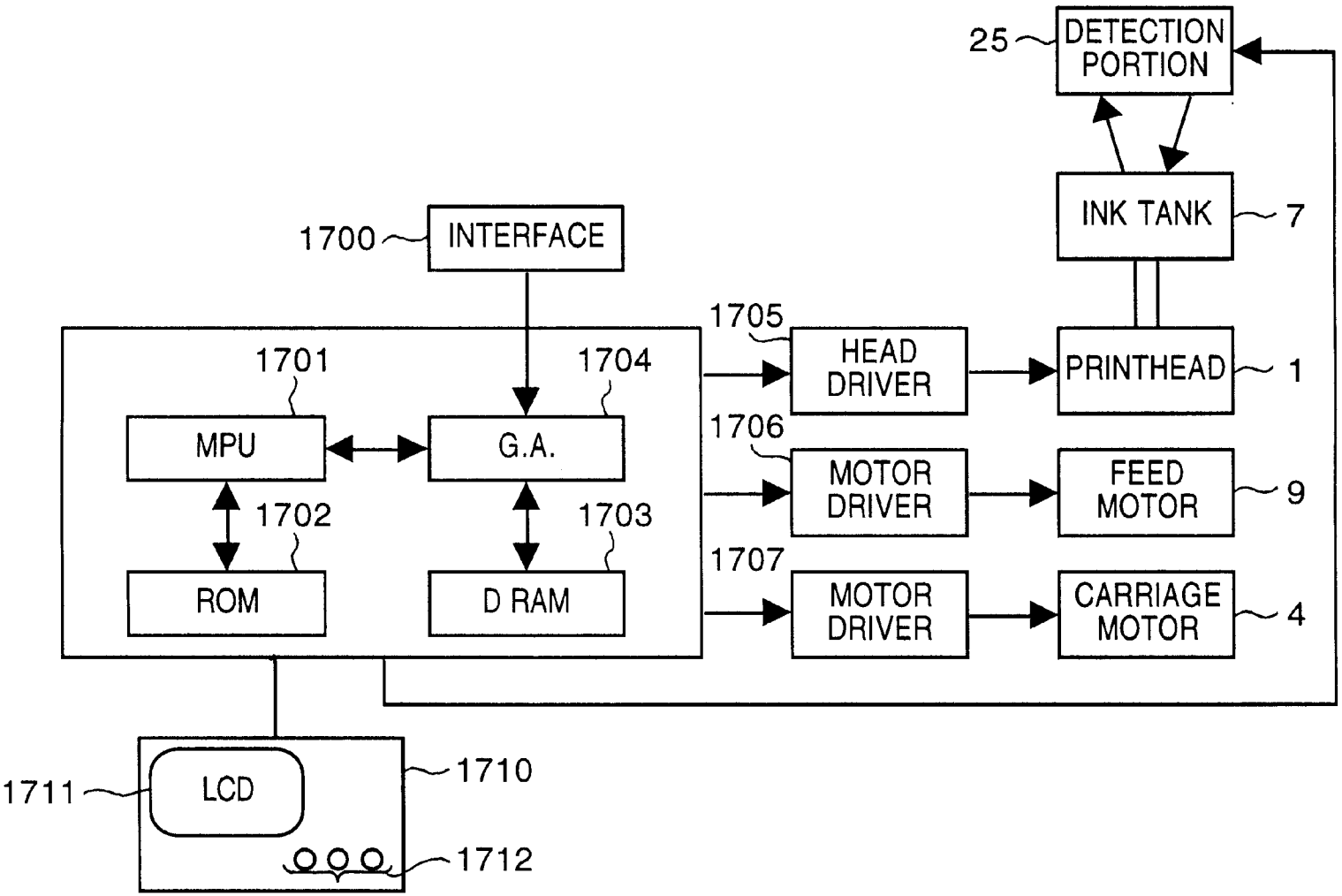
FIG. 2 is a block diagram showing the structure of a control circuit of the printing apparatus.

FIG. 2 is a block diagram showing the structure of a control circuit of the printing apparatus. In FIG. 2, reference numeral 1700 denotes an interface for inputting a print signal; 1701, an MPU; 1702, a ROM for storing control programs to be executed by the MPU 1701; and 1703, a DRAM for storing various data (aforementioned print signal, print data supplied to the printhead 1 and so on). Reference numeral 1704 denotes a gate array (G.A.) which controls supplying print data to the printhead 1, and also controls data transfer among the interface 1700, MPU 1701 and RAM 1703. Reference numeral 1705 denotes a head driver for driving the printhead 1; 1706 and 1707, motor drivers for driving the feed motor 9 and carriage motor 4 respectively.

The operation of the foregoing control structure will now be described. When the interface 1700 receives a print signal, the print signal is converted to print data for printing in between the gate array 1704 and the MPU 1701. Then, as the motor drivers 1706 and 1707 are driven, the printhead 1 is driven in accordance with the print data transmitted by the head driver 1705, performing printing.

Note that reference numeral 1710 denotes a display portion comprising an LCD 1711 which displays various messages related to a condition of printing operation or the printing apparatus, and an LED lamp 1712 including various colors for informing the conditions of printing operation or the printing apparatus.

Moreover, the MPU 1701 controls the operation of an ink-existence/ink-tank-existence detection unit 25 which detects ink in the ink tank 7 or existence of an ink tank. The ink-existence/ink-tank-existence detection unit 25 (hereinafter referred to as detection unit 25) will be described later in detail.

Next, an overall configuration of the ink tank preferably applicable to the present embodiment will be described with reference to FIGS. 3 and 4.

Figure 3A:
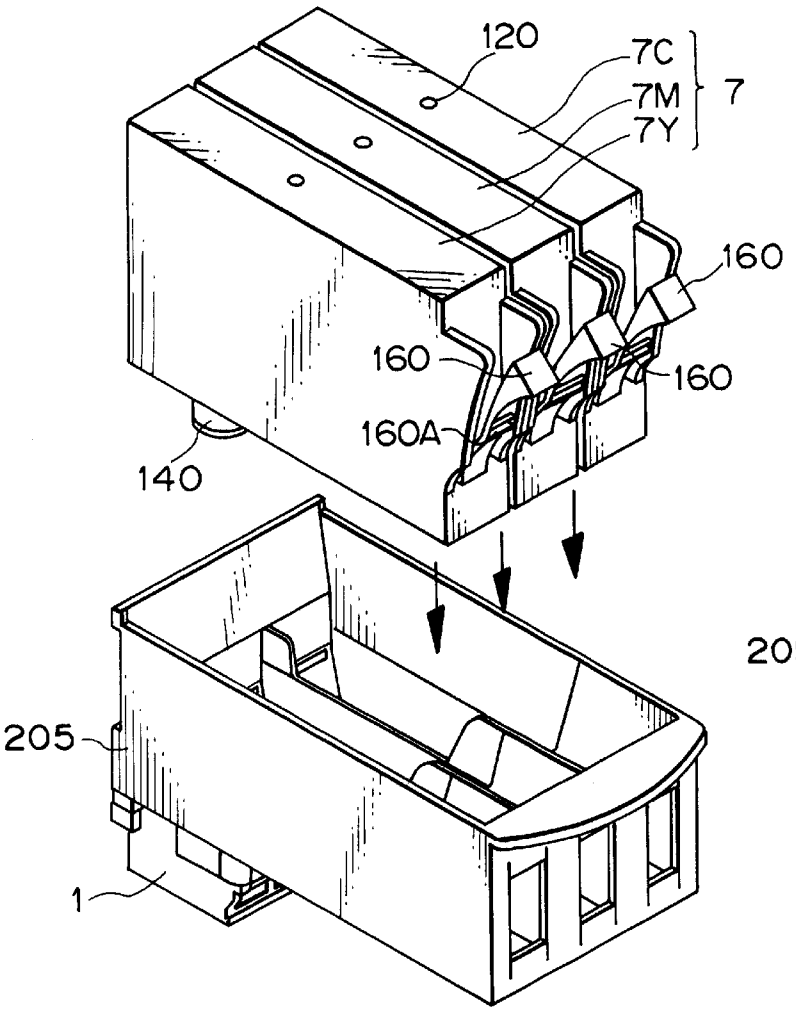
FIGS. 3A and 3B are perspective views showing an external appearance of a head holder 205 holding the ink tank 7 and a printhead 1.
Figure 3B:
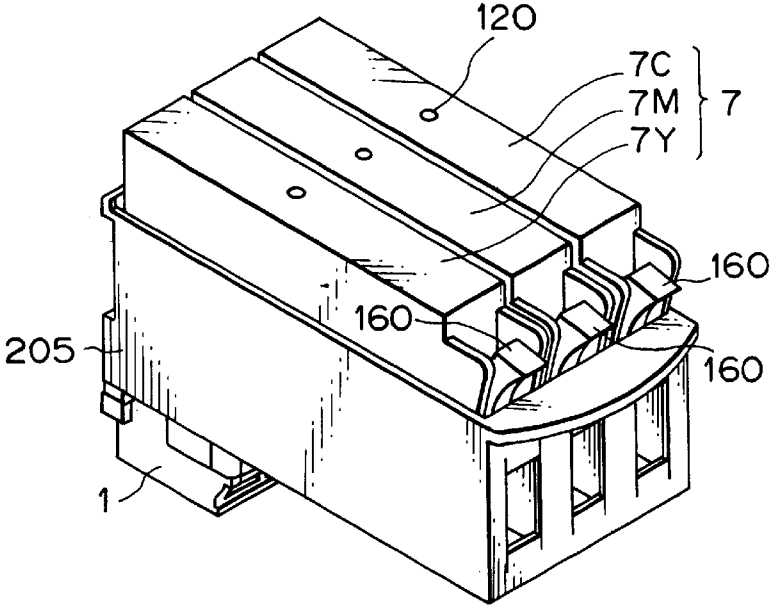
Figure 4:
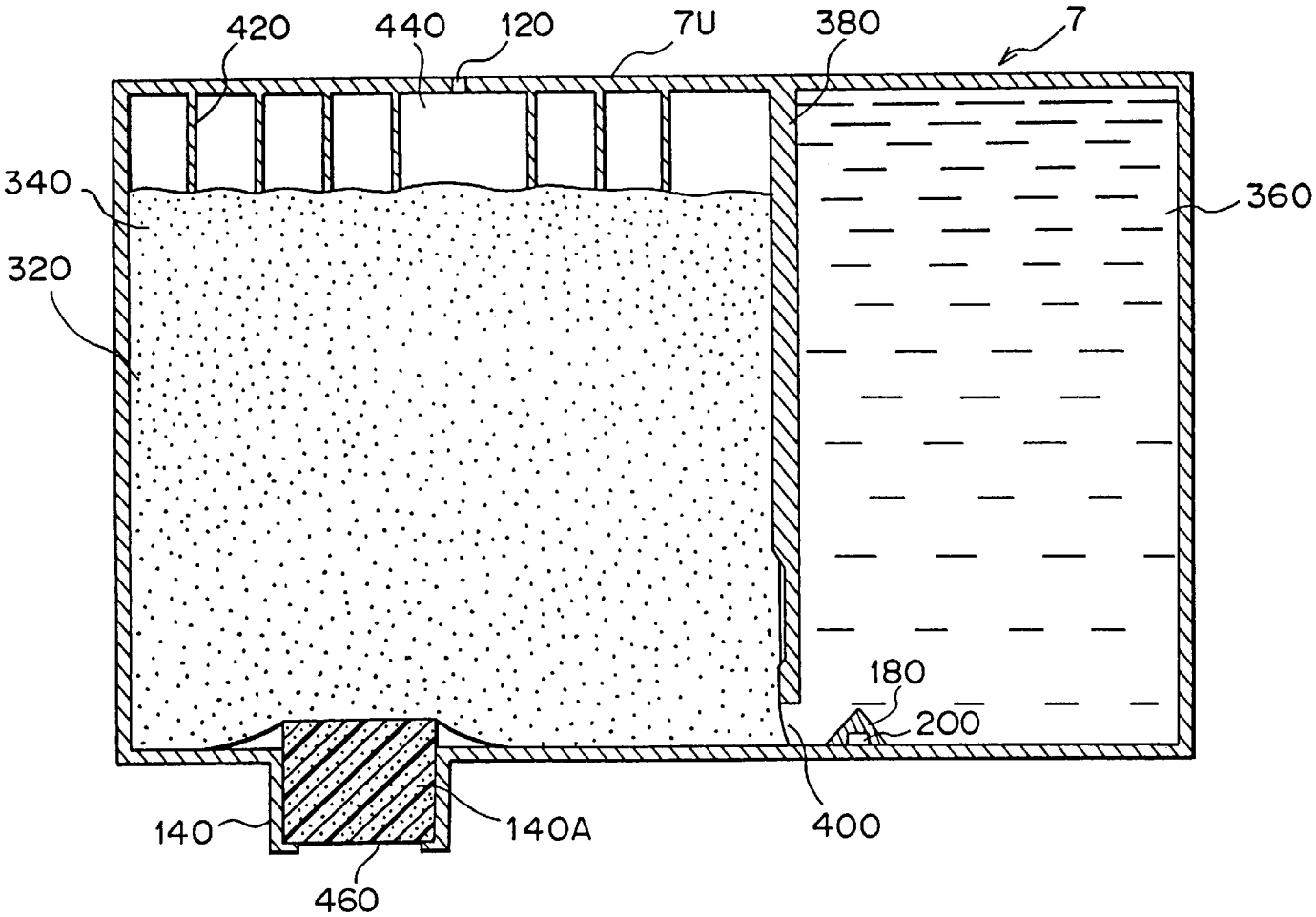
FIG. 4 is a sectional side view showing an internal structure of the ink tank 7.

FIGS. 3A and 3B are perspective views showing an external appearance of a head holder 205 holding the ink tank 7 and the printhead 1. FIG. 3A shows the state where the ink tank 7 is detached from the head holder 205, while FIG. 3B shows the state where the ink tank 7 is held by the head holder 205. FIG. 4 is a sectional side view showing an internal structure of the ink tank 7.

The ink tank 7 according to the present embodiment, which serves as a discharge-liquid container, has a shape of an approximate rectangular parallelepiped, and has an atmospheric-air communicating portion 120 which connects with the internal portion of the ink tank 7.

On the bottom wall 7B of the ink tank 7, an ink supply pipe 140 having an ink supply opening 140A to be served as a discharge-liquid supplying opening is formed. In the shipping process, the atmospheric-air communicating portion 120 is sealed with a film or the like, and the ink supply pipe 140 is sealed with a cap, which is an ink supply opening sealing material.

Reference numeral 160 denotes a resilient lever formed integratedly on the outer portion of the ink tank 7, and a latch 160A is provided in the middle of the lever.

Reference numeral 205 denotes a head holder integrating a printhead, where the aforementioned ink tank 7 is to be attached. In the present embodiment, ink tank 7 including three containers (7C, 7M and 7Y), each having e.g. cyan, magenta or yellow ink, are held in the head holder 205. On the bottom of the head holder 205, the printhead 1 which discharges each of the color ink is integrally formed. A window is provided on the bottom of the head holder 205 so that an ink-existence detection portion and an ink-tank-existence detection portion, which will be described later, can detect whether or not there is ink and whether or not there is an ink tank, in cooperation with the optical unit 14 and detection unit 25.

The printhead 1 is formed such that the plural discharge orifices of the printhead face downward (hereinafter the surface of the printhead where the plural discharge orifices are formed will be referred to as discharge-orifice surface).

From the state shown in FIG. 3A, the ink tank 7 is pressed into the head holder 205 such that the ink supply pipe 140 is engaged with an ink supply pipe receptor (not shown) provided in the printhead 1 and an ink passage pipe of the printhead 1 is inserted into the ink supply pipe 140. As a result, the latch 160A of the lever 160 is engaged with a projection (not shown) formed in a predetermined portion of the head holder 205, and the ink tank 7 is properly inserted in the head holder 205 as shown in FIG. 3B. The head holder 205 integrating the ink tank 7 is attached to e.g., the carriage 2 of the printing apparatus shown in FIG. 1, and become ready for printing. In this state, there is a liquid level difference (H) between the level of liquid on the bottom portion of the ink tank 7 and the level of liquid on the discharge-orifice surface of the printhead 1.

Next, the internal structure of the ink tank 7 will be described with reference to FIG. 4.

The ink tank 7 according to the present embodiment lets air in through the atmospheric-air communicating portion 120 provided on the ceiling portion of the ink tank, and the bottom portion of the ink tank 7 is connected to the ink supply opening. Inside the ink tank 7, a negative-pressure generating member accommodating chamber 340 including an absorbent material 320 serving as a negative-pressure-generating member, and a substantial-closed liquid storage 360 containing liquid ink are separated by a partition wall 380. The negative-pressure generating member accommodating chamber 340 and liquid storage 360 are connected only through a passage opening 400 of the partition wall 380 formed near the bottom portion of the ink tank 7.

On the upper wall 7U of the ink tank 7 which forms the negative-pressure generating member accommodating chamber 340, plural ribs 420 projected into the ink tank 7 are formed, and the plural ribs are in contact with the absorbent material 320 housed in the negative-pressure generating member accommodating chamber 340 in the compressed form. Between the upper wall 7U and the top surface of the absorbent material 320, an air buffer room 440 is formed. The absorbent material 320 is formed with heat-compressed urethane foam, and housed in the negative-pressure generating member accommodating chamber 340 in the compressed form so as to produce a predetermined capillarity which will be described later. An absolute value of the pore size of the absorbent material 320 for producing the predetermined capillarity differs depending on the type of the ink used, dimension of the ink tank 7, position of the discharge-orifice surface of the printhead 1 (liquid level difference H) and so on.

In the ink supply pipe 140 forming the ink supply opening 140A, a disc-shape or cylindrical-shape ink inducing element 460 is provided. The ink inducing element 460 is formed with a felt made of e.g. polypropylene, and is not deformed easily by external force. In the state shown in FIG. 3A where the ink tank is not inserted in the head holder 205, the ink inducing element 460 is pushed into the absorbent material 320 so as to partially compress the absorbent material 320. Therefore, at the upper end portion of the ink supply pipe 140, a flange is formed around the ink inducing element 460.

In the ink tank having the above-described configuration, when ink absorbed by the absorbent material 320 is consumed by the printhead 1, ink is supplied to the absorbent material 320 in the negative-pressure generating member accommodating chamber 340 from the liquid storage 360 through the passage opening 400 of the partition wall 380. At this time, although the pressure inside the liquid storage 360 is reduced, air from the atmospheric-air communicating portion 120, coming through the negative-pressure generating member accommodating chamber 340, is supplied to the liquid storage 360 through the passage opening 400 provided on the partition wall 380, and the reduced pressure in the liquid storage 360 is compensated. Therefore, even if ink is consumed by the printhead 1, ink is provided to the absorbent material 320 in accordance with the consumed amount, enabling the absorbent material 320 to keep a constant amount of ink and maintain a substantially constant negative pressure to the printhead 1. Accordingly, ink supplied to the printhead is kept stable. As the ink absorbed by the absorbent material 320 is consumed, ink in the liquid storage 360 is consumed.

Accordingly, by virtue of having the ink-existence detection mechanism in the liquid storage 360 of the ink tank to inform a user that ink in the liquid storage 360 has been consumed, thus letting the user exchange the ink tank, the printing apparatus can be used without concern of ink shortage.

Next, detailed description will be provided on the configuration of two embodiments applying the present invention to the above-described ink tank.

<First Embodiment>

Figure 5A:
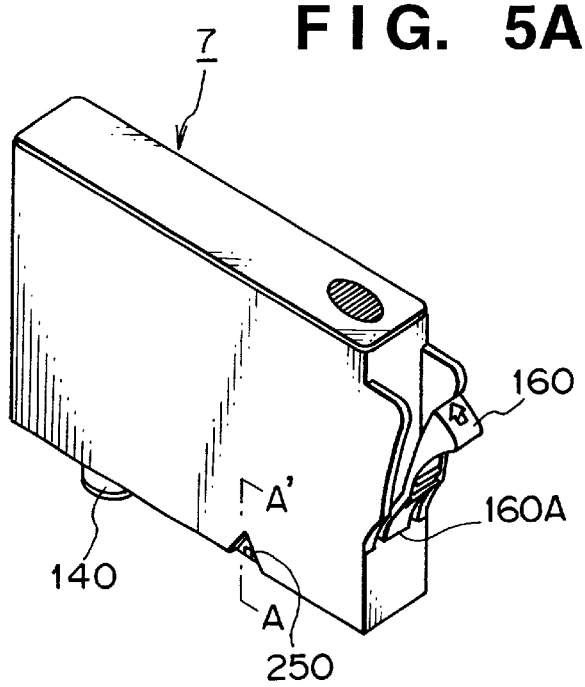
FIGS. 5A to 5C are illustration showing the structure of the ink tank 7 according to the first embodiment.
Figure 5B:
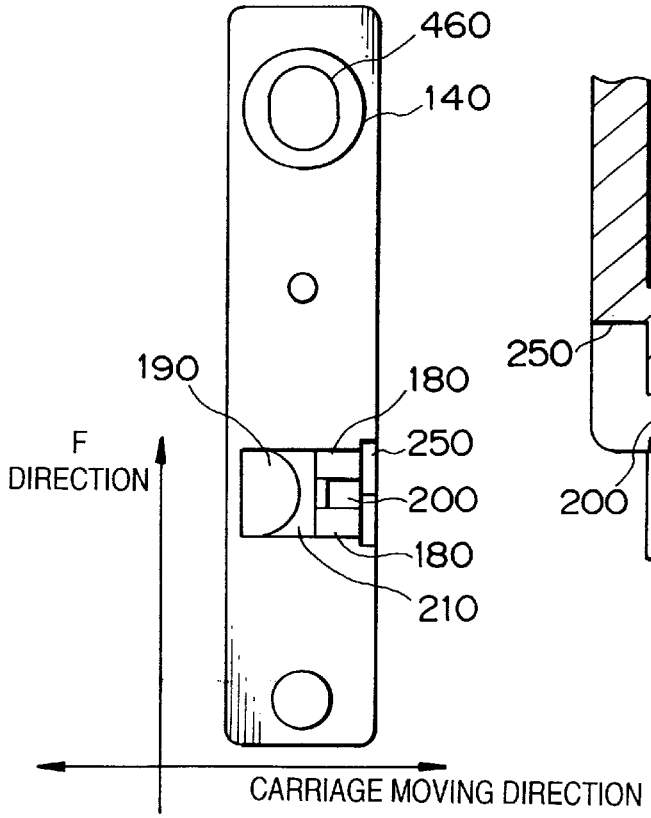
Figure 5C:
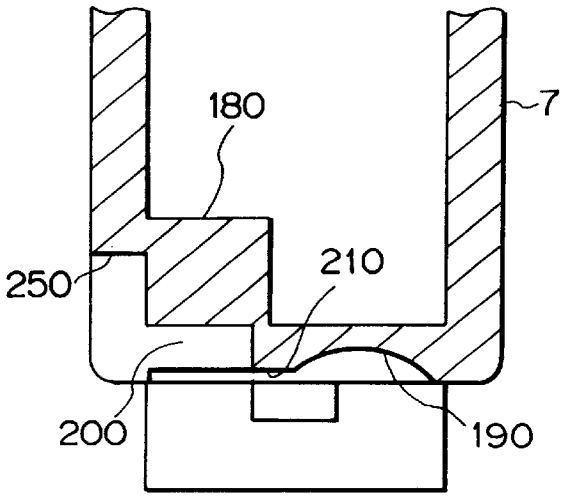

FIGS. 5A to 5C show the structure of the ink tank 7 according to the present embodiment. Herein, FIG. 5A is a perspective view showing the external appearance of the ink tank 7; FIG. 5B, a bottom view of the ink tank 7; and FIG. 5C, a cross-section cut along the line A–A' in FIG. 5A. Note that in FIGS. 5A to 5C, those components explained as the common embodiment in FIGS. 3 and 4 are assigned with the same reference numerals, and description thereof will be omitted. Hereinafter, configuration which is characteristic to the first embodiment will be described.

As shown in FIG. 5A, a triangular notch 250 is provided in the lower side wall of the ink tank 7 in the present embodiment. Moreover, as shown in FIGS. 5B and 5C, a prism 180 and a concave curved surface reflection portion 190 are provided on the bottom surface of the ink tank 7. The prism 180 is used for detecting existence/non-existence of ink which will be described later, and the concave curved surface reflection portion 190 is used for detecting existence/non-existence of an ink tank which will be described later.

The ink tank 7 is formed with translucent light-transmitting material, e.g. polypropylene, and on the bottom surface of the ink tank 7, an optical prism is integratedly formed.

The concave curved surface reflection portion 190 has a curvature with respect to two directions: the carriage moving direction and the direction perpendicular thereto (direction F), i.e. the direction in which the light emission device 15 and the photoreceptor 16 are arranged. The entire area of the concave curved surface reflection portion 190 forms the curved surface.

The prism 180 is an ordinary triangular prism having a concave portion 200 at the bottom center of the triangular prism. An area 210 between the prism 180 and the concave curved surface reflection portion 190 on the bottom surface of the ink tank 7 has a rough surface. Therefore, hereinafter, the area 210 will be referred to as a rough surface portion. Note that although the concave portion 200 is a rectangular parallelepiped in the present embodiment, the concave portion may take a shape other than a rectangular shape, e.g. a trapezoid. Thus, hereinafter, the concave portion 200 will be referred to as a concave polyhedral portion.

As can be seen from FIG. 5C, a part of the side walls of the prism 180 contacts against the side wall of the ink tank 7, and this contact portion has the notch 250. Having the notch 250 provides an advantage of increased molding precision at the time of manufacturing the prism 180 and ink tank 7 by injection molding or the like, and serves as a diffusion portion of the prism 180 together with the concave polyhedral portion 200. Note that this advantages will be described later in detail.

As can be seen from the FIG. 5B, the rough surface portion 210 has a circular arc on the side which contacts with the concave curved surface reflection portion 190. The rough surface portion 210 may be structured on the same level as the bottom surface of the prism 180 which constructs the part of the external wall of the ink tank 7, or the prism side may be projected externally. By this construction, the precision (S/N (signal/noise) ratio) in detecting ink is improved.

Figure 7A:
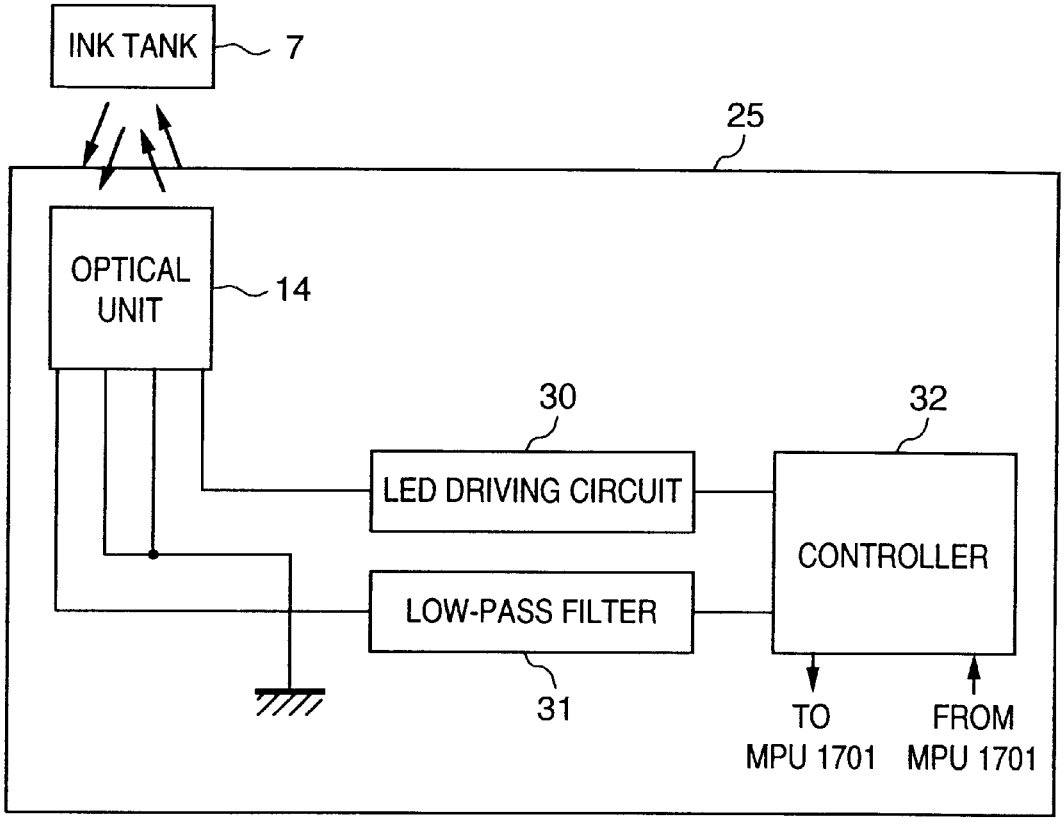
FIGS. 7A and 7B are block diagrams showing the detailed structure of an ink-existence/ink-tank-existence detection unit 25.
Figure 7B:
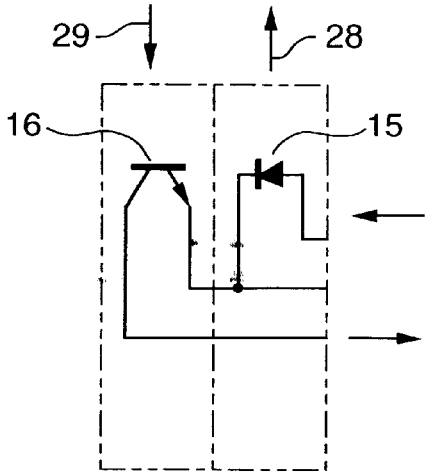
Figure 8:
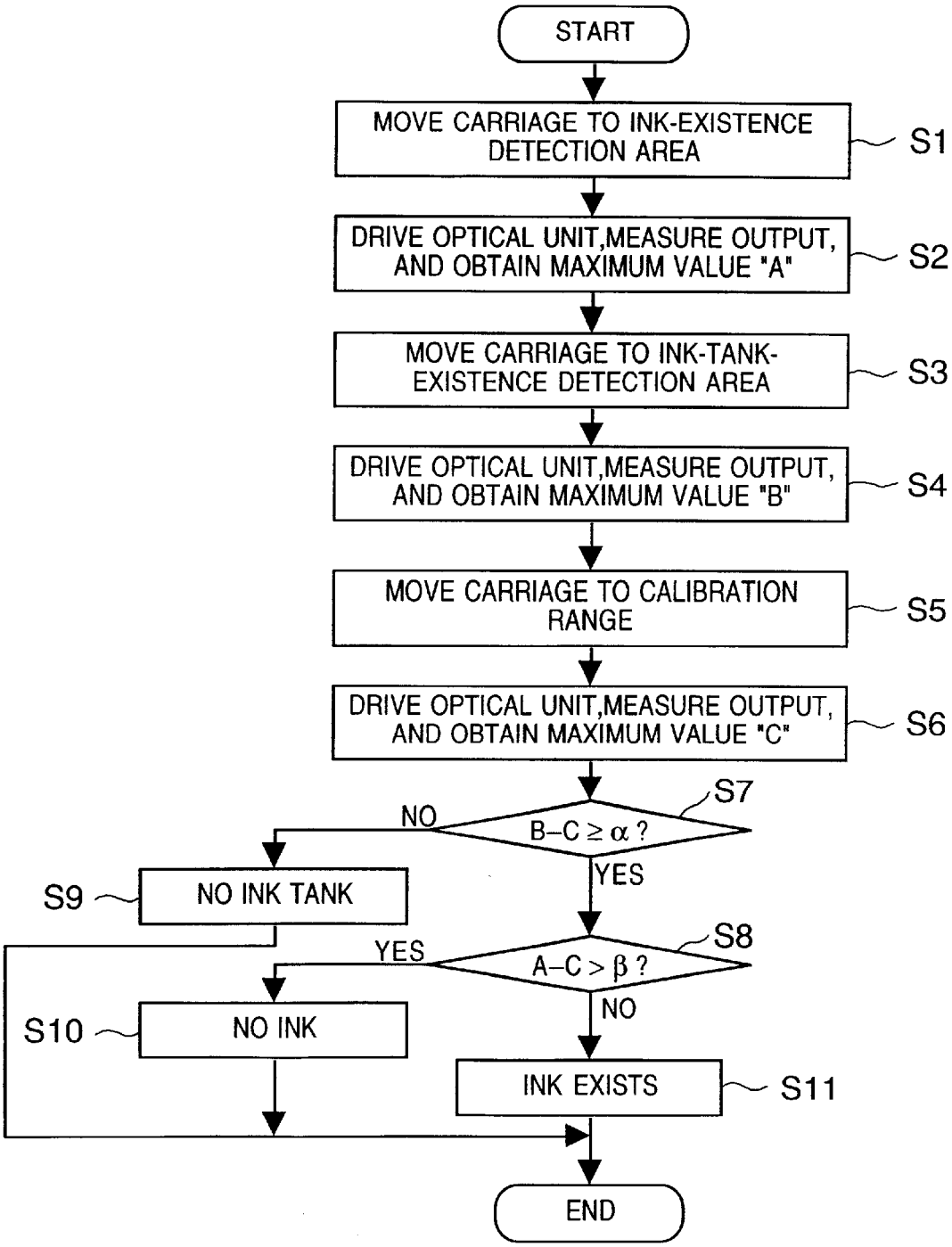
FIG. 8 is a flowchart showing control for detecting existence/non-existence of ink and existence/non-existence of an ink tank.

Next, description will be provided on the processing for detecting existence/non-existence of ink in the ink tank and detecting existence/non-existence of an ink tank, with reference to FIGS. 6 to 8.

Figures 6A, 6B, 6C:
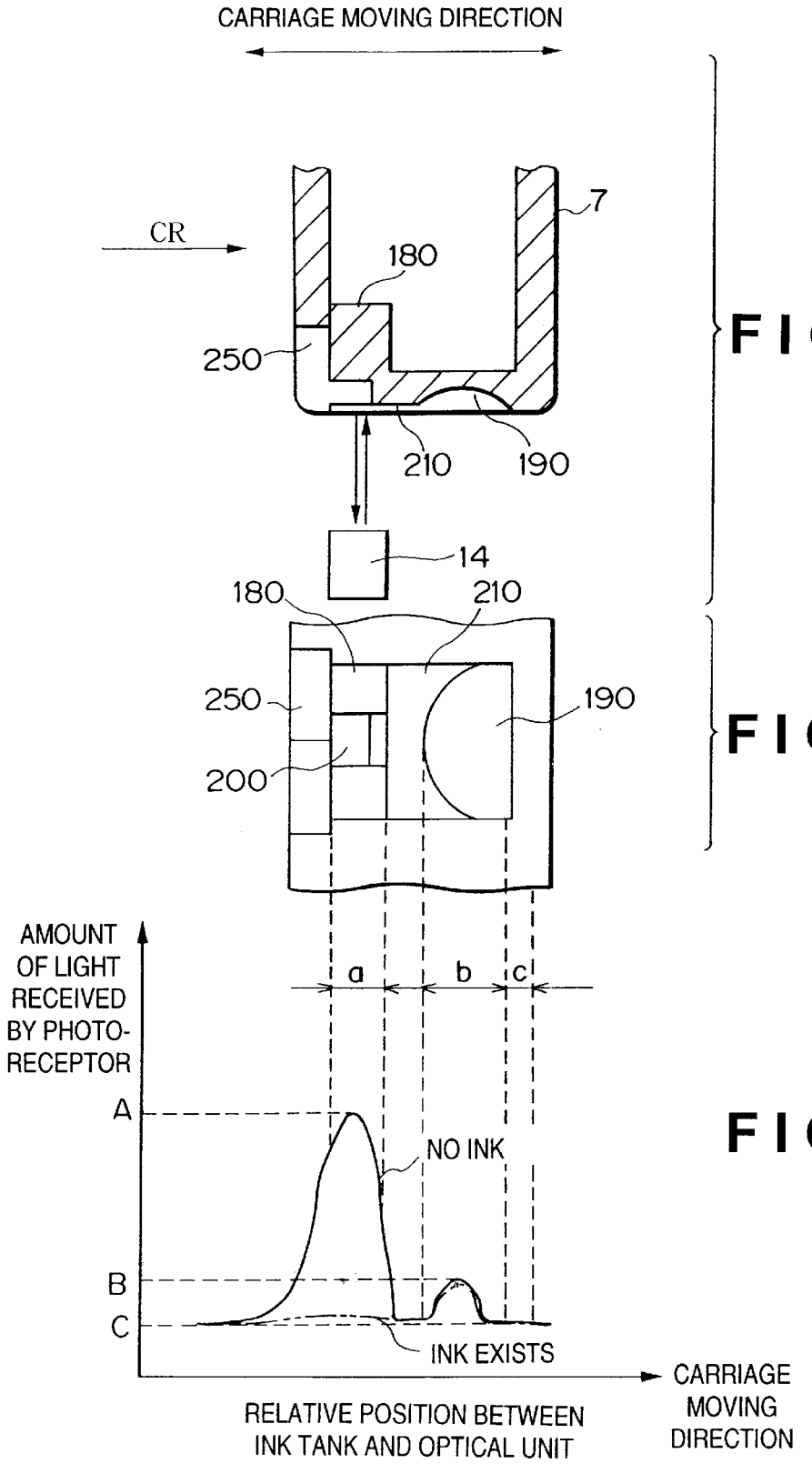
FIGS. 6A and 6B are explanatory views and FIG. 6C is a graph, showing the relative position relation between the ink tank 7 and an optical unit 14, and the relation between their relative positions and an amount of light received by a photoreceptor 16.

FIGS. 6A to 6C show the relative position relation between the ink tank 7 and the optical unit 14, and the relation between their relative positions and the amount of light received by the photoreceptor 16.

FIG. 6A is a cross section of the ink tank 7 and optical unit 14 when viewed in the direction of the arrow F shown in FIG. 1; FIG. 6B, a bottom view of the ink tank 7 viewed in the direction of the arrow T shown in FIG. 1; and FIG. 6C is a graph showing variations in the amount of light received by the photoreceptor 16 according to the relative position relation between the ink tank 7 and the optical unit 14 in respect with the carriage moving direction.

As shown in FIGS. 6A and 6B, the optical prism 180 used for detecting existence/non-existence of ink is provided on the bottom portion of the ink tank 7. To the right of the optical prism 180, the concave curved surface reflection portion 190 formed with a light-transmitting material is provided for detecting existence/non-existence of an ink tank. This surface is subsided towards the inner portion of the ink tank. Between the optical prism 180 and concave curved surface reflection portion 190, the rough surface portion 210 for irregularly reflecting light is formed. The rough surface portion 210 has a relatively higher roughness as compared to a portion opposing to the light emission device 15 or photoreceptor 16 on the bottom surface of the optical prism 180, and the concave curved surface reflection portion 190.

By having the above-described configuration, existence/non-existence of ink is detected when the optical prism 180 of the ink tank 7 is positioned relative to the optical unit 14 fixed to the chassis 17, and existence/non-existence of an ink tank is detected when the concave curved surface reflection portion 190 is positioned.

Herein, if the ink tank 7 is attached to the carriage 2 and the carriage 2 is moved slowly in the neighborhood of the optical unit 14, the amount of light received by the photoreceptor 16 varies as shown in FIG. 6C. In FIG. 6C, the solid line indicates variations in the amount of received light when there is no ink in the ink tank 7, and the two-dot chain line indicates variations in the amount of received light when the ink tank 7 contains ink.

According to these variations, in the case where there is no ink in the ink tank 7, the amount of received light shows a maximum value (A) when the optical prism 180 is positioned directly above the optical unit 14 (the range a in FIG. 6C), and shows the second peak value (B) when the concave curved surface reflection portion 190 is positioned directly above the optical unit 14 (range b in FIG. 6C). When the rough surface portion 210, i.e. the portion between the optical prism 180 and concave curved surface reflection portion 190, is positioned directly above the optical unit 14, the amount of received light shows a local minimum value (C). Depending on movement of the carriage 2, if a portion outside the concave curved surface reflection portion 190 is positioned directly above the optical unit 14 (range c in FIG. 6C), the amount of received light shows substantially the local minimum value (C).

Meanwhile, in the case where the ink tank 7 contains ink, the amount of received light shows almost no change even when the optical prism 180 is positioned directly above the optical unit 14, but shows the-peak value (B) when the concave curved surface reflection portion 190 is positioned directly above the optical unit 14 as similar to the case where there is no ink in the ink tank 7. Although not shown in the drawing, if the ink tank 7 is not attached to the carriage 2, the amount of received light shows almost "0", representing only the background light as noise.

Note that since the amount of light received during the detection of existence/non-existence of ink may vary depending on the color of ink being contained in the ink tank 7, it is preferable to have a large difference in the amount of received light between a case where the ink tank contains ink and a case where the ink tank does not contain ink. Meanwhile when detecting existence/non-existence of an ink tank, the amount of received light should theoretically show the same value as long as the same kind of ink tank is used. In fact, because the ink tank according to the present embodiment has a simple structure, unevenness caused during the manufacturing process is minimum; thus, the amount of received light shows almost the same value.

FIG. 7A is a block diagram showing detailed configuration of the detection unit 25.

In the configuration shown in FIG. 7A, the controller 32 outputs a pulse signal having a predetermined duty ratio (DUTY) (%) to an LED driving circuit 30 based on a control signal sent by the MPU 1701, and drives the light emission device 15 which constructs a part of the optical unit 14 in accordance with the duty ratio so as to emit infrared light upon the bottom portion of the ink tank 7.

The infrared light is reflected upon the optical prism 180 provided on the bottom portion of the ink tank 7 and returned to the photoreceptor 16 which constructs the rest of the optical unit 14. The photoreceptor 16, i.e. a phototransistor, converts the received light into an electrical signal and outputs the electrical signal to a low-pass filter (LPF) 31. The low-pass filter (LPF) 31 transmits only the signal having a low frequency component of the received electrical signal to the controller 32, eliminating high frequency noise. The controller 32 performs A/D conversion on the signal transmitted by the low-pass filter (LPF) 31, converting it into a digital signal. Then, the converted digital signal is transferred to the MPU 1701.

Note that the light emission device 15 is an LED emitting infrared light 28, and the photoreceptor 16 is a phototransistor for receiving infrared light 29 and outputting an electrical signal in accordance with the intensity of the received light, as shown in FIG. 7B. These LED and phototransistor are arranged such that they are arranged along the conveyance direction of a print medium as shown in FIG. 1.

Next, description will be provided with reference to the flowchart shown in FIG. 8, regarding controlling for detecting existence/non-existence of ink and existence/non-existence of an ink tank in the apparatus having the above-described configuration.

First in step S1, the MPU 1701 drives the carriage motor 4 via the motor driver 1707 to move the carriage 2 in the direction indicated by an arrow CR in FIG. 6A, so that the right edge of the prism 180 in the ink tank 7 is positioned directly above the optical unit 14.

Further in step S2, while moving the carriage 2 directly above the optical unit 14 at a predetermined speed in the direction indicated by the arrow CR in FIG. 6A within the range a shown in FIG. 6B, the optical unit 14 is driven at a predetermined duty ratio at a predetermined time interval via the LED driving circuit 30 to consecutively measure the reflected light of the infrared light emitted by the light emission device 15 as an output of the low-pass filter (LPF) 31. Then, A/D conv ers ion is perform ed on the me asured value and the obt ai ned digital value is inputted. By moving the carriage 2 as described above, if the ink tank 7 is attached to the carriage 2, the photoreceptor 16 receives reflected light from the prism 180 provided on the bottom portion of the ink tank 7. Based on the inputted digital value, a maximum value is obtained and stored aas value "A" in the DRAM 1703.

Next in step S3, the carriage 2 is moved such that the right edge of the concave curved surface reflection portion 190 of the ink tank 7 is positioned directly above the optical unit 14.

In step S4, while moving the carriage 2 direct ly above th e optical unit 14 at a predetermined speed in the direction indicated by the arrow CR in FIG. 6A within the range b shown in FIG. 6B, infrared light is emitted by the light emission device 15 as similar to step S2 and the reflected light of the infrared light is consecutively measured as an output of the low-pass filter (LPF) 31. Then, A/D conversion is performed on the measured value and the obtained digital value is inputted. By moving the carriage 2 as described above, if the ink tank 7 is attached to the carriage 2, the photoreceptor 16 receives reflected light from the concave curved surface reflection portion 190 provided on the bottom portion of the ink tank 7. Based on the inputted digital value, a maximum value is obtained and stored as a value "B" in the DRAM 1703.

Further in step S5, the carriage 2 is moved such that the right edge of the rough surface portion 210 is positioned directly above the optical unit 14.

In step S6, while moving the carriage 2 directly above the optical unit 14 at a predetermined speed in the direction indicated by the arrow CR in FIG. 6A within a range in between the range b and range a shown in FIG. 6B, the reflected light of the infrared light emitted by the light emission device 15 is consecutively measured as an output of the low-pass filter (LPF) 31 as similar to step S2. Then, A/D conversion is performed on the measured value and the obtained digital value is inputted. By moving the carriage 2 as described above, if the ink tank 7 is attached to the carriage 2, the photoreceptor 16 receives reflected light from the rough surface portion 210 on the bottom portion of the ink tank 7. At this stage, even though the ink tank 7 is attached to the carriage 2 and the rough surface portion 210 is positioned directly above the optical unit 14, since the rough surface portion 210 irregularly reflects the infrared light emitted by the light emission device 15, the amount of light received by the photoreceptor 16 is considerably reduced.

Then based on the inputted digital value, a minimum value is obtained and stored as a value "C" in the DRAM 1703.

Next in step S7, the difference (B−C) between values B and C stored in steps S4 and S6 is compared with a predetermined threshold value "α". Herein, if (B−C)<α, the processing proceeds to step S9 where determination is made that an ink tank 7 is not attached to the carriage 2, and the processing ends. Note that, at this stage, processing of notifying a user of "no ink tank (or no ink cartridge)" may be performed by, e.g., turning on an LED lamp (not shown) provided on the printing apparatus. On the other hand, if (B−C)≧α, determination is made that an ink tank 7 (ink cartridge 20) is attached to the carriage 2, and the processing proceeds to step S8.

In step S8, the difference (A−C) between values A and C stored in steps S2 and S6 is compared with another predetermined threshold value "β". Herein, if (A−C)>β, the processing proceeds to step S10 where determination is made that the ink tank 7 has no ink, and the processing ends. Note that, at this stage, processing of notifying a user of "no ink" in the ink tank 7 may be performed by, e.g., turning on an LED lamp (not shown) (different color from the LED lamp used for indicating that there is "no ink tank") provided on the printing apparatus. On the other hand, if (A−C)≦β, the processing proceeds to step S11 where determination is made that the ink tank 7 contains ink, and the processing ends.

According to the foregoing processing, for instance, in the case where there is no ink in the ink tank 7, the amount of light received by the photoreceptor 16 shows the maximum value when the optical prism 180 is positioned directly above the optical unit 14, shows the minimum value when the rough surface portion 210 is positioned directly above the optical unit 14, and shows another peak value when the concave curved surface reflection portion 190 is positioned directly above the optical unit 14. Meanwhile, in the case where the ink tank 7 contains ink, the amount of light received by the photoreceptor 16 shows the maximum value when the concave curved surface reflection portion 190 is directly above the optical unit 14.

Note that in order to minimize the movement of the carriage 2 in the above processing, light is first emitted on the concave curved surface reflection portion 190 for detecting existence/non-existence of an ink tank, next the light is emitted on the rough surface portion 210 after moving the carriage 2, finally the light is emitted on the optical prism 180 after moving the carriage 2, and the photoreceptor 16 may receive reflected light from each of the above positions.

Next, the concave polyhedral portion 200 which is the most notable feature of the present embodiment will be described with reference to FIGS. 9A and 9B.

Figure 9A:
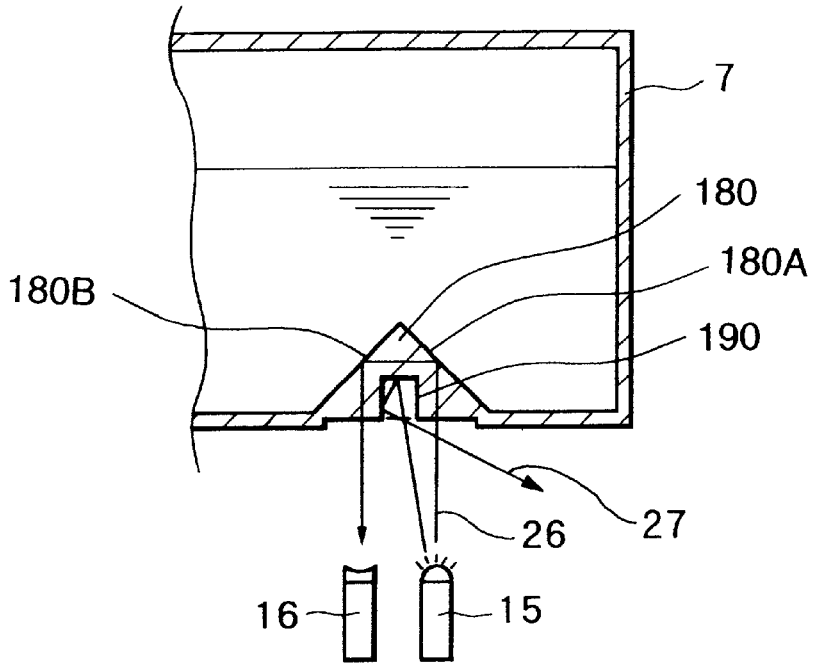
FIGS. 9A and 9B are explanatory views showing the structure of an optical prism 180 provided on the bottom surface of the ink tank 7.
Figure 9B:
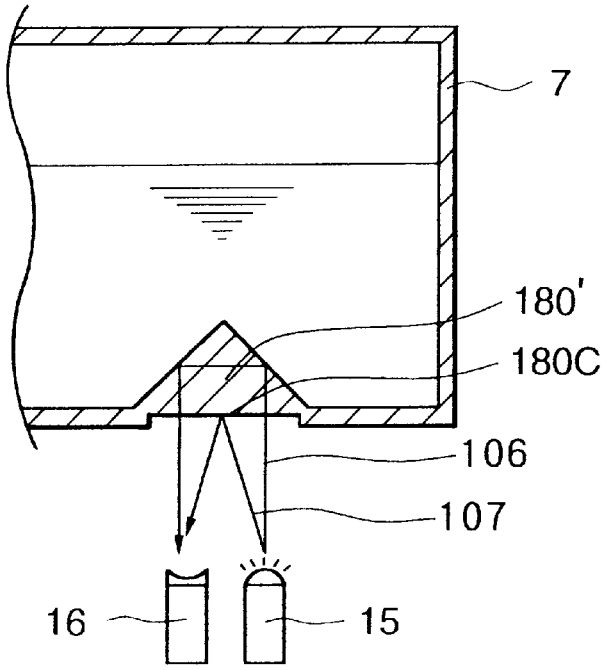

FIGS. 9A and 9B show the structure of the optical prism 180 provided on the bottom surface of the ink tank 7. FIG. 9A shows the structure of the optical prism 180 according to the present embodiment; and FIG. 9B, the structure of a conventional optical prism 180'.

In a case where a conventional ink tank is attached to the carriage 2, as shown in FIG. 9B, part of the light from the light emission device 15 is reflected on a bottom surface 180C of the optical prism 180'. Thus, along with an increase of the reflected light 107 on the bottom surface 180C, component of the reflected light which is returned to the photoreceptor 16 is increased. Theoretically, an amount of light received by the photoreceptor 16 should decrease if the ink tank 7 contains ink; however, in the case of a conventional ink tank, the amount of light received by the photoreceptor 16 is increased, making it unable to accurately detect existence/non-existence of ink.

Note that in FIG. 9B, reference numeral 106 denotes light emitted by the light emission device 15 and is incident perpendicularly to the bottom surface 180C.

On the other hand, in the structure shown in FIG. 9A, the concave polyhedral portion 200 is provided in the central portion of the optical prism 180. By virtue of this, in place of the light path of the reflected light reflected by the bottom surface 180C and returned to the photoreceptor 16, another light path 27 is formed, thus the reflected light is diffused. Accordingly, there is less possibilities for the photoreceptor 16 to receive light not related to the ink detection, making it possible to considerably reduce reflected light not related to the ink detection to be returned to the photoreceptor 16. Furthermore, since the concave polyhedral portion 200 serves to prevent deformation of reflection surfaces 180A and 180B of the optical prism 180 at the time of molding the prism, the precisely formed reflection surfaces 180A and 180B contribute to realize the surface of the optical prism which surely reflects light.

Figure 28:
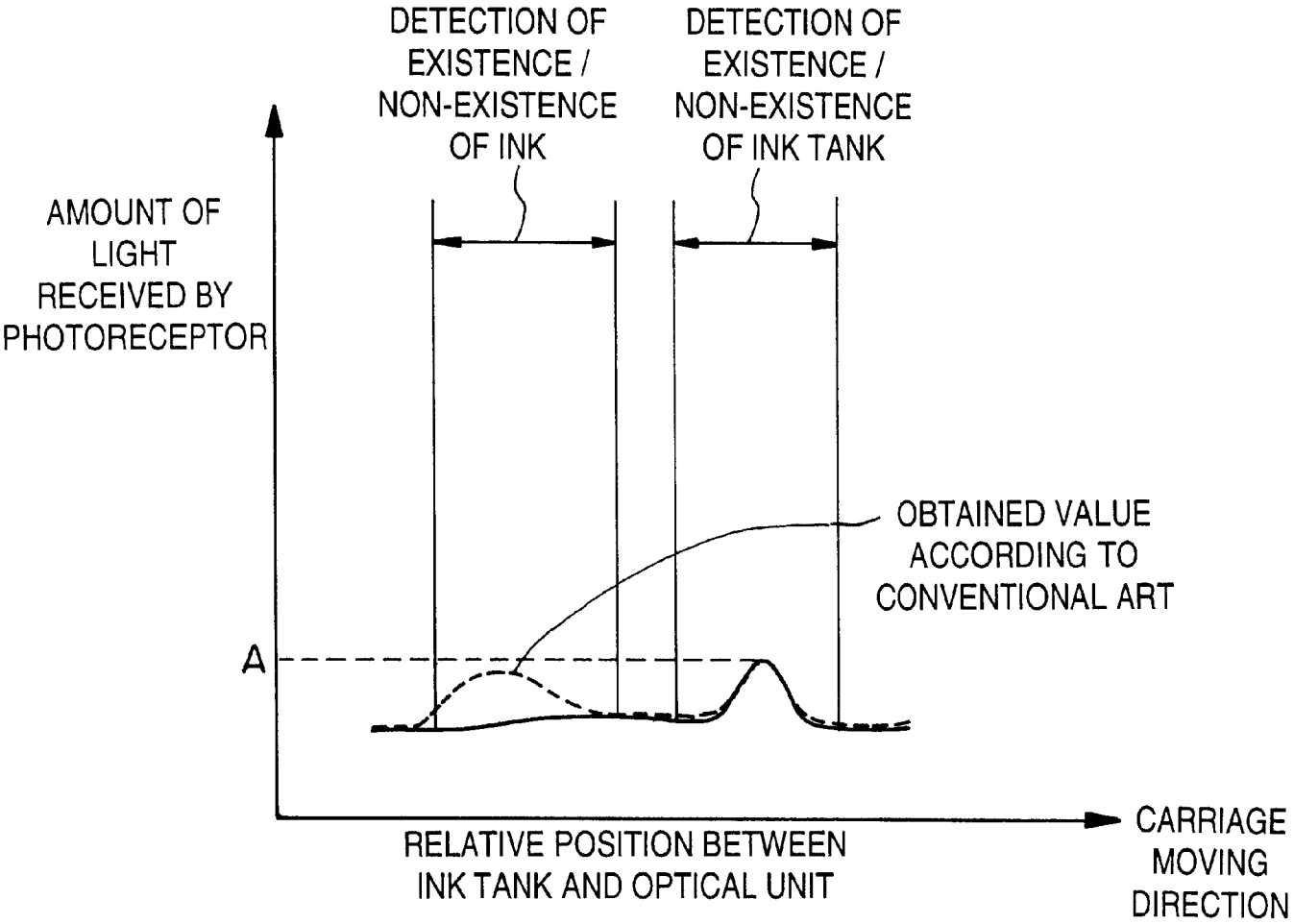
FIG. 28 is a graph showing variations in the amount of received light reflected on the ink tank shown in FIG. 9.

FIG. 28 shows the amount of light received by the photoreceptor 16 in a case where the carriage 2 holding each of the ink tanks is scanned near the optical unit 14. In FIG. 28, the solid line indicates a case where the ink tank having the structure shown in FIG. 9A contains ink, and the dotted line indicates a case where the ink tank having the structure shown in FIG. 9B contains ink. As can be seen, by virtue of having the concave polyhedral portion, it is possible to reduce an amount of light received by the photoreceptor 16 in a case where the ink tank contains ink. Thus, it is possible to reduce the threshold value used for ink existence/non-existence detection in the above-described processing.

Finally, description will be provided on the concave curved surface reflection portion 190 serving as an ink tank detector.

Figure 10A:
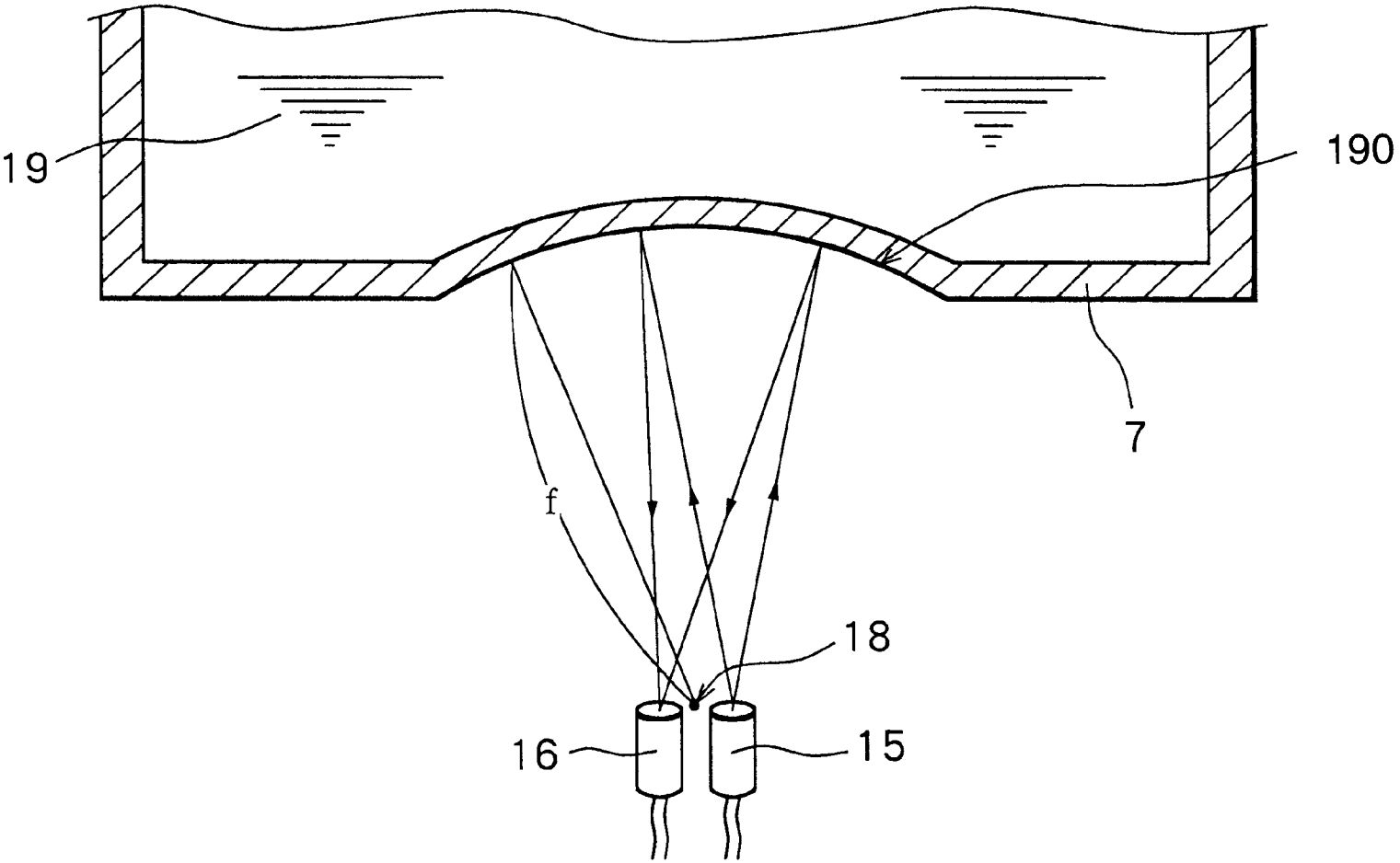
FIGS. 10A to 10C are explanatory views showing the reflection surface on the bottom portion of the ink tank 7.
Figure 10B:
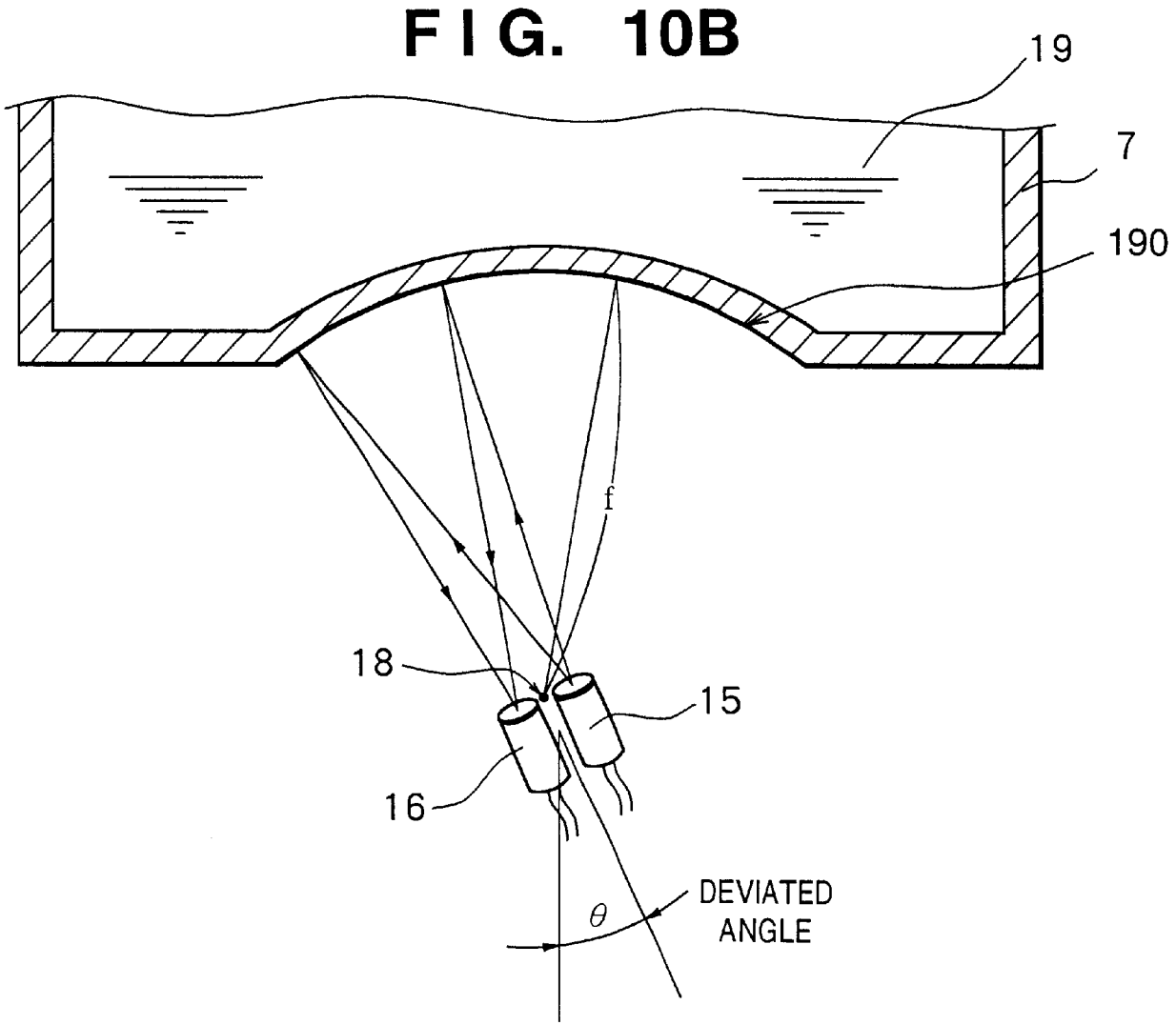
Figure 10C:
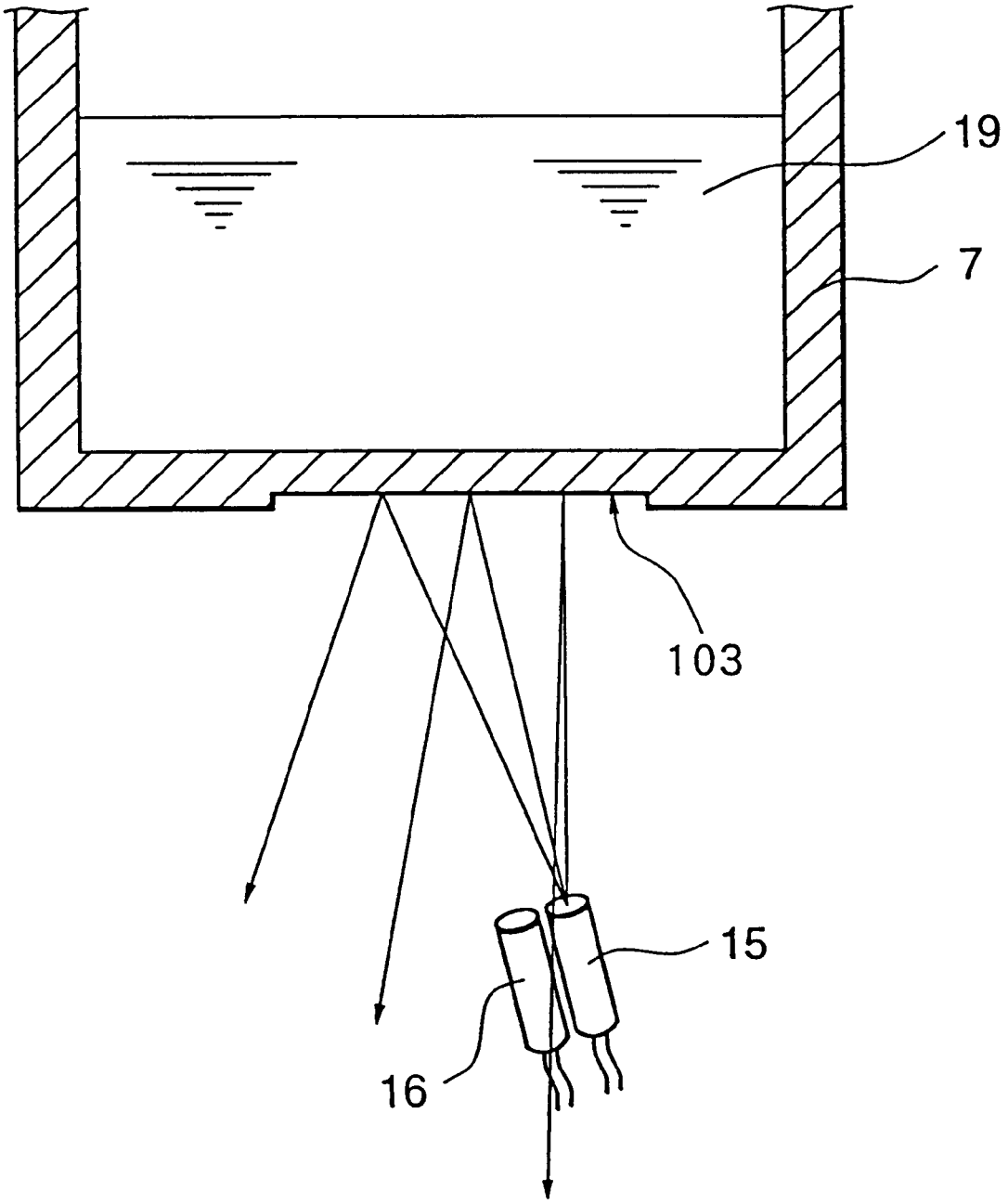
FIG. 10C PRIOR ART

FIGS. 10A to 10C and 11 show the reflection surface on the bottom portion of the ink tank 7. Among these drawings, FIG. 10C shows the structure of a conventional ink tank detection portion provided on the bottom portion of the ink tank. As can be seen from FIGS. 10A, 10B and 11, the curved surface of the concave curved surface reflection portion 190 according to the present embodiment has a quadratic surface (sphere surface), while the conventional ink tank detection portion has a flat light reflection surface 103 as shown in FIG. 10C.

In FIGS. 10A to 10C and 11, reference numeral 18 denotes a center of curvature of the concave curved surface reflection portion 190, and 19 denotes ink.

First of all, a problem regarding the conventional ink tank detection will be discussed with reference to FIG. 10C.

For instance, if a fixed angle with respect to a light reflection surface 103 of the optical sensor comprising the light emission device 15 and photoreceptor 16 is inclined from the line perpendicular to the bottom surface of the ink tank 7, the reflected light will not return to the photoreceptor 16; thus, the amount of light received by the photoreceptor 16 decreases greatly.

As a result, even if an ink tank is properly fixed to the printing apparatus and there is no problem in terms of printing function, a problem may arise such that an inhibit mechanism is activated and printing operation of the printing apparatus is terminated. Vice versa, even if an ink tank is not properly fixed to the printing apparatus and there is a problem in terms of printing function, a problem may arise such that the printing operation is continued without ink supply, giving damage to the printhead.

The simplest measures to prevent deterioration in detection precision due to such factors is to increase the amount of reflected light such that the signal outputted by the sensor has a margin. However, if a high-output optical sensor (particularly the light emission device) is provided, problems arise: e.g. the cost of the printing apparatus' main body is increased; the size of the optical sensor becomes big; power consumption of the printing apparatus is increased and so on.

Alternately, applying some material having high reflectivity onto the light reflection surface of the bottom surface of the ink tank, or coating the light reflection surface by a vacuum evaporation plating or the like, whereby increasing the amount of reflected light are other measures to prevent deterioration in detection precision. However, since an ink tank is a consumable, if the aforementioned measures are taken, the running cost of the printing apparatus largely increases.

Accordingly, in consideration of the above-described problems of the conventional optical prism, the present embodiment (1) reduces decline or unevenness of an output signal due to an error of the fixed angle of the optical sensor comprising the light emission device and photoreceptor with respect to the reflection surface on the bottom surface of the ink tank, and (2) reduces declines or unevenness of an output signal due to an error of the fixed position of the optical sensor comprising the light emission device and photoreceptor with respect to a reflection surface.

FIG. 10A illustrates a case where the optical unit 14 is properly fixed to the apparatus (fixed to a regular position). In this case, the optical unit 14 is fixed so that a light emission portion of the light emission device 15 and a light reception portion of the photoreceptor 16 in the optical unit 14 are positioned substantially at the center of curvature 18. The center axis of the infrared light beam, emitted by the light emission device, passes through the center of curvature 18 and is in parallel with the line perpendicular to the bottom surface of the ink tank 7.

Figure 11:
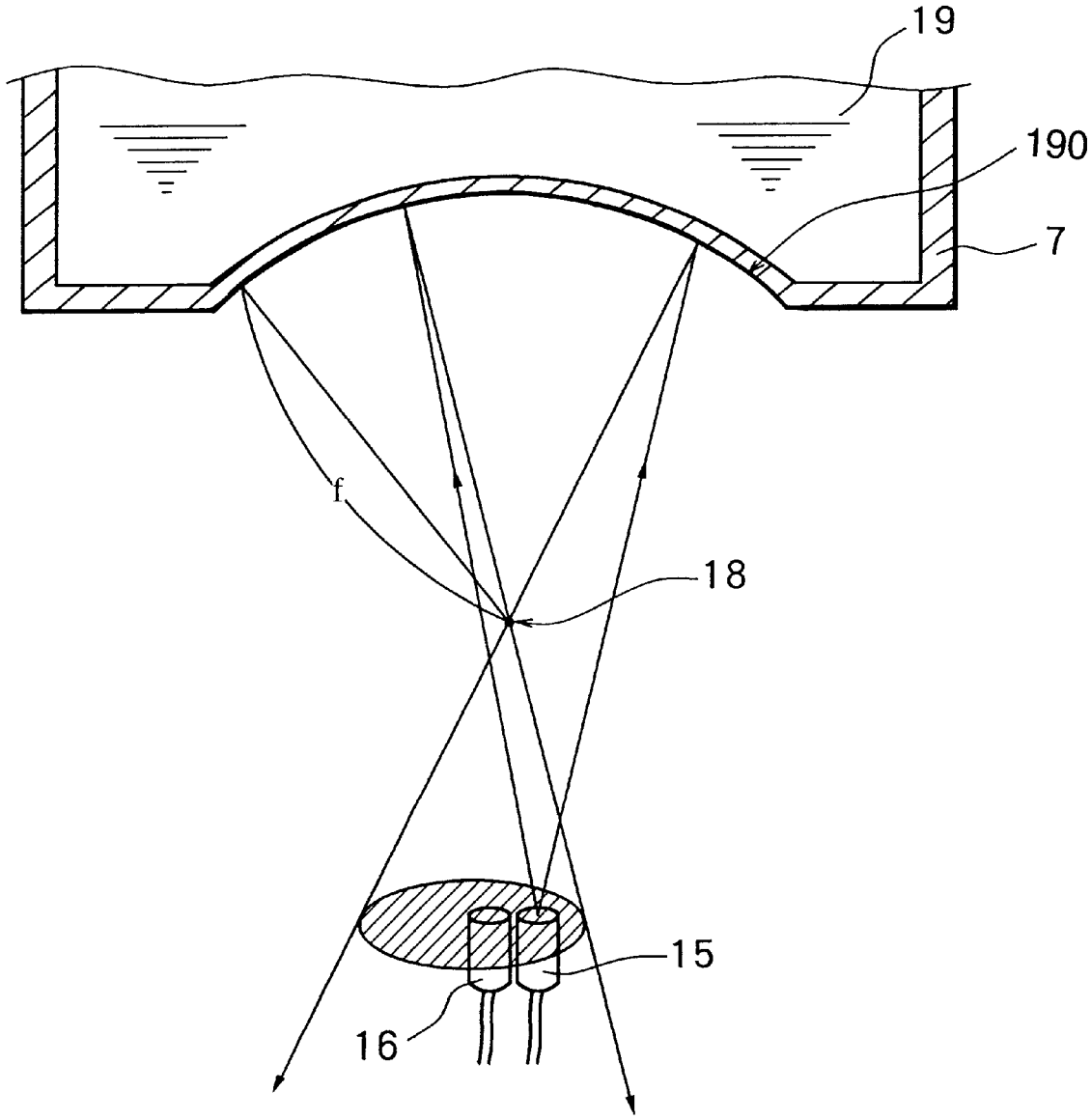
FIG. 11 is an explanatory view showing the reflection surface on the bottom portion of the ink tank 7.

FIG. 10B illustrates a case where the optical unit 14 is fixed at an inclined angle θ with respect to the line which passes through the center of curvature 18 and is perpendicular to the bottom surface of the ink tank 7 (i.e. error of the fixed angle is θ). FIG. 11 also illustrates a case where the light emission portion of the light emission device 15 and a light reception portion of the photoreceptor 16 in the optical unit 14 are fixed at a position slightly away from the center of curvature 18.

In a case where there is no deviation in a position and angle with respect to fixing the optical unit 14 as shown in FIG. 10A, light emitted by the light emission device 15 is reflected on the concave curved surface reflection portion 190 and returned to the center of curvature 18. Therefore, the light is incident upon the light reception surface of the photoreceptor 16.

Thus, the phototransistor of the photoreceptor 16 converts the incident light into an electrical signal, generating an output signal for ink tank detection.

Meanwhile, since the conventional reflection surface is flat as shown in FIG. 10C if the optical unit is fixed at an inclined angle, only a part of the reflected light is returned to the photoreceptor. However, according to the present embodiment, by virtue of the reflection surface having the quadratic surface (sphere surface), even in a case where the optical unit is fixed at an inclined angle, light emitted by the light emission device fixed in the neighborhood of the center of curvature 18 is reflected upon the concave curved surface reflection portion 190 and is all returned to the center of curvature 18.

Accordingly, the reflected light is focused on the center of curvature 18. Thus, even if the optical unit is fixed with a deviation angle as sh own in FIG. 10B, the photoreceptor 16 receives a large amount of light as compared to the conventional example shown in FIG. 10C. According to experiments, the output from the photoreceptor 16 is twice as much, compared to the case utilizing the flat reflection surface. Therefore, it is possible to increase the signal output for ink tank detection.

As has been set forth above, in a case where the optical unit 14 is fixed in the neighborhood of the center of curvature 18 of the concave curved surface reflection portion 190 having a sphere surface, even if the fixing angle is deviated, the reflected light from the optical unit 14 can be efficiently focused. However, the center of curvature 18 is a position where luminous flux of the reflected light is the narrowest. Therefore, if the optical unit is positioned with deviation, the focus efficiency considerably declines. Accordingly, in the present embodiment, the optical unit 14 is positioned slightly behind the center of curvature 18 where the luminous flux is widened.

By virtue of the above, even if the optical unit is positioned with deviation, a light amount sufficient for the photoreceptor 16 to detect an ink tank can be obtained.

Note that the optical unit 14 may be positioned, besides the position shown in FIG. 11, slightly before the center of curvature, i.e. between the center of curvature and the concave curved surface reflection portion 190. In this case, the curvature becomes smaller than the case shown in FIG. 11.

Although light outputted by the light emission device 15 is high-directional beam light, the beam light generally has a beam angle of ±10°. Meanwhile, since the optical unit 14 is fixed with a reasonably correct angle as shown in FIG. 10A in the assembly process of the printing apparatus, the error of the fixed angle is not so large. Moreover, taking into consideration of the fact that the beam light has a beam angle of ±10°, even if the fixed angle has an error to some extent, considerably large portion of the light emitted by the light emission device 15 is incident upon the concave curved surface reflection portion 190 as a parallel light.

Therefore, using the concave curved surface reflection portion 190 having a paraboloid surface, the optical unit 14 may be fixed in the neighborhood of the focal point of the paraboloid. By this, a considerably large portion of the light emitted by the light emission device 15 is incident upon the concave curved surface reflection portion 190 as a parallel light, and the reflected light is returned to the focal point, i.e. a position where the photoreceptor 16 is situated. Therefore, as similar to the sphere surface, when compared to the case utilizing the flat reflection surface, it is possible to increase the output from the photoreceptor 16, thus increasing the signal output for ink tank detection. Note that also in this case, it is preferable to fix the optical unit slightly away from the focal point where the luminous flux is concentrated, taking into consideration of a case where the optical unit is positioned with deviation.

Therefore, according to the present embodiment described above, by virtue of having the concave polyhedral portion in the central portion of the bottom surface of the optical prism, it is possible to reduce the amount of light, not related to ink detection, reflected upon the bottom surface of the optical prism, to be returned to the photoreceptor. Also, since the light reflected on the ink boundary surface of the optical prism and returned to the photoreceptor which represents existence/non-existence of ink mostly contributes to an amount of received light in the photoreceptor, it is possible to accurately detect existence/non-existence of ink. Moreover, since the optical prism having such bottom surface portion can be manufactured by injection molding, the optical prism can be manufactured very inexpensively.

Furthermore, by providing on the bottom surface of the ink tank with the reflection surface having quadratic surface e.g., sphere surface or paraboloid, which reflects light emitted from the optical unit comprising the light emission device and photoreceptor, and by fixing the optical unit slightly away from the center of curvature or the focal point, even if a fixed angle or position of the optical unit is deviated, a light amount sufficient for the photoreceptor can be obtained. Therefore, accurate ink tank detection can be performed.

<Second Embodiment>

Figure 12A:
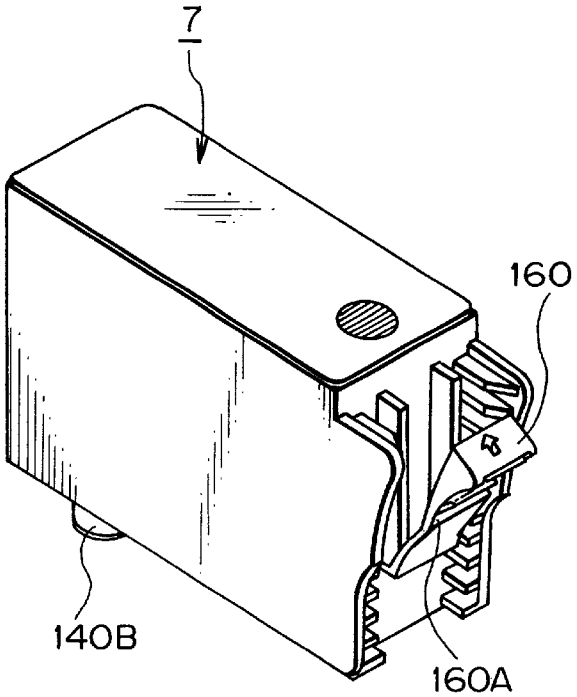
FIGS. 12A to 12C are illustrations showing the structure of the ink tank 7 according to the second embodiment.
Figure 12B:
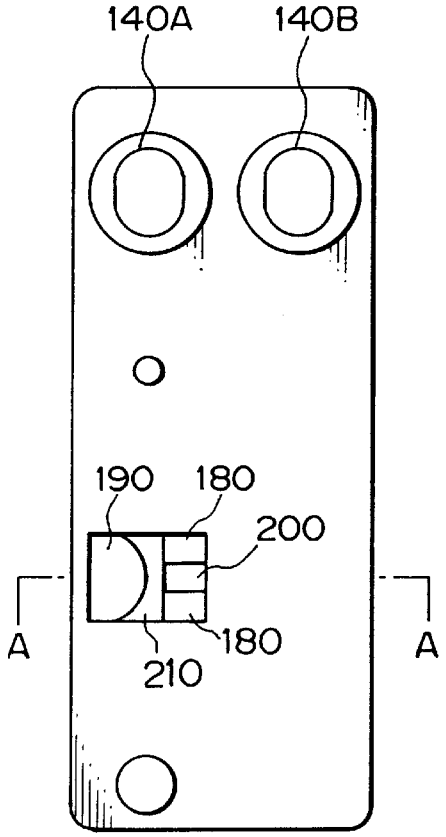
Figure 12C:
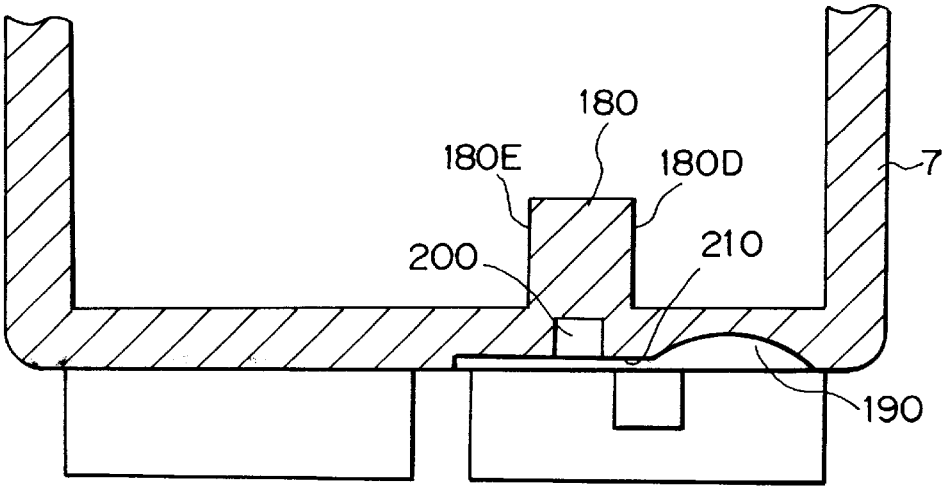

FIGS. 12A to 12C are illustration showing the structure of the ink tank 7 according to the second embodiment. Herein, FIG. 12A is a perspective view showing an external appearance of the ink tank 7; FIG. 12B, a bottom view of the ink tank 7; and FIG. 12C, a cross section cut along the line A–A' in FIG. 12B. Note that in FIGS. 12A to 12C, the same reference numerals are assigned to compositional parts identical to those explained with reference to FIGS. 3 and 4 as the common embodiment, or those explained with reference to FIG. 5 as the first embodiment, and description thereof will be omitted. Hereinafter, the characteristic configuration of the second embodiment will be described.

The ink tank 7 according to the second embodiment has a capacity twice as much as that of the ink tank according to the first embodiment shown in FIG. 5, for containing frequently-used liquid such as black ink.

The ink tank according to the second embodiment, which can be attached to and used in the printing apparatus described in the common embodiment, comprises: the prism 180 having the same structure and arrangement as that of the ink tank according to the first embodiment shown in FIG. 5, the concave polyhedral portion 200, concave curved surface reflection portion 190 and rough surface portion 210. As apparent from FIG. 12B, ink supply openings 140A and 140B are provided on the bottom surface of the ink tank 7, and the above elements, prism, etc. are arranged on the side of the opening 140A.

The ink tank according to the present embodiment differs from that of the first embodiment in that the wid th of the tank is differ ent, and that the side walls 180D and 180E (FIG. 12C) of the prism 180 do not contact against the external side wall of the ink tank; thus, there is no notch on the external wall surface of the ink tank.

Figure 13A:
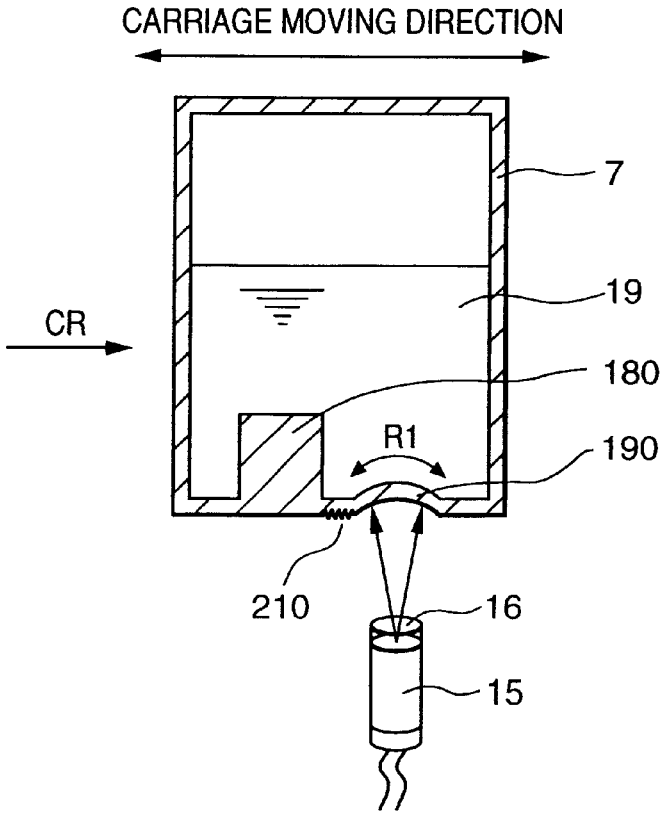
FIGS. 13A to 13C are explanatory views showing a concave curved surface reflection portion 190 seen from various directions, according to the second embodiment.
Figure 13B:
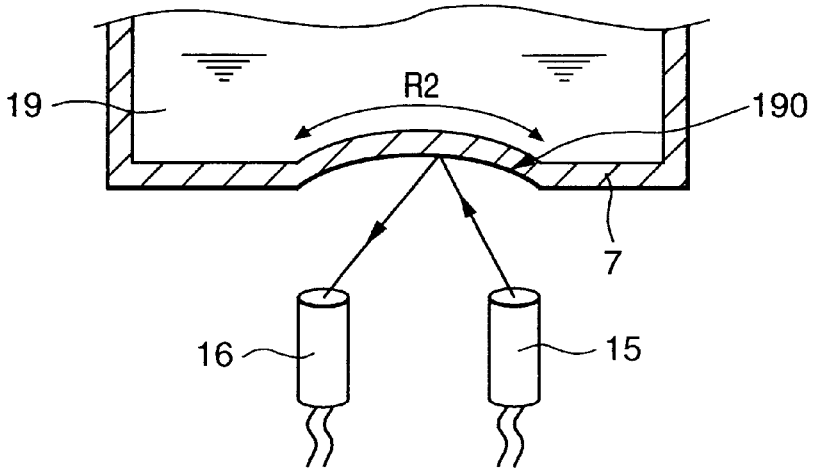
Figure 13C:
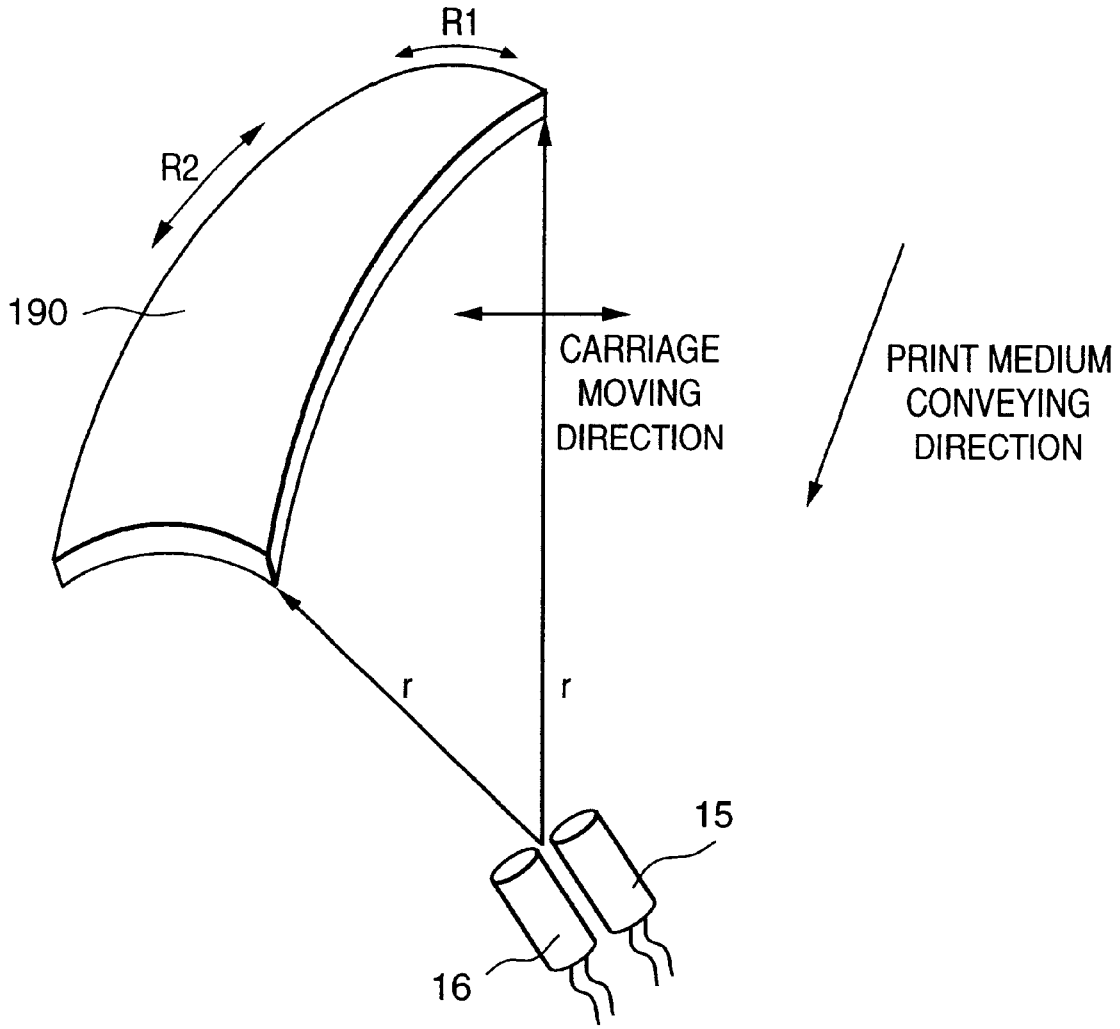

Next, description will be provided with reference to FIGS. 13A to 13C on the concave curved surface reflection portion 190 which takes part in the detection portion for detecting existence/non-existence of an ink tank in the present embodiment.

The concave curved surface reflection portion 190 according to the present embodiment has curved surfaces R1 and R2, having different radius of curvatures respectively in two directions: the direction shown in the cross sections FIG. 5C and FIG. 12C and the o direction perpendicular thereto. Therefore, assuming a case where the ink tank 7 is attached to the carriage 2, R1 curves in the carriage scanning direction as shown in FIG. 13A, and R2 curves in the direction in which the light emission device 15 and photoreceptor 16 are arranged as shown in FIG. 13B. Note that the concave polyhedral portion 200 is omitted in FIG. 13A.

FIG. 13C is a perspective view showing only the concave curved surface reflection portion 190. As apparent from FIG. 13C, the concave curved surface reflection portion 190 has different curved surfaces R1 and R2 in the two directions.

Herein, generally, if a radius of curvature of the curved surface is set small i.e., a curvature indicated by the inverse of the radius of curvature is set large (sharp curved surface), the effect of focusing is increased. However, the amount of light at the focused portion and the amount of light at other portions differ largely on the other hand, if the radius of curvature is large, (i.e. relaxed curved surface having a small curvature), it is possible to minimize the difference in the amounts of light at a focused portion and other portions.

Accordingly, considering the correspondence between the radius of curvature of the concave curved surface reflection portion 190 and the arrangement of the light emission device 15 and photoreceptor 16 of the optical unit 14, it is preferable to have a sharp curved surface in the direction of the cross section shown in FIG. 13A where the light emission device 15 overlaps with the photoreceptor 16, since the distance between the light emission device 15 and photoreceptor 16 need not be considered. Meanwhile, it is preferable to have a relaxed curved surface in the direction of the cross section shown in FIG. 13B which is parallel to the direction where the light emission device 15 and photoreceptor 16 are arranged, since the distance between the light emission device 15 and photoreceptor 16 needs to be considered. Therefore, in the present embodiment, the radius of curvature of R1 is set smaller than that of R2.

Further, taking into consideration the correspondence between the moving direction of the carriage 2 and the radius of curvature of the concave curved surface reflection portion 190, since the carriage 2 is moved to detect the maximum value of the received amount of light in the range having a predetermined width according to the present embodiment, the present embodiment employs, as the curved surface parallel to the carriage moving direction as shown in FIG. 13A, the surface having an ideal radius of curvature taking into account of a distance between the light emission device 15 and photoreceptor 16, which provides superior focusing capability. By this, it is possible to properly detect the portion 190 which provides superior focusing capability by moving the carriage 2.

On the other hand, since the detection position cannot be adjusted by the carriage 2 with respect to the direction perpendicular to the carriage scanning direction, it is preferable to have more relaxed curved surface compared to the ideal radius of curvature, i.e. curve having a large radius of curvature.

Herein, with respect to the carriage moving direction, in order to prevent size-enlargement of a printing apparatus because of that of a carriage, it is preferable to have as thin width of an ink tank as possible in terms of the carriage moving direction. Taking this point into consideration, in the first and second embodiments of the present invention, the side surface of the prism is arranged orthogonal to the carriage moving direction, and the concave curved surface reflection portion is provided adjacent to the prism along with the carriage moving direction. Moreover, in order to detect existence/non-existence of ink and existence/non-existence of an ink tank by a single sensor while efficiently utilizing such limited bottom surface of the ink tank, the light emission device 15 and photoreceptor 16 according to the printing apparatus of the present invention are arranged such that the direction in which the light emission device 15 and photoreceptor 16 of the optical unit 14 are arranged is approximately orthogonal to the moving direction of the carriage 2.

<Other Modification>

The foregoing description has been provided on the embodiment of the main portion of the present invention. Hereinafter, some modifications applicable to these embodiments will be described.

Note that the following description is applicable to each of the aforementioned embodiments unless stated otherwise, and each of the modifications and application examples may be flexibly combined.

[Diffusion Portion (e.g. concave polyhedral portion) of Prism]

First, description as well as supplemental explanation will be provided, with reference to FIGS. 14 to 17, on a modification of the diffusion portion (e.g. concave polyhedral portion) of the prism, which is the most notable feature of the present invention.

Figure 14:
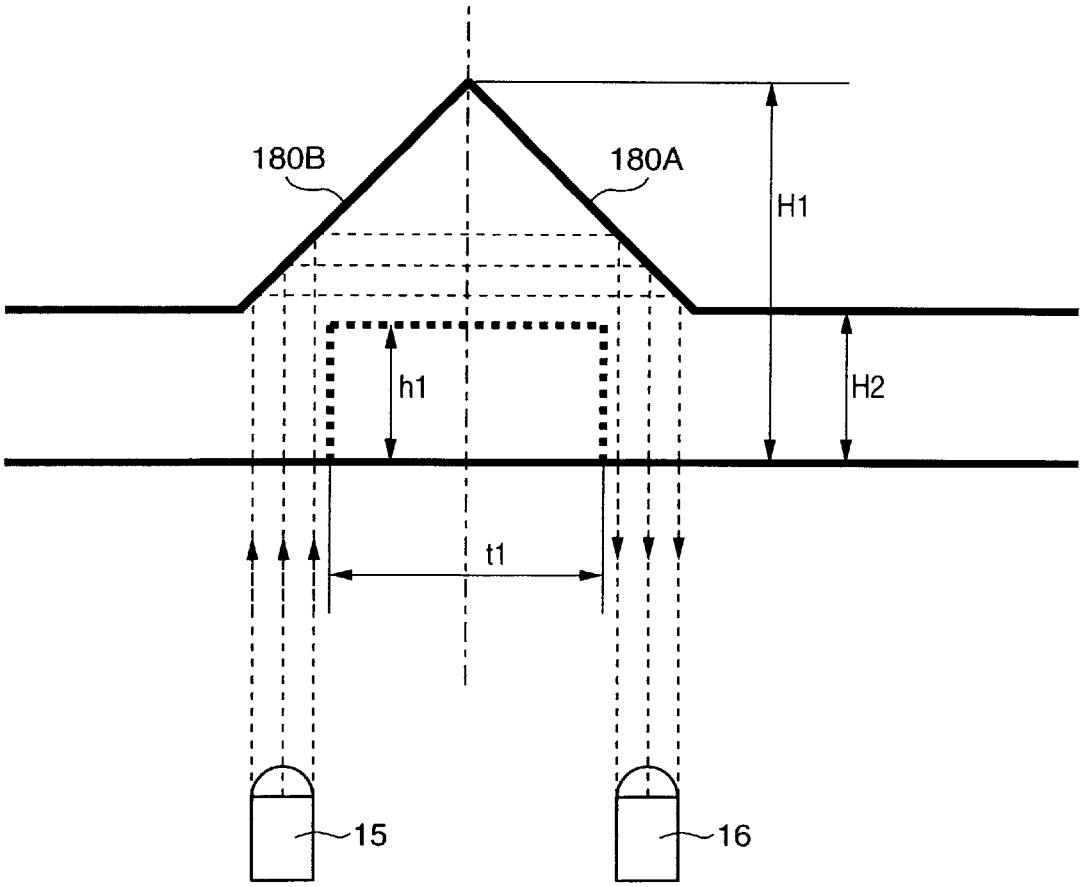
FIG. 14 is a cross section for explaining a concave polyhedral portion 200 of the optical prism 180 provided on the bottom portion of the ink tank.
Figure 15:
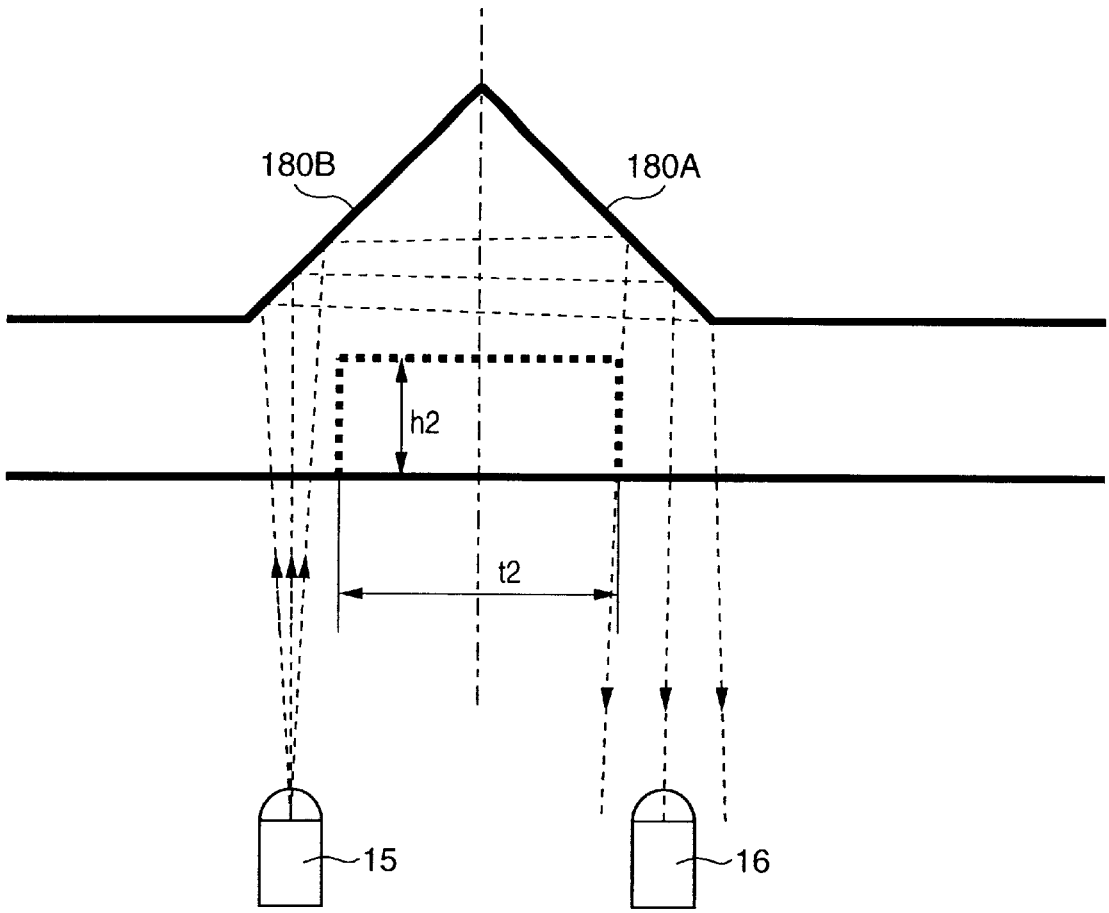
FIG. 15 is a cross section for explaining a concave polyhedral portion 200 of the optical prism 180 provided on the bottom portion of the ink tank.

Each of the above described embodiments has the concave polyhedral portion serving as a diffusion portion for diffusing the light reflected on the external wall surface of the ink tank, preventing the light from returning to the photoreceptor 16. Herein, the depth and width of the concave portion of the concave polyhedral portion of the prism will be explained with reference to FIGS. 14 and 15. FIGS. 14 and 15 are cross sections for explaining the concave polyhedral portion 200 of the optical prism 180 provided on the bottom portion of the ink tank.

In FIGS. 14 and 15, reference h1 and h2 denote depths of the concave polyhedral portion; and t1 and t2, widths of the concave polyhedral portion.

The concave polyhedral portion 200 serves to prevent deformation of the reflection surfaces 180A and 180B of the prism at the time of molding the prism 180 by injection molding or the like. In fact, if the concave polyhedral portion 200 is made large, and the thickness between an inner corner of the concave surface of the concave polyhedral portion 200 and the reflection surface of the prism 180 is made close to the thickness of the wall surface of the ink tank 7, the reflection surfaces 180A and 180B can be formed precisely. This contributes to forming an optical prism surface which properly reflects light. To improve formation precision of the reflection surfaces 180A and 180B of the prism 180, it is preferable, in a case of a triangular prism, that the reflection surfaces 180A and 180B are symmetrical with respect to the central axis passing the peak of the triangular prism. On the other hand, if the concave polyhedral portion 200 is made too large, the light path of light emitted by the light emission device 15 of the optical unit 14 is narrowed, making it difficult to secure a sufficient amount of light to be returned to the photoreceptor 16.

Considering a case where the light emitted by the light emission device 15 is ideal parallel light, when the depth h1 of the concave polyhedral portion 200 is approximately the same as the thickness of the wall surface constructing the ink tank 7, the reflection surfaces of the prism can be formed with high precision while efficiently utilizing the boundary area between the reflection surfaces 180A and 180B, and the internal wall surface of the ink tank. The width t1 of the concave polyhedral portion 200 can be determined based on a light path of the luminous flux of the parallel light which is closest to the concave portion. In reality, light emitted by the light emission device 15 is diffused as shown in FIG. 15. Therefore, the depth and width of the concave polyhedral portion 200 become smaller compared to the case of parallel light, i.e. inevitably become h1>h2 and t1>t2. However, in practice, when the depth of the concave polyhedral portion is approximately the same as the thickness of the wall surface constructing the ink tank 7, the reflection surfaces of the prism can be formed with high precision while efficiently utilizing the boundary area between the reflection surfaces 180A and 180B, and the internal wall surface of the ink tank.

Note that, in view of the molding precision as set forth above, it is preferable to make the thickness of the wall surface of the ink tank 7 the same as the thickness between the inner corner of the concave surface of the concave polyhedral portion 200 and the reflection surface of the prism 180. Therefore, as shown in FIG. 14, practically the height (H1) of the prism is preferably set 1.5 to 4 times as large as the thickness (H2) of the wall surface (bottom surface) of the ink tank depending on the material used or the shape of the sensor, although it may be set smaller if the distance between the light emission device 15 and photoreceptor 16 is short. In the first and second embodiments, the height H1 is about 2.5 times as large as the thickness H2.

Furthermore, each of the foregoing embodiments discloses the configuration having the concave polyhedral portion as a diffusion portion. However, the diffusion portion may be of another form as long as it has the function to diffuse the light reflected on the external wall surface of the ink tank, thus preventing the light from returning to the photoreceptor 16. Therefore, various modifications of the diffusion portion are possible.

Figure 16A:
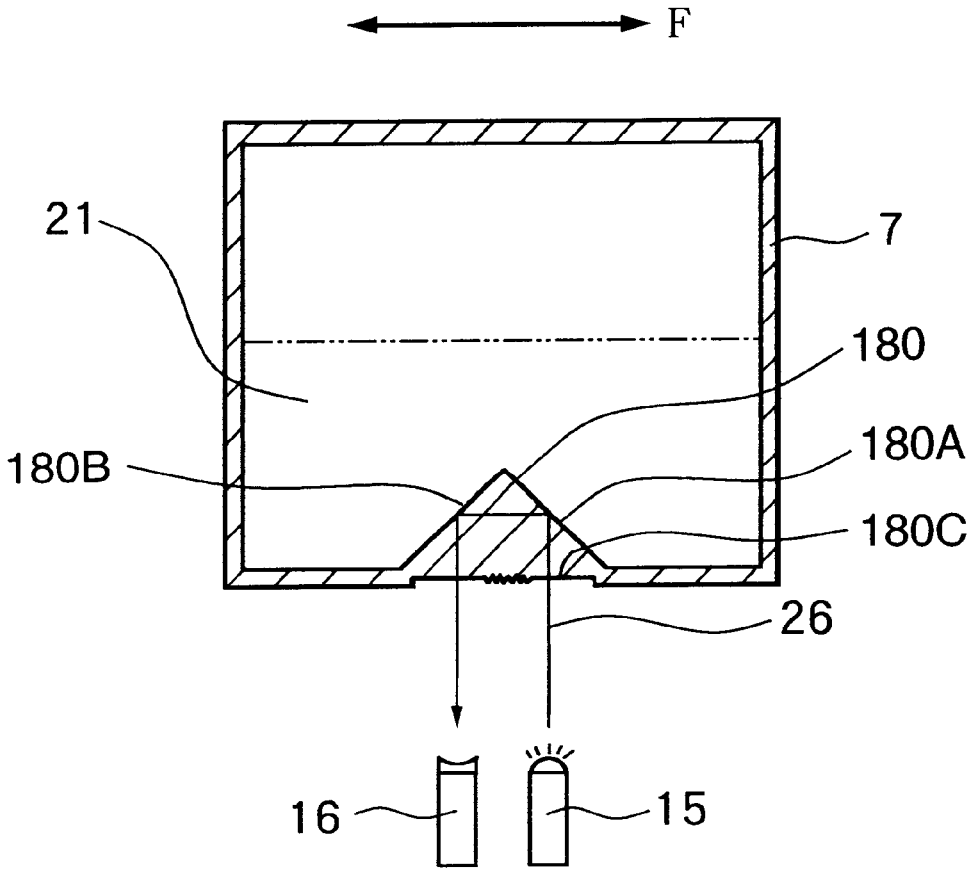
FIGS. 16A to 16C are explanatory views showing first and second modifications of a diffusion portion of the optical prism provided on the bottom portion of the ink tank.
Figure 16B:
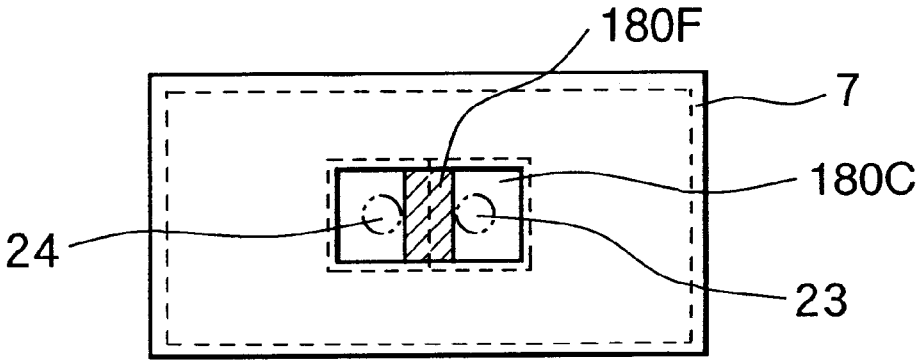
Figure 16C:
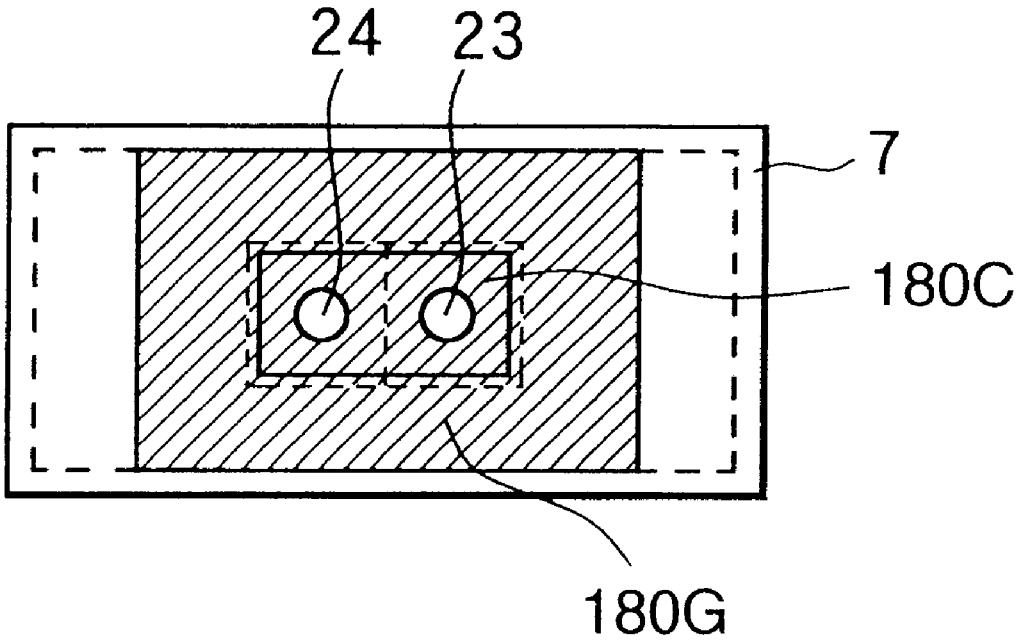

FIGS. 16A to 16C are explanatory views showing the first and second modifications of the diffusion portion of the optical prism provided on the bottom portion of the ink tank 7. FIG. 16A is a cross section of the ink tank 7 cut along the print sheet conveyance direction; FIG. 16B, a bottom view of the ink tank 7 seen in the direction indicated by an arrow T in FIG. 1; and FIG. 16C, an explanatory view showing the second modification of the diffusion portion of the optical prism provided on the bottom portion of the ink tank 7.

The ink tank 7 is formed with translucent light-transmitting material, e.g. polypropylene, and on the bottom surface of the ink tank 7, an optical prism is integratedly formed.

Referring to FIG. 16A, reference numerals 180A and 180B denote reflection surfaces serving as the boundary surface to ink as similar to FIGS. 14 and 15, and reference numeral 26 denotes a light path of the light which is perpendicularly incident upon the bottom surface 180C from the light emission device 15, reflected on the reflection surfaces 180A and 180B, and returned to the photoreceptor 16. In the present embodiment, as shown in FIG. 16B, a part (area 180F indicated by hatching) of the bottom surface 180C is not smooth, but is processed into a rough surface as compared to other areas on the bottom surface of the optical prism.

Moreover in FIG. 16B, reference numerals 23 and 24 respectively denote areas where the light path 26 passes through the bottom surface 180C.

As apparent from the foregoing configuration, in the light emitted on the bottom surface 180C by the light emission device 15, light other than the light passing through the area 23 is mostly diffused on the area 180F having the rough surface. Therefore, the amount of light reflected on the area 180F and returned to the photoreceptor 16 is considerably reduced. In other words, the light received by the photoreceptor 16 is mostly the light passing the light path 26.

Moreover, referring to FIG. 16C, taking into consideration of the light reflected on the bottom surface 180C of the optical prism or the surrounding area thereof on the bottom surface of the ink tank, an area 180G other than the areas 23 and 24 has a rough surface.

Thus, by virtue of the first and second modifications of the diffusion portion, it is possible to shut out light other than that reflected on the reflection surfaces 180A and 180B, which is unnecessary to ink detection.

Figure 17:
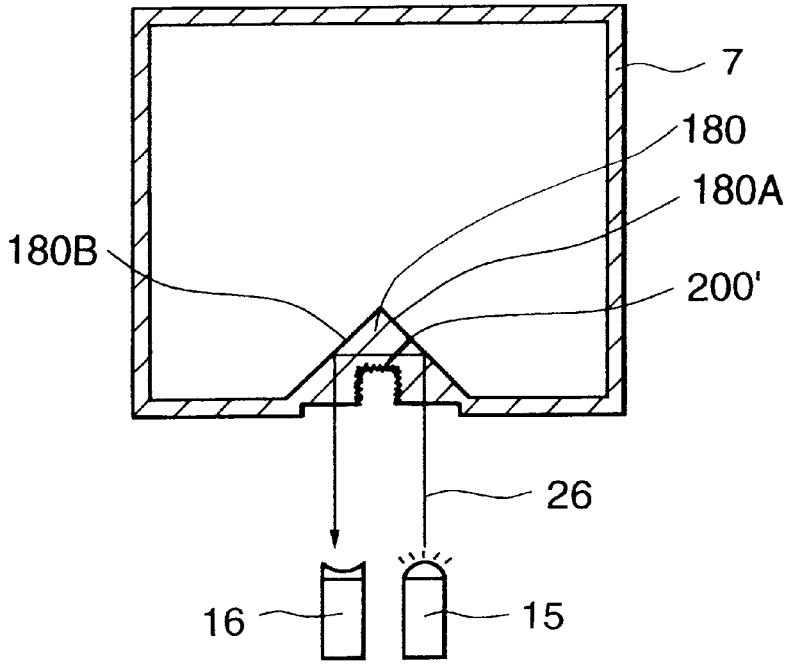
FIG. 17 is an explanatory view showing a third modification of a diffusion portion of the optical prism provided on the bottom portion of the ink tank.

FIG. 17 is an explanatory view showing the third modification of the diffusion portion of the optical prism provided on the bottom portion of the ink tank 7.

According to FIG. 17, a rough surface 200' is formed on the concave portion of the concave polyhedral portion 200 provided at the center of the bottom surface of the optical prism 180. By this, it is possible to further reduce reflected light not related to the ink detection to be returned to the photoreceptor 16.

[Prism]

Next, an application example of a prism serving as an ink-existence/non-existence detection portion will be described with reference to FIGS. 18 to 21.

Each of the foregoing embodiments employs a triangular prism as an ink-existence/non-existence detection portion. The prism according to the present invention is formed with a light-transmitting material, and has a surface constructing a part of the external wall surface of the ink tank and plural reflection surfaces which are different from the surface. The reflection surfaces which are in contact with ink have a predetermined angle with respect to the path of light emitted by the light emission device 1S. The prism is structured such that, in a case where light is incident upon the surface constructing a part of the external wall of the ink tank, the amount of light reflected on the reflection surfaces and coming through the surface constructing the part of the external wall of the ink tank is different depending on whether or not the ink tank contains ink. Herein, the plural reflection surfaces are provided in the internal wall surface of the ink tank. Therefore, the prism is not limited to a triangular prism, but may be a cylindrical prism as shown in FIG. 18.

Figure 18:
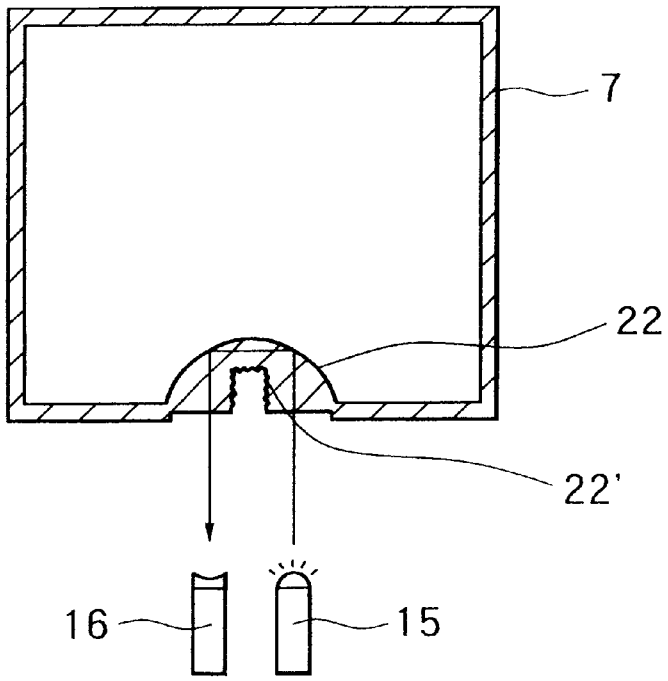
FIG. 18 is an explanatory view showing a modification of the optical prism provided on the bottom portion of the ink tank.

According to FIG. 18, a cylindrical prism 22 is used as the optical prism. In the central portion of the prism 22, a concave portion 22' is provided, and the surface of the concave portion 22' is processed into a rough surface, compared to other areas on the bottom surface of the prism 22. By this, it is possible to reduce reflected light not related to the ink detection to be returned to the photoreceptor 16. Moreover, by utilizing such cylindrical prism, even in a case where light emitted by the light emission device 15 is diffused light, the light can be focused.

Figure 19:
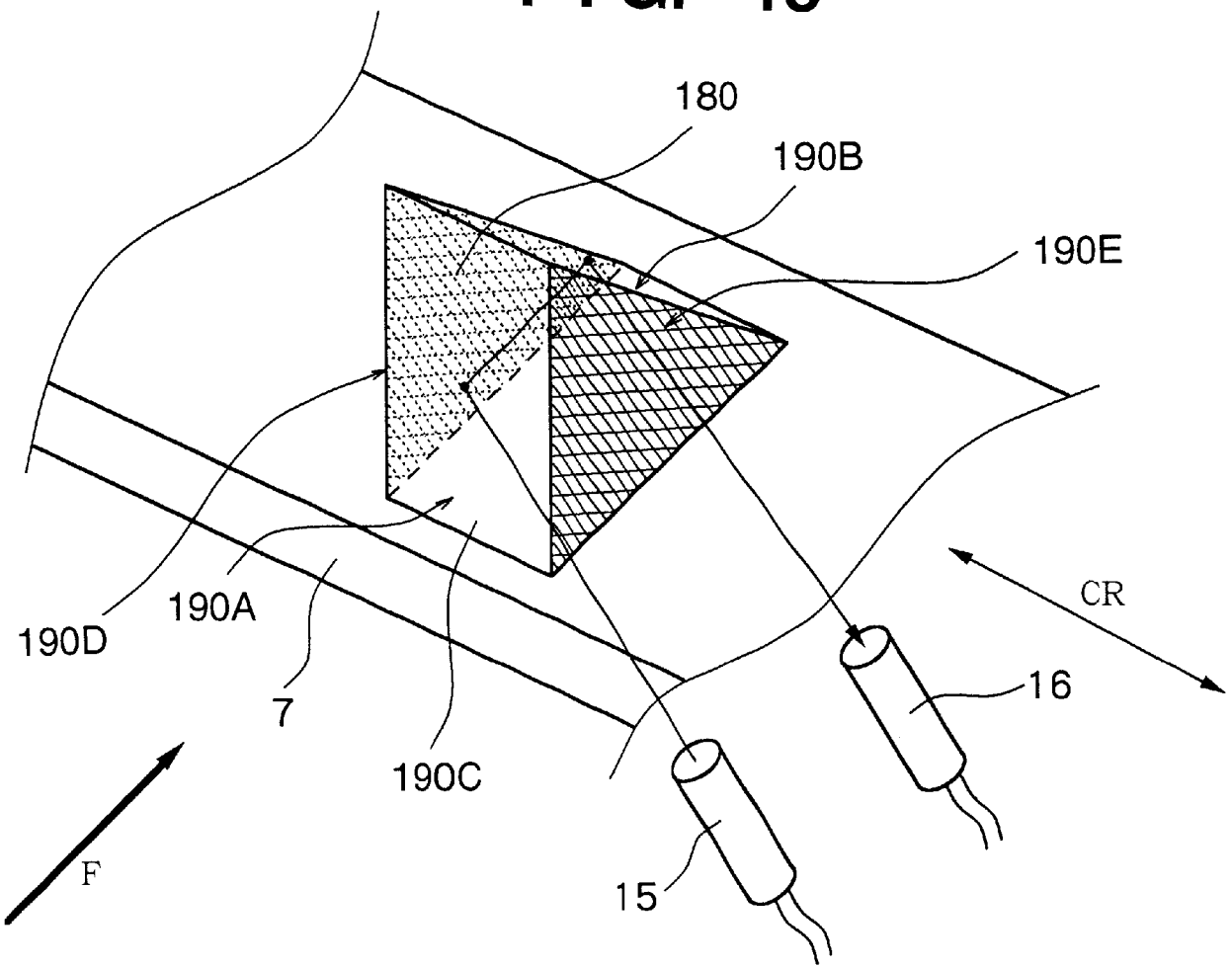
FIG. 19 is an explanatory view showing how light emitted by a light emission device 15 of an optical unit is reflected on the optical prism on the bottom surface of the ink tank and returned to a photoreceptor 16 of the optical unit.

Furthermore, with regard to the prism, the side surface of the prism may have a rough surface compared to the reflection surfaces of the optical prism, as shown in FIG. 19.

FIG. 19 is an explanatory view showing how light emitted by the light emission device 15 of the optical unit is reflected on the optical prism on the bottom surface of the ink tank and returned to the photoreceptor 16 of the optical unit. Note that the reference numerals 190A, 190B and 190C assigned to the components in FIG. 19 correspond to components described before, and description thereof will be omitted. In addition, the diffusion portion explained above is also omitted in FIG. 19. Herein, prism side walls 190D and 190E have a rough surface as compared to the reflection surfaces of the optical prism.

By having the rough surface on the side wall of the prism, it is possible to prevent reflected light not related to the reflection surfaces from returning to the photoreceptor 16. Meanwhile, in a case where the side surface has a mirror surface, if ink is attached only on the side surface but not on the reflection surfaces, the amount of light received by the photoreceptor 16 is larger as compared to the case where ink is completely exhausted. Therefore, in the case where existence/non-existence of ink is detected according to the processing of the first and second embodiments of the present invention, the amount of received light is always larger than the threshold value. Therefore, determination of no ink is not affected. In view of the above, whether to have a mirror surface or a rough surface on the side surface of the prism may be appropriately selected depending on the detection processing in a printing apparatus used.

Furthermore, in each of the foregoing embodiments and modifications of the present invention, the bottom surface 180C of the prism 180 which constructs a part of the external wall of the ink tank is described as a flat surface. However, the light-incident side (surface on which light is incident) and/or the reflected-light-exit side (surface from which reflected light exits) may have a convex surface to focus the light. Such modification is shown in FIGS. 20A, 20B, 21A and 21B.

Figure 20A:
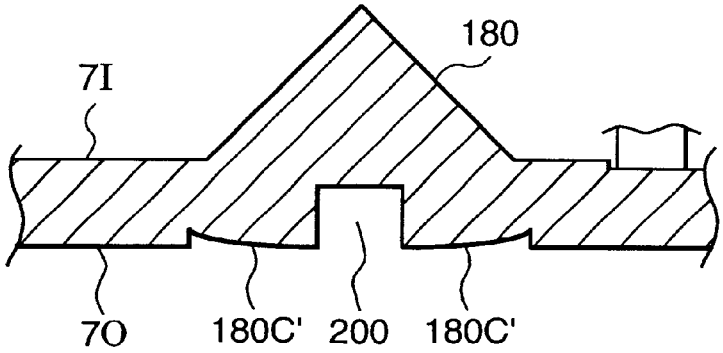
FIGS. 20A and 20B are explanatory views showing a first modification of the optical prism according to the first embodiment.
Figure 20B:
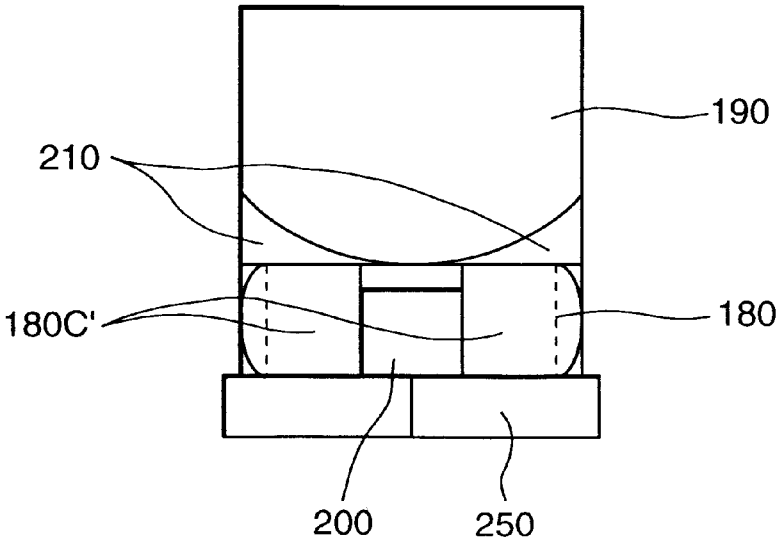
Figure 21A:
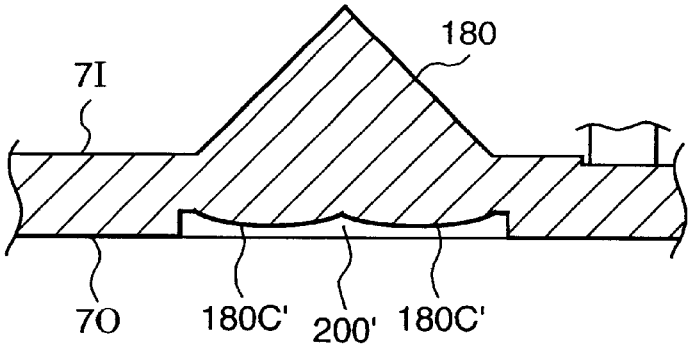
FIGS. 21A and 21B are explanatory views showing a second modification of the optical prism according to the first embodiment.
Figure 21B:
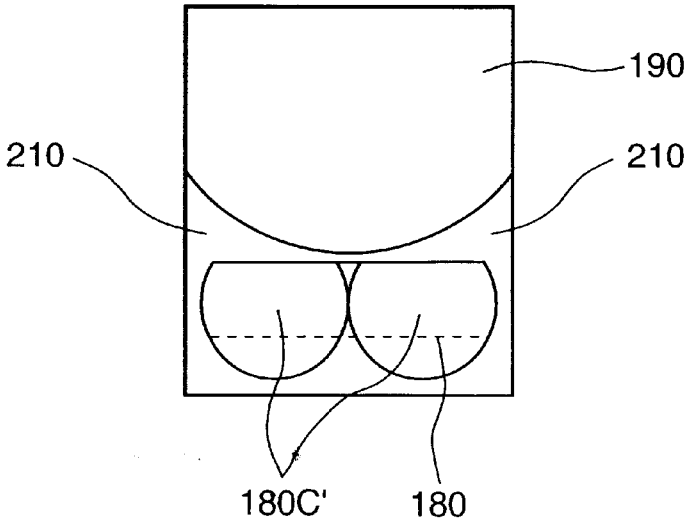

FIGS. 20A and 20B are explanatory views showing the first modification of the optical prism according to the first embodiment, and FIGS. 21A and 21B are explanatory views showing the second modification of the optical prism according to the first embodiment. In these drawings, FIGS. 20A and 21A are cross sections of the main portion of the prism and FIGS. 20B and 21B are bottom views of the ink tank 7 in the neighborhood of the prism. The optical prism shown in FIGS. 21A and 21B as the second modification does not include the concave polyhedral portion 200.

Furthermore, in FIGS. 20A to 21B, the same reference numerals as those components already described above are assigned, and description thereof will be omitted. Herein, description will be provided only on the components characteristic to the modifications. In these drawings, 7I denotes an internal wall surface of the ink tank 7; 70, an external wall surface of the ink tank 7; 180C', the bottom surface (convex surface) having a convex surface shape; and 200', a reflected-light diffusion portion (intersection portion). Note that although the structure shown in FIGS. 21A and 21B does not have the concave polyhedral portion 200, the intersection portion 200' where the left and right convex surfaces intersect, serves as the diffusion portion.

As described above, by having a convex shape for the surface on the light-incident side and/or the surface on the reflected-light exit side, it is possible to increase the amount of light related to ink detection, even if the light emitted by the light emission device 15 is diffused light. An optimal value may be decided for a radius of curvature of the convex surface 180C', based on a beam angle of light emitted by the light emission device 15 used, the distance between the light emission device 15 and ink tank 7 or the like.

As further modification of the modifications of the prism shown in FIGS. 20 and 21, the side facing the photoreceptor 16 may be provided as a flat surface. By this, even in a case where positioning precision of the ink tank 7 and the light emission device 15 is bad, reflected light can be detected.

Note that it goes without saying that the prism according to the present invention is applicable regardless of the direction arranged to the ink tank.

[Structure of Ink-Tank-Existence/Non-Existence Detection Portion]

In the above-described embodiments, existence/non-existence of an ink tank is detected by utilizing the concave curved surface reflection portion 190 provided on the ink tank 7. However, detection of ink tank existence/non-existence can be realized by providing a reflector in which the amount of light reflected by the reflector and received by the photoreceptor 16 does not change regardless of ink existence/non-existence in the ink tank. Therefore, various modifications are possible.

Herein, modification of the ink-tank-existence/non-existence detection portion will be described with reference to FIGS. 22A, 22B, 23A and 23B.

Figure 22A:
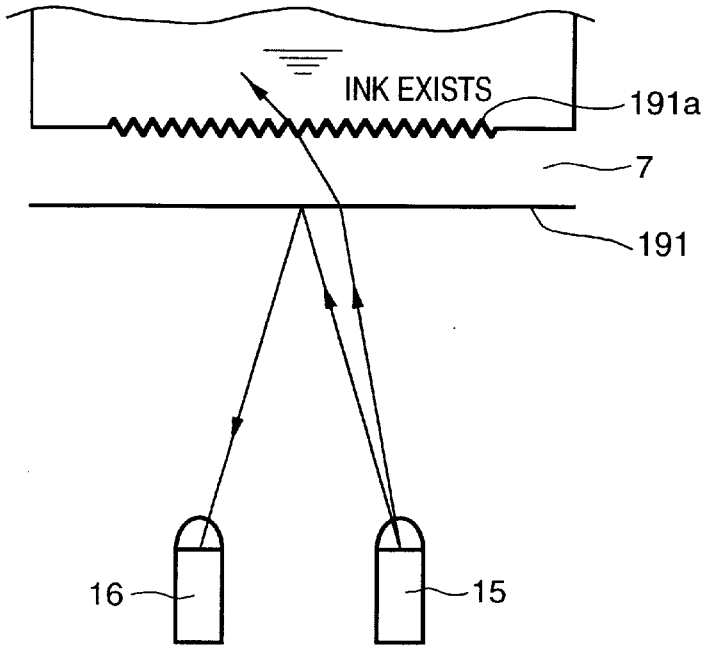
FIGS. 22A and 22B are explanatory views showing a modification of the structure of the ink-tank-existence detection portion.
Figure 22B:
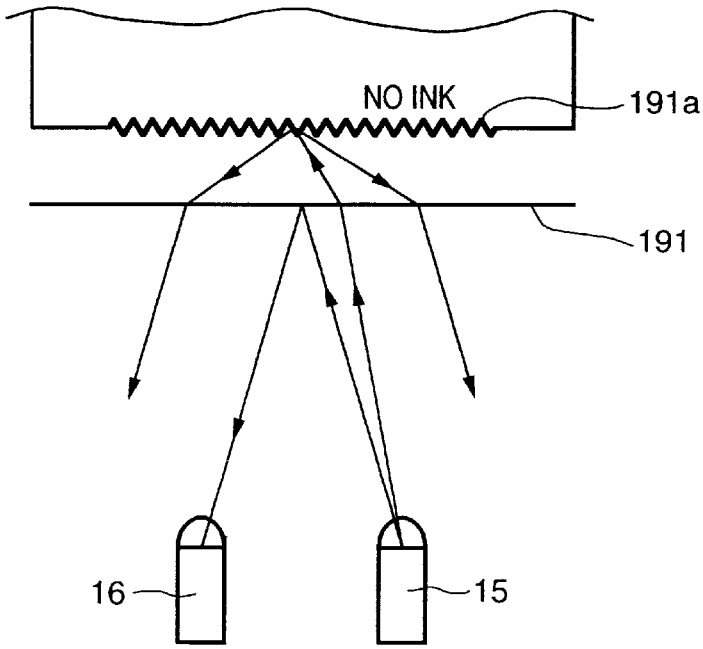
Figure 23A:
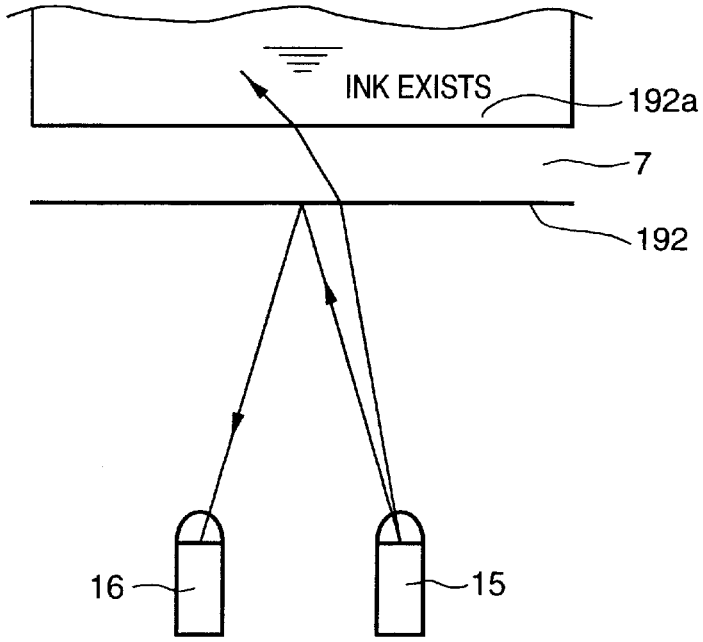
FIGS. 23A and 23B are explanatory views showing the structure of a conventional ink-tank-existence detection portion.
Figure 23B:
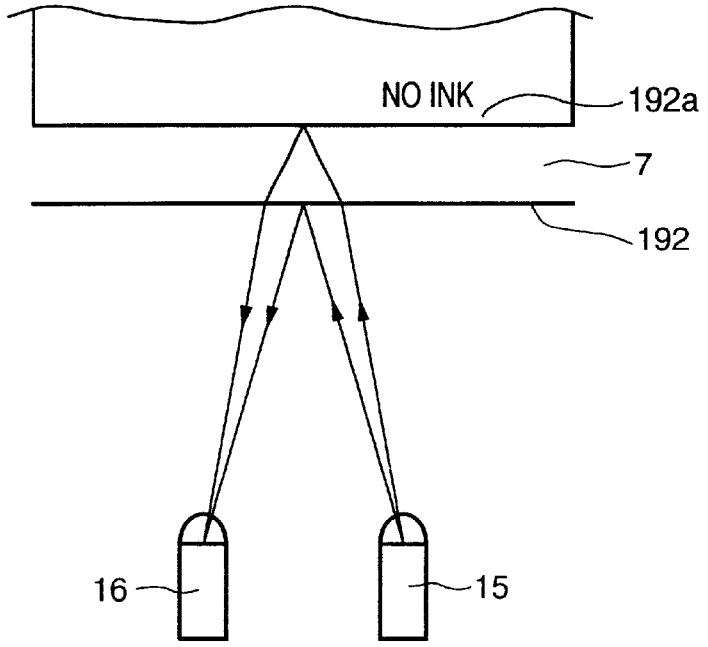

FIGS. 22A and 22B show a modification of the structure of the ink-tank-existence/non-existence detection portion, while FIGS. 23A and 23B show the structure of a conventional ink-tank-existence/non-existence detection portion. Note that the same reference numerals as those components already described above are assigned in FIGS. 22A to 23B, and description thereof will be omitted. Herein, description will be provided only on the components characteristic to the modifications.

In FIGS. 22A and 22B, reference numeral 191 denotes a light reflection surface formed with a light-transmitting material, provided on the ink tank 7, for detecting existence/non-existence of an ink tank; and 191*a*, an internal wall surface of the ink tank having an area rougher than the light reflection surface 191. FIGS. 22A shows a case where the ink tank contains ink, and FIG. 22B shows a case where the ink tank does not contain ink.

When the ink tank 7 contains ink, light emitted by the light emission device 15 is partially reflected on the light reflection surface 191 and returned to the photoreceptor 16 as shown in FIG. 22A. Another part of the light i.e., the refracted light, passes through the bottom wall of the ink tank 7 to the internal wall surface 191*a*, then are again refracted at the internal wall surface 191*a* and penetrates into the internal space of the ink tank (ink container). On the other hand, when the ink tank 7 does not contain ink, as shown in FIG. 22B, the refracted light penetrated into the bottom wall of the ink tank 7 is irregularly reflected on the internal wall surface 191*a*. Thus, the light is not returned to the photoreceptor 16. Accordingly, the amount of light received by the photoreceptor 16 does not change much in either cases.

In the conventional method of ink-tank-existence/non-existence detection, a mere light-transmitting material is used in a part of the bottom surface of the ink tank 7 as shown in FIGS. 23A and 23B. As similar to FIGS. 22A and 22B, FIG. 23A shows a case where the ink tank contains ink, and FIG. 23B shows a case where the ink tank does not contain ink. Reference numeral 192 denotes a light-transmitting material serving as an ink-tank-existence/non-existence detection portion; and 192*a*, an internal wall surface of the ink tank formed with the light-transmitting material which contacts with ink.

Comparing the case of FIGS. 23A and 23B with the case of FIGS. 22A and 22B, if the ink tank 7 contains ink, the amount of light received by the photoreceptor 16 is the same as that of FIGS. 22A and 22B; but if the ink tank 7 does not contain ink, the light reflected on the internal wall surface 192*a* of the conventional ink tank is returned to the photoreceptor 16. Therefore, the amount of light in the case of FIG. 23B is increased, compared to the case of FIG. 23A.

Thus, in the conventional method of detecting existence/non-existence of an ink tank, the outputted signal is changed depending on whether or not the ink tank contains ink. However, in the present embodiment, the ink-tank-existence/non-existence detection portion is made into a concave surface shape in order to increase the amount of light received in a case where the ink tank contains ink, minimizing the influence of existence/non-existence of ink. Furthermore in the present embodiment, the amount of received light is made substantially constant as described in the above modification, thus making it possible to accurately detect the existence/non-existence of an ink tank regardless of whether or not the ink tank contains ink.

Such structure of having an irregular reflection surface in the internal wall surface may be employed by the ink-tank-existence/non-existence detection portion as described in the above modification, or may be applied to the range surface portion, which is used for calibrating the detection processing, described in the foregoing embodiment of the present invention. In this case, it is preferable that the ink-tank-existence/non-existence detection portion has a concave surface shape as described in each of the foregoing embodiments, to ensure a large amount of light received by the photoreceptor.

Moreover, in a case where the ink-tank-existence/non-existence detection portion is provided to the ink tank in addition to the ink-existence/non-existence detection portion, it is preferable to have a diffusion portion for diffusing light in between the ink-existence/non-existence detection portion and ink-tank-existence/non-existence detection portion, as described above. In the above embodiments, the rough surface portion 210 is provided in between the optical prism 180 and the concave curved surface reflection portion 190 as a diffusion portion where light is irregularly reflected. However, the present invention is not limited to this, but various modifications may be considered.

Figure 24A:
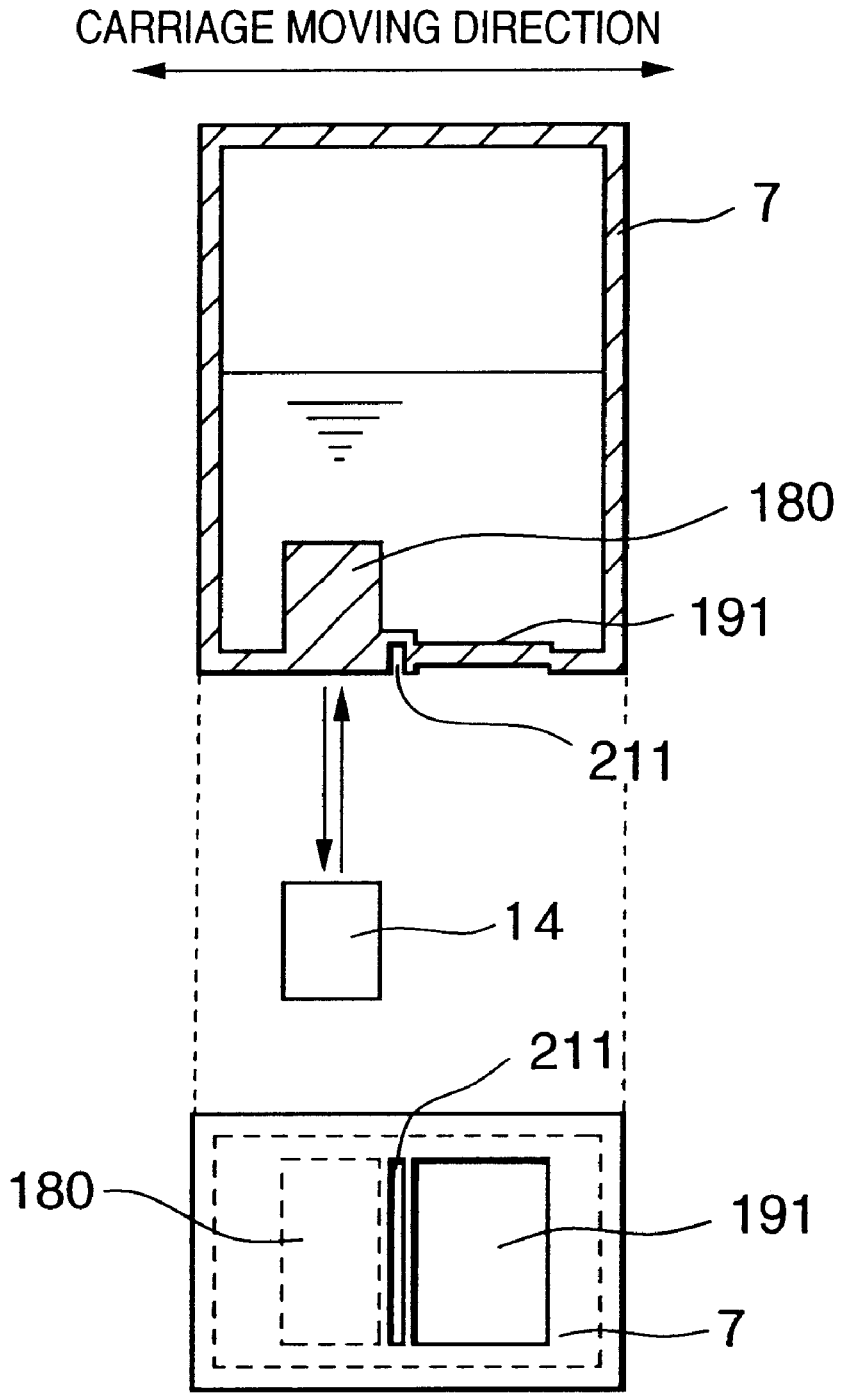
FIGS. 24A and 24B are explanatory views showing a modification of the diffusion portion.
Figure 24B:
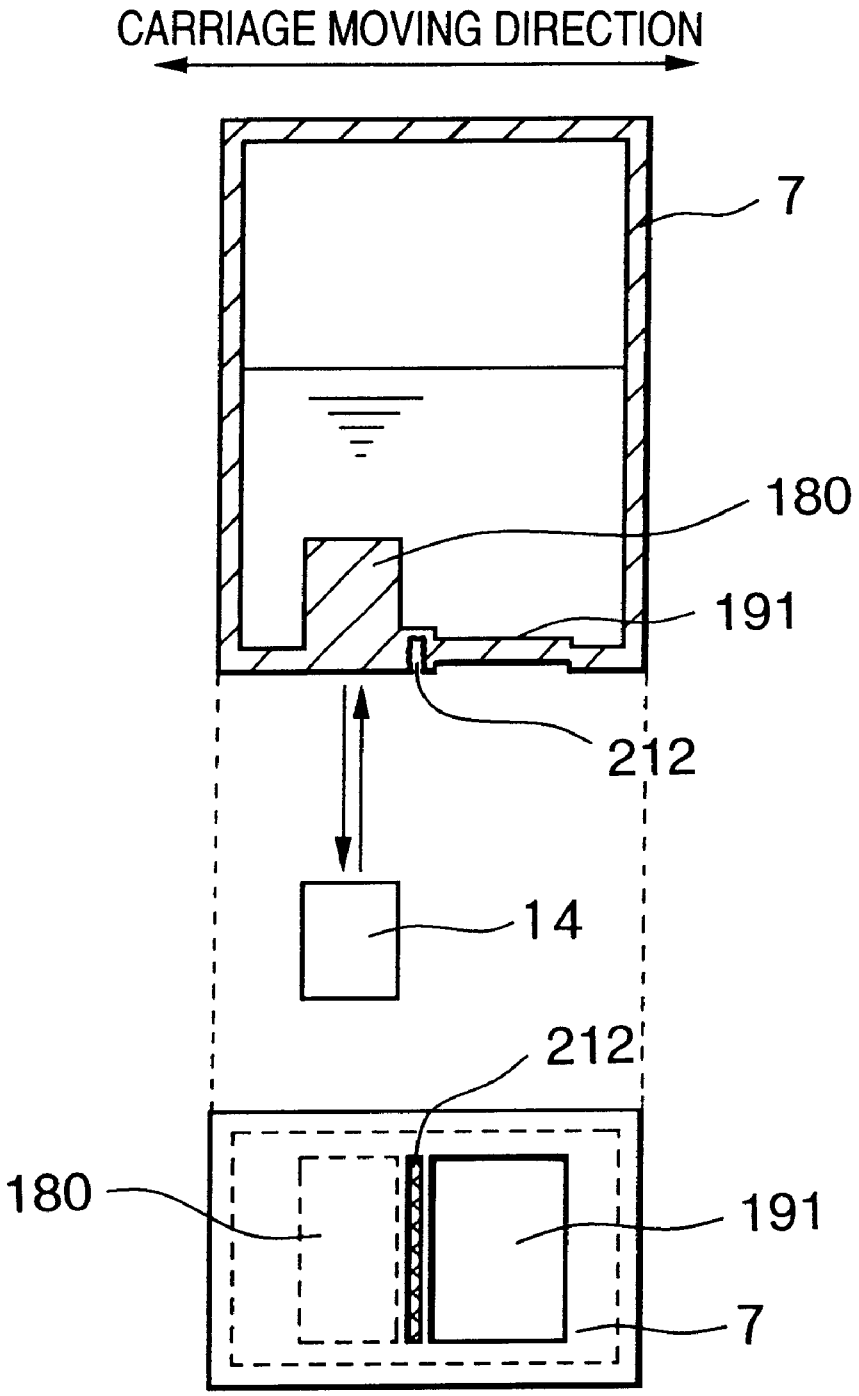

FIGS. 24A and 24B show the modification of the diffusion portion.

For instance, as shown in FIG. 24A, a concave portion 211 may be provided, in place of the rough surface portion 210, in between the optical prism 180 and the light reflection surface 191 in order to decrease the amount of light received by the photoreceptor 16. Alternately, as shown in FIG. 24B, the surface of the concave portion 211 may be further processed into a rough surface 212, so as to assure the reduced amount of light.

[Structure of Liquid Container]

Next, a modified structure of the ink tank (liquid container) to which the present invention is applicable will be described.

Although each of the foregoing embodiments of the present embodiment describes the liquid container comprising: a negative-pressure generating member accommodating chamber, having ink supply openings and an atmospheric-air communicating portion, for accommodating a negative-pressure-generating member; and a substantially enclosed liquid container having a passage opening connected to the negative-pressure generating member accommodating chamber, the application of the present invention is not limited to such container. In practice, as long as the container has a liquid reservoir portion capable of directly containing liquid in the neighborhood of the ink-existence/non-existence detection portion, it is applicable.

Furthermore, in each of the foregoing embodiments, the container contains one type of ink. However, as shown in FIG. 25A, the container may have plural types of liquid.

Figure 25A:
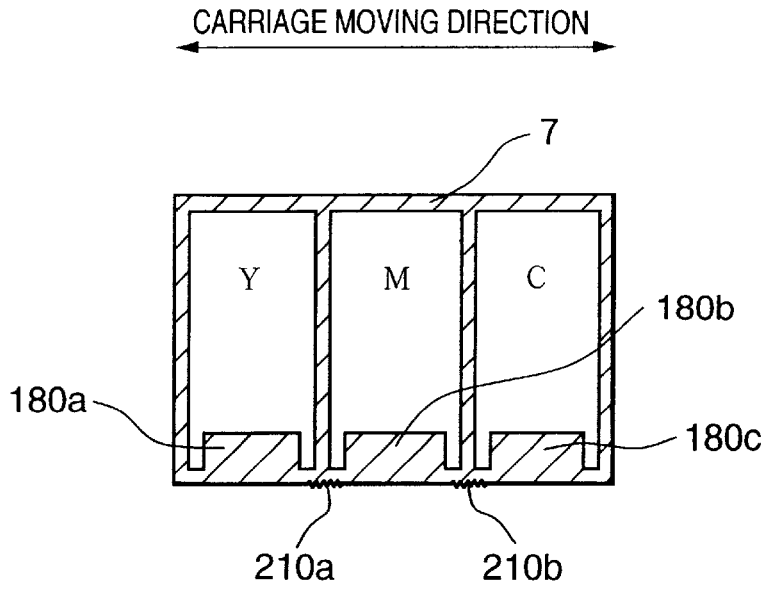
FIGS. 25A and 25B are an explanatory view and a graph respectively showing the structure of the bottom portion of an ink tank containing plural colors of ink as a modification of the ink tank, and showing variations in the amount of light received by a photoreceptor 16.
Figure 25B:
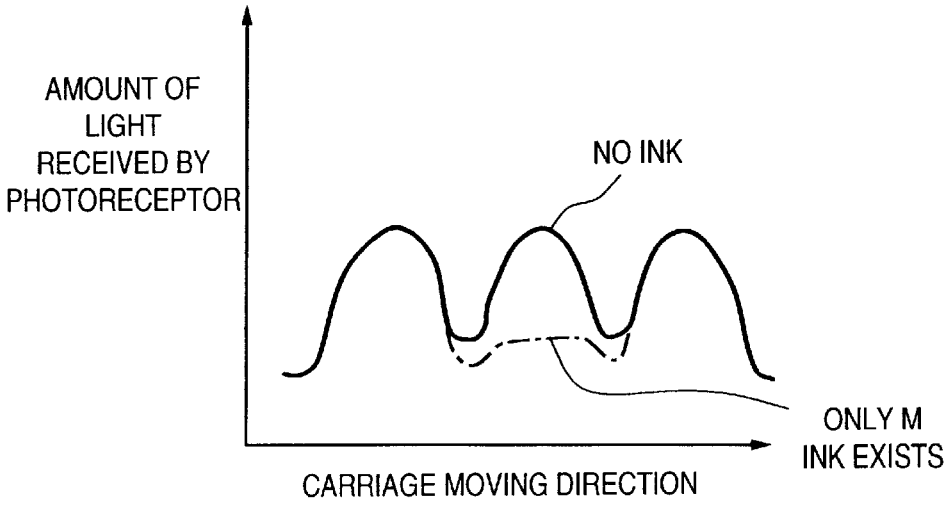

FIGS. 25A and 25B show a modification of the ink tank. FIG. 25A shows the structure of the bottom portion of an ink tank containing plural colors of ink, and FIG. 25B shows variations in the amount of light received from the bottom portion of the ink tank.

In this modification, the ink tank is divided into three compartments as shown in FIG. 25A, each containing different colors of ink (yellow (Y), magenta (M) and cyan (C)). In this case, optical prisms 180*a*, 180*b* and 180*c* are provided respectively on the bottom portions of these compartments, and rough surface portions 210*a* and 210*b* are formed in between the three optical prisms for irregularly reflecting light.

In a case where the ink tank 7 having the above construction is attached to the carriage 2 and the carriage 2 is moved, the amount of light received by the photoreceptor 16 changes as shown in FIG. 25B. As apparent from FIG. 25B, by virtue of forming the rough surface portions 210*a* and 210*b* in between the optical prisms on the bottom surface of the ink tank 7, the amount of received light shows the minimum value in between the optical prisms. Thus, the amount of light received from each optical prism has less influence of the neighboring optical prisms. Note that in FIG. 25B, the solid line indicates a case where all the ink compartments are empty, and the two-dot chain line indicates a case where there is only M ink left.

Note that although each of the above-described embodiments of the present invention comprises the ink-existence/non-existence detection portion and ink-tank-existence/non-existence detection portion, the embodiment may comprise only the ink-existence/non-existence detection portion if ink-tank detection is not necessary.

Further, in the foregoing embodiments and modifications, the liquid container has been described as an ink tank for containing ink. However, the present invention is not limited to this. For instance, the liquid contained therein may be liquid other than ink, e.g. processing liquid for water-proofing an image printed on a print medium and/or for enhancing the image quality.

Therefore, according to the principle of the detection system of the present invention, the liquid contained in the liquid container is not limited to ink or the aforementioned processing liquid, but may be any liquid as long as an absolute refractive index between air and the liquid is different.

More specifically, so long as the above condition is satisfied and the amount of received light differs depending on existence/non-existence of contents in the container, the difference in the amount of received light can be made larger by the diffusion portion; thus, the contents in the container is not limited to liquid. For instance, it may be solid ink which liquefies at or above the fusing point. In this case, the liquid-jet printing apparatus integrating the container may have means for taking the solid ink out of the container and liquefying the ink.

[Sequence]

Next, modification of the control processing applicable to the detection system according to the present invention will be described with reference to FIGS. 26A to 27.

Figure 26A:
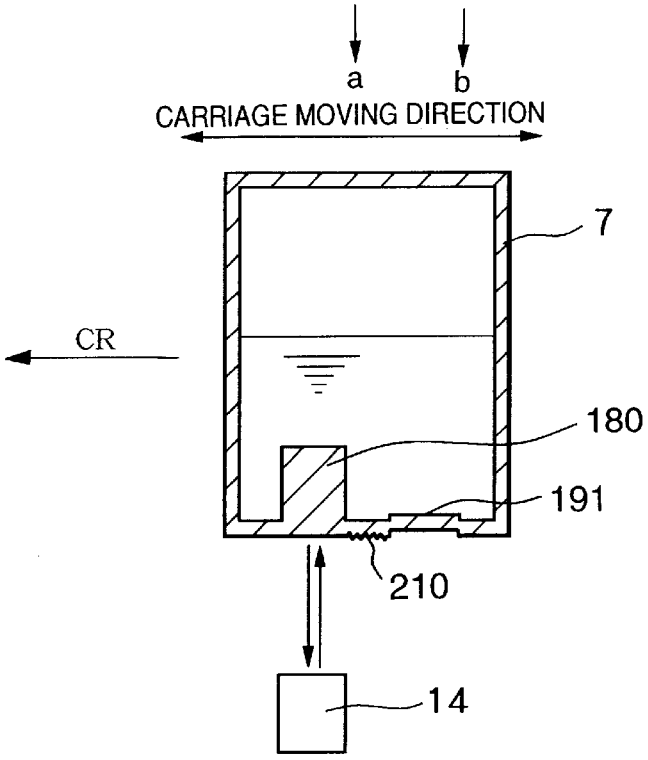
FIGS. 26A and 26B are explanatory views and FIG. 26C is a graph, showing the relative position relation between the ink tank 7 and an optical unit 14, and the relation between their relative positions and an amount of light received by a photoreceptor 16.
Figure 26B:
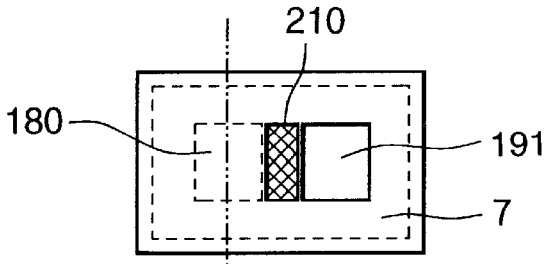
Figure 26C:
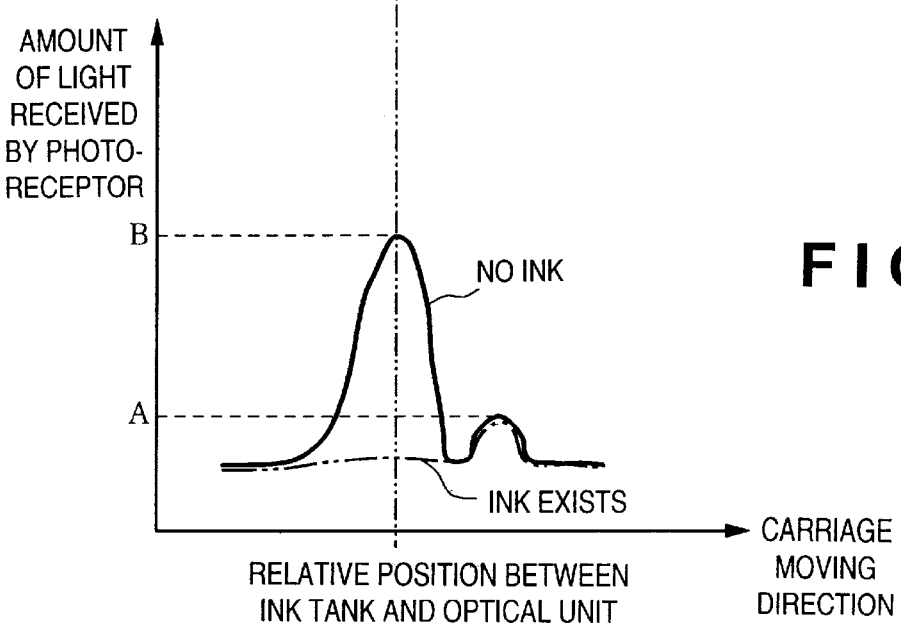

FIGS. 26A and 26B are explanatory views and FIG. 26C is a graph, showing the relative position relation between the ink tank 7 and an optical unit 14, and the relation between their relative positions and an amount of light received by the photoreceptor 16. FIGS. 26A and 26B differ from FIGS. 6A and 6B in that a flat-type light reflection surface 191 is used and that the rough surface portion 210 has a rectangular shape. Since other portions are the same, description thereof will be omitted.

Figure 27:
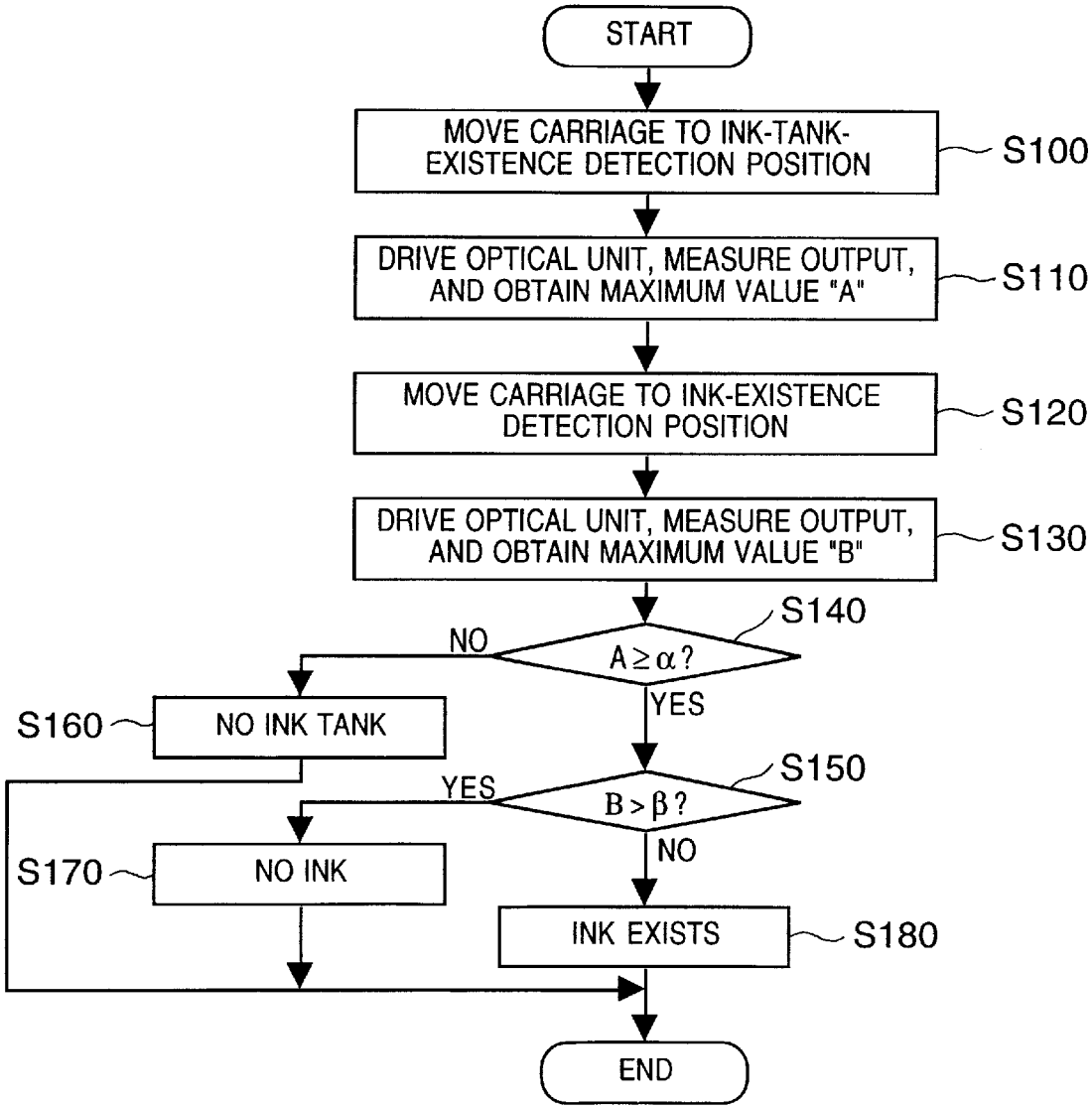
FIG. 27 is a flowchart showing a modification of control for detecting existence/non-existence of ink and existence/non-existence of an ink tank.

FIG. 27 is a flowchart showing control for detecting existence/non-existence of ink and detecting existence/non-existence of an ink tank according to the modification. Note that the basic flow of the control is identical to that explained in the first embodiment. However, according to the modification, calibration is not performed, and the maximum amounts of light received at the ink-existence/non-existence detection portion and ink-tank-existence/non-existence detection portion are directly compared with a threshold value.

Hereinafter, the modification will be briefly described with reference to FIGS. 26 and 27.

First in step S100, the carriage 2 is moved so that the right edge of the light reflection surface 191 (indicated by an arrow b in FIG. 26A) is positioned directly above the optical unit 14. In step S110, while moving the carriage 2 in the direction indicated by an arrow CR at predetermined speed, infrared light is emitted by the light emission device 15, the reflected light is consecutively measured as an output of the low-pass filter (LPF) 31, A/D conversion is performed on the measured value, the maximum value is obtained based on the converted digital value, and the obtained value is stored in the DRAM 1703 as a value "A".

In step S120, the carriage 2 is further moved in the direction indicated by an arrow CR so that the right edge of the optical prism 180 (indicated by arrow a in FIG. 26A) is positioned directly above the optical unit 14. In step S130, while moving the carriage 2 in the direction indicated by the arrow CR at predetermined speed, reflected light of the infrared light which is emitted by the light emission device 15 as similar to step S110 is consecutively measured as an output of the low-pass filter (LPF) 31, A/D conversion is performed on the measured value, the maximum value is obtained based on the converted digital value, and the obtained value is stored in the DRAM 1703 as a value "B".

Next, in step S140, the value "A" is compared with a predetermined threshold value "α". If A<α, the processing proceeds to step S160 where determination is made that an ink tank 7 is not attached to the carriage 2, and the processing ends. Meanwhile, if A≧α, determination is made that the ink tank 7 (ink cartridge 20) is attached, and the processing proceeds to step S150.

In step S150, the value "B" is compared with another predetermined threshold value "β". Herein, if B>β, the processing proceeds to step S170 where determination is made that the ink tank 7 has no ink, and the processing ends. Meanwhile, if B≦β, the processing proceeds to step S180 where determination is made that ink tank 7 has ink, and the processing ends.

As set forth above, according to the processing steps described in the foregoing embodiments and modifications of the present invention, by virtue of the fact that the maximum value in a predetermined range is detected, even if positioning is not accurate because of a margin of each component constructing the apparatus or fluctuation of positioning of the ink tank and optical unit and so forth, it is possible to accurately detect existence/non-existence of ink and existence/non-existence of an ink tank.

Furthermore, according to the above processing, since the maximum value in a predetermined range is detected, the ink-existence/non-existence detection portion may merely be configured such that an amount of light received by the photoreceptor is different depending on existence/non-existence of ink, and the ink-tank-existence/non-existence detection portion may merely be configured such that an amount of light received by the sensor is constant regardless of existence/non-existence of ink in the ink tank, but is different when an ink tank is not attached. Moreover, there is an advantage in this case that the diffusion portion is not always necessary in between the ink-existence/non-existence detection portion and the ink-tank-existence/non-existence detection portion.

On the other hand, in the structure according to each embodiment of the present invention, the amount of light received by the photoreceptor when the ink-existence/non-existence detection portion detects no ink is larger than the amount of light received by the photoreceptor when the ink-tank-existence/non-existence detection portion detects existence of an ink tank, regardless of the type of ink. Since the amount of light received by the photoreceptor when the ink-tank-existence/non-existence detection portion detects existence of an ink tank is substantially constant regardless of the type of ink, it is possible to detect existence/non-existence of ink and/or existence/non-existence of an ink tank by processing other than that of the foregoing embodiments and modifications.

For instance, the detection may be realized by driving the optical unit, while scanning the carriage, and obtaining a maximum value X for both the ink-existence/non-existence detection portion and ink-tank-existence/non-existence detection portion. If the maximum value X is larger than the aforementioned threshold value β (X≧β), determination is made that there is an ink tank but no ink; if β>X>α, determination is made that there is an ink tank and ink; and if α≧X, determination is made that there is no ink tank. In this processing, since the detection results at the ink-existence/non-existence detection portion and ink-tank-existence/non-existence detection portion are dealt within one range, advantages are attained such that position adjustment of a carriage is easy, and a memory may store only one maximum value.

As set forth above, according to the liquid container of the present invention, by having a structure such that an amount of reflected light at the ink-tank-existence/non-existence detection portion is less than that of the ink-existence/non-existence detection portion when there is no liquid in the container, the detection processing in the detection system becomes more flexible. Note that even in this case, it is preferable to provide a diffusion portion in between the ink-existence/non-existence detection portion and ink-tank-existence/non-existence detection portion because the signal used for detecting existence/non-existence of an ink tank can be surely discriminated from the signal for detecting existence/non-existence of ink, thus enabling accurate detection.

Accordingly, it is possible to improve reliability of the detection as to whether or not there is ink and/or whether or not there is an ink tank by utilizing an ink tank having a diffusion portion and the processing described in each of the above embodiments according to the present invention.

Note that in the liquid container comprising: a negative-pressure generating member accommodating chamber, having ink supply openings and an atmospheric-air communicating portion, for accommodating a negative-pressure-generating member; and a substantially enclosed liquid container having a passage opening connected to the negative-pressure generating member accommodating chamber, the aforementioned state of "no ink" indicates the state where the liquid container has no ink but the negative-pressure generating member accommodating chamber still has available ink.

Therefore, after making the determination of "no ink" according to the aforementioned processing, the number of dots corresponding to ink discharge may be counted based on print data. When the counted value becomes higher than a counted number corresponding to the amount of ink in the negative-pressure-generating member, information indicative of no ink in the negative-pressure generating member accommodating chamber is displayed on the display screen, requesting a user to refill ink or exchange the container. As described above, ink in the liquid container can be efficiently used. Such information may be displayed on the display unit 1710 provided on the main body of the printing apparatus shown in FIG. 1, or may be displayed on a screen of a computer which gives instruction of printing.

[Liquid-jet Printing Apparatus]

The liquid-jet printing apparatus described in the foregoing embodiments is capable of printing at high density and high speed, thus can be utilized as output means of a data processing system, e.g. a copying machine, facsimile apparatus, an electric typewriter, word processor, printer serving as an output terminal of work station, portable printer provided in a personal computer, optical disc device, video camera or the like. In this case, the liquid-jet printing apparatus is configured so as to be adaptive to the function and operating environment of these apparatuses.

Therefore, it goes without saying that the applicable area of the liquid container according to the present invention is not limited to a mere printer, but may be extended to various apparatuses such as a facsimile apparatus or copying machine and the like.

As many apparently widely different embodiments of the present invention can be made without departing from the spirit and scope thereof, it is to be understood that the invention is not limited to the specific embodiments thereof except as defined in the appended claims.

What is claimed is:

1. A detection system comprising:

a liquid container for holding liquid;

optical means including a light emission unit for emitting light to said liquid container and a light receptor for receiving reflected light of the emitted light;

a prism formed with light transmitting material, said prism having a surface constructing a part of an external wall surface of said liquid container and plural reflection surfaces, which are different from said surface, each being in contact with liquid and having a predetermined angle with respect to a light path of the emitted light; and determination means for determining whether or not the liquid in said liquid container exists based on the reflected light of the light emitted on said prism and received by said optical means, wherein said liquid container has a diffusion portion, provided in between a portion opposing to said light emission unit and another portion opposing to said light receptor, for diffusing light reflected on said external wall surface of said liquid container so as to prevent the reflected light from returning to said light receptor of said optical means, and said liquid container and said optical means are separated from each other.

2. The detection system according to claim 1, wherein said prism is provided on a bottom surface portion of said liquid container.

3. The detection system according to claim 1, wherein said diffusion portion is a concave polyhedral portion provided in a center of a bottom surface portion of said prism.

4. The detection system according to claim 1, wherein said diffusion portion is a rough surface provided in a center of a bottom surface portion of said prism.

5. The detection system according to claim 1, further comprising a detection portion provided in the vicinity of said prism, in cooperation with said optical means and determination means, for, when light is emitted by said optical means, determining whether or not said liquid container exists by reflecting a predetermined amount of light regardless of whether or not the liquid in said liquid container exists.

6. The detection system according to claim 5, wherein said detection portion is a concave curved surface portion provided on said external wall surface of said liquid container.

7. The detection system according to claim 5, wherein the amount of light, reflected on said detection portion, detected by said light receptor, is in between an amount of light reflected on said prism in a case where said liquid container contains liquid and an amount of light reflected on said prism in a case where said liquid container does not contain liquid.

8. The detection system according to claim 5, further comprising a second diffusion portion, different from said diffusion portion, which is provided in between said prism and said detection portion, for diffusing light reflected on said external wall surface of said container, thereby preventing the reflected light from returning to said light receptor.

9. The detection system according to claim 1, wherein said determination means comprises:

maximum value detection means for respectively obtaining maximum values of an amount of reflected light received when said liquid container and said optical means are within respective predetermined ranges;

comparison means for comparing the maximum values detected by said maximum value detection means with respective predetermined threshold values; and discrimination means for discriminating whether or not the liquid in said liquid container exists and whether or not said liquid container exists, based on the comparison results obtained by said comparison means.

10. A liquid-jet printing apparatus comprising:

a liquid container for containing liquid;

a container holding portion capable of holding said liquid container;

optical means, provided near said container holding portion, including a light emission unit for emitting light to said liquid container and a light receptor for receiving reflected light of the emitted light; and detection means for detecting whether or not liquid in said liquid container exists, based on the reflected light of the light emitted by said light emission unit and received by said light receptor, wherein said liquid container held by said container holding portion comprises:

a prism formed with light transmitting material, said prism having a surface constructing a part of an external wall surface of said liquid container and plural reflection surfaces, which are different from said surface, each being in contact with liquid and having a predetermined angle with respect to a light path of the emitted light; and a diffusion portion provided in between a light reception portion and a light reflecting portion of said prism, for diffusing light reflected on said external wall surface of said liquid container so as to prevent the reflected light from returning to said light receptor of said optical means, and said liquid container and said optical means are separated from each other.

11. A liquid container comprising:

a liquid storage container for reserving liquid;

a liquid supply opening for supplying the liquid reserved in said liquid storage container externally; and a prism formed with light transmitting material, said prism having a surface constructing a part of an external wall surface of said liquid storage container and plural reflection surfaces, which are different from said surface, each being in contact with liquid and having a predetermined angle with respect to a light path of emitting light, wherein said prism has a concave polyhedral portion constructed with plural surfaces having a different shape from that of said plural reflection surfaces of said prism, said concave polyhedral portion provided on the surface of said prism which constructs said external wall surface of said liquid storage container, and wherein a concave depth of said concave polyhedral portion is about a thickness of an external wall surface whose part is constructed by said prism.

12. The liquid container according to claim 11, wherein said prism is provided on a bottom surface portion of said liquid storage container.

13. The liquid container according to claim 11, wherein a side surface of said prism partially contacts against a part of said external wall surface of said liquid storage container, and a notch is provided in said external wall surface which a side surface of said prism partially contacts against.

14. The liquid container according to claim 11, wherein among surfaces of said prism, forming a part of said external wall surface of said liquid storage container, at least one of said surfaces separated by said concave polyhedral portion has a convex surface.

15. The liquid container according to claim 11, wherein an internal surface of said concave portion of said concave polyhedral portion has a rough surface.

16. The liquid container according to claim 11, wherein said plural reflection surfaces of said prism have a smooth surface and a side surface of said prism has a rough surface so as to irregularly reflect light.

17. The liquid container according to claim 11, further comprising a detection portion provided in the vicinity of said prism, when light is emitted by external optical means, for reflecting a predetermined amount of light regardless of whether or not the liquid exists in said liquid storage container.

18. The liquid container according to claim 17, wherein said detection portion is a concave surface portion provided on said external wall surface of said liquid storage container.

19. The liquid container according to claim 17, further comprising a diffusion portion provided in between said prism and said detection portion, for diffusing light reflected on said external wall surface of said liquid storage container, thereby preventing the reflected light from returning to a light receptor of the external optical means.

20. A liquid container attachable/detachable to/from a printing apparatus having optical means in which a light emission unit and a light receptor are fixed within a predetermined space, comprising:

a liquid storage container for reserving liquid;

a liquid supply opening for supplying the liquid reserved in said liquid storage container externally;

a first detection portion provided on a surface of said liquid storage container, wherein when light is emitted, said first detection portion reflects different amounts of light depending on whether or not the liquid in said liquid storage container exists; and a second detection portion provided in the vicinity of said first detection portion, wherein when light: is emitted, said second detection portion reflects a predetermined amount of light, wherein said container is movable relative to the optical means, and the predetermined amount of light reflected by said second detection portion is between an amount of reflected light in a case where said first detection portion detects existence of liquid and an amount of reflected light in a case where said first detection portion detects non-existence of liquid.

21. The liquid container according to claim 20, wherein said first detection portion is a light-transmitting prism provided on a bottom surface of said liquid storage container.

22. The liquid container according to claim 20, wherein said second detection portion is a concave curved surface portion provided on an external wall surface of said liquid storage container.

23. The liquid container according to claim 22, wherein a radius of curvature of said concave curved surface portion is larger in a first direction than a second direction, said first direction being parallel to a line connecting a light incident portion and light reflecting portion of said first detection portion, the second direction being perpendicular to the first direction.

24. A liquid-jet printing apparatus including said liquid container according to claim 23, and further comprising:

a carriage capable of holding said liquid container and scanning in the second direction;

optical means, provided along a scanning path of said carriage, capable of emitting light to said first and second detection portions of said liquid storage container and receiving reflected light;

control means for controlling to drive said optical means while moving said liquid container by said carriage in the vicinity of said optical means; and detection means for detecting existence/non-existence of liquid in said liquid container and/or existence/non-existence of said liquid container, based on the reflected light received by said optical means, wherein the light emission unit and light receptor of said optical means are arranged in the first direction.

25. The liquid-jet printing apparatus according to claim 24, wherein said detection means comprises:

maximum value detection means for respectively obtaining maximum values of an amount of received reflected light when a relative portion of said liquid container and said optical means are within respective predetermined ranges;

comparison means for comparing the maximum values detected by said maximum value detection means with respective predetermined threshold values; and determination means for determining existence/non-existence of liquid in said liquid container and/or existence/non-existence of said liquid container, based on the comparison result obtained by said comparison means.

26. The liquid container according to claim 20, wherein an internal wall surface of said liquid storage container where said second detection portion is arranged has a rough surface.

27. The liquid container according to claim 20, further comprising a diffusion portion, provided in between said first detection portion and said second detection portion, for diffusing light reflected on said external wall surface of said liquid storage container, thereby preventing the light from returning to the light receptor.

28. The liquid container according to claim 27, wherein said second detection portion is a concave curved surface portion provided on said external wall surface of said liquid storage container, said diffusion portion is a rough surface formed integratedly on an external wall surface of a bottom surface of said liquid storage container, and an end portion of said concave curved surface portion is part of a circular arc.

29. The liquid container according to claim 27, wherein said diffusion portion is further projected outwardly from said external wall surface of said storage container as compared to said first detection portion, or is situated on a same surface level.

30. a liquid container comprising:

a liquid storage container for reserving liquid;

a liquid supply opening for supplying the liquid reserved in said liquid storage container externally;

a first detection portion provided on a surface of said liquid storage container, wherein when light is emitted, said first detection portion reflects different amounts of light depending on whether or not liquid in said liquid storage container exists; and a second detection portion provided in the vicinity of said first detection portion, wherein when light is emitted, said second detection portion reflects a predetermined amount of light; and a diffusion portion, provided in between said first detection portion and said second detection portion, for diffusing light reflected on an external wall surface of said liquid storage container, thereby preventing the light from returning to an externally provided light receptor.

31. The liquid container according to claim 30, wherein said first detection portion and said second detection portion are provided on a bottom surface of said liquid storage container.

32. The liquid container according to claim 30, wherein said diffusion portion is further projected outwardly from said external wall surface of said storage container as compared to said first detection portion, or is situated on a same surface level.

33. The liquid container according to claim 30, wherein said diffusion portion is a rough surface formed integratedly on said external wall surface of a bottom surface of said liquid storage container.

34. The liquid container according to claim 30, wherein said diffusion portion is a concave portion formed on said external wall of a bottom surface of said liquid container.

35. The liquid container according to claim 30, further comprising:

a plurality of liquid storage containers capable of respectively reserving plural types of liquid; and a plurality of prisms corresponding to said liquid storage containers, wherein a diffusion portion is provided in between said plurality of prisms.

36. A liquid-jet printing apparatus for performing printing by discharging liquid, comprising:

a liquid container having a first detection portion and a second detection portion adjacent to said first detection portion, on at least one surface of said liquid container;

a carriage capable of holding said liquid container and scanning along a direction in which said first and second detection portions are arranged;

optical means, provided along a scanning path of said carriage, capable of emitting light to said first and second detection portions of said liquid container and receiving reflected light;

control means for controlling to drive said optical means while moving said liquid container by said carriage in the vicinity of said optical means; and detection means for detecting existence/non-existence of liquid in said liquid container and/or existence/non-existence of said liquid container, based on reflected light received by said optical means, wherein said detection means comprises:

maximum value detection means for respectively obtaining maximum values of an amount of received reflected light when a relative portion of said liquid container and said optical means are within respective predetermined ranges;

comparison means for comparing the maximum values detected by said maximum value detection means with respective predetermined threshold values; and determination means for determining existence/non-existence of liquid in said liquid container and/or existence/non-existence of said liquid container, based on the comparison result obtained by said comparison means.

37. The liquid-jet printing apparatus according to claim 36, wherein said determination means first determines existence/non-existence of said liquid container, then determines existence/non-existence of liquid in said liquid container.

38. The liquid-jet printing apparatus according to claim 36, further comprising minimum value detection means for obtaining a minimum value of an amount of reflected light detected at a predetermined portion other than said first detection portion or said second detection portion, wherein said comparison means compares differences between the maximum values obtained by said maximum value detection means and the minimum value detected by said minimum value detection means, with predetermined threshold values respectively.

39. The liquid-jet printing apparatus according to claim 36, wherein said liquid container comprises:

a negative-pressure generating member accommodating chamber, having a liquid supply opening and an atmospheric-air communicating portion, for accommodating a negative-pressure-generating member; and a liquid storage, having a passage opening connected to said negative-pressure generating member accommodating chamber and forming a substantially enclosed space, wherein after said determination means in cooperation with the first detection portion detects existence/non-existence of liquid in said liquid container, a number of dots corresponding to liquid droplets discharged is counted and a request for exchanging said liquid container is displayed before consuming liquid in said negative-pressure generating member accommodating chamber.

40. The liquid-jet printing apparatus according to claim 36, further comprising an ink-jet printhead which serves as a liquid-jet head unit and performs printing by discharging ink.

41. The liquid-jet printing apparatus according to claim 40, wherein said printhead is a printhead which discharges ink by utilizing heat energy, and includes heat energy transducers for generating heat energy to be applied to the ink.

42. A light amount change receiving system for emitting light and receiving reflected light, comprising:

a prism formed with light transmitting material, having a surface constructing a part of an external wall surface of a container and plural reflection surfaces, which are different from said surface, each being in contact with contents of the container and having a predetermined angle with respect to a light path of the emitted light; and a diffusion portion, provided in between a light incident portion of said prism for receiving the emitted light and a light reflecting portion of said prism for reflecting the light, for diffusing light reflected on an external wall surface of the container, thereby preventing the light from being reflected, wherein the container and a source of the emitted light are separated from each other.

43. A liquid container attachable/detachable to/from a printing apparatus having optical means in which a light emission unit and a light receptor are fixed with a predetermined space, said liquid container being movable relative to the optical means, comprising:

a liquid storage container for storing liquid;

a prism formed with light transmitting material, having a surface constructing a part of an external wall surface of said liquid storage container and plural reflection surfaces, which are different from said surface, each being in contact with liquid and having a predetermined angle with respect to a light path of light; and a diffusion portion provided on a surface of said prism constructing a part of an external wall surface of said liquid storage container, for diffusing light reflected on an external-wall surface of said liquid storage container, thereby preventing the light from returning to the light receptor, wherein said diffusion portion is provided in between a light incident portion of said prism for receiving light from the light emission portion and a light reflecting portion of said prism for reflecting the light intended to return to the light receptor, and said liquid storage container and said optical means are separated from each other.

44. The liquid container according to claim 43, further comprising:

a negative-pressure generating member accommodating chamber, accommodating a negative-pressure-generating member and having a liquid supply opening and an atmospheric-air communicating portion, wherein said liquid storage container includes a passage opening connected to said negative-pressure generating member accommodating chamber and forming a substantially enclosed space, wherein said prism is provided in said liquid storage container.

* * * * *

UNITED STATES PATENT AND TRADEMARK OFFICE

CERTIFICATE OF CORRECTION

PATENT NO. : 6,361,136 B1 
DATED : March 26, 2002
INVENTOR(S) : Itaru Watanabe et al.

It is certified that error appears in the above-identified patent and that said Letters Patent is hereby corrected as shown below:

Title page,
Item [56], References Cited, FOREIGN PATENT DOCUMENTS,
"7218321" should read -- 7-218721 --;
"8112907" should read -- 8-112907 --;
"9 174877" should read -- 9-174877 --; and
"JP 9174877 7/1997 ..... B41J/2/175" should be deleted.

Column 9,
Line 27, "dr" should be deleted.

Column 16,
Line 14, "the-peak" should read -- the peak --.

Column 17,
Line 14, "conv ers ion" should read -- conversion --; "perform ed" should read -- performed --; and "me asured" should read -- measured --;
Line 15, "obt ai ned" should read -- obtained --;
Line 19, "aas" should read -- as --;
Line 25, "direct ly" should read -- directly --; and "th" should read -- the --; and
Line 26, "e" should be deleted.

Column 20,
Line 61, "sh own" should read -- shown --.

Column 22,
Line 34, "wid th" should read -- width --;
Line 35, "differ ent" should read -- different --; and
Line 48, "o" should be deleted.

UNITED STATES PATENT AND TRADEMARK OFFICE

CERTIFICATE OF CORRECTION

PATENT NO. : 6,361,136 B1
DATED : March 26, 2002
INVENTOR(S) : Itaru Watanabe et al.

It is certified that error appears in the above-identified patent and that said Letters Patent is hereby corrected as shown below:

Column 26,
Line 9, "1S." should read -- 15. --.

Signed and Sealed this

Eleventh Day of February, 2003

JAMES E. ROGAN
*Director of the United States Patent and Trademark Office*